US008210379B2

(12) United States Patent
Afflerbach et al.

(10) Patent No.: US 8,210,379 B2
(45) Date of Patent: Jul. 3, 2012

(54) COLLAPSIBLE CONTAINER

(75) Inventors: Robert H. Afflerbach, Bellevue, WA (US); David E. Griffin, Woodinville, WA (US); Vipin Kumar, Seattle, WA (US); Dustin Miller, Seattle, WA (US); John R. McKnight, Woodinville, WA (US); Craig M. Watjen, Bellevue, WA (US); Peter D. Wilson, Bellevue, WA (US)

(73) Assignee: Pacific Bin Corporation, Bellevue, WA (US)

( * ) Notice: Subject to any disclaimer, the term of this patent is extended or adjusted under 35 U.S.C. 154(b) by 899 days.

(21) Appl. No.: 12/110,021

(22) Filed: Apr. 25, 2008

(65) Prior Publication Data

US 2009/0266813 A1 Oct. 29, 2009

(51) Int. Cl.
*B65D 6/24* (2006.01)
*B65D 90/08* (2006.01)

(52) U.S. Cl. ..... 220/4.31; 220/4.32; 220/617; 220/683

(58) Field of Classification Search ..... 220/4.28, 220/4.31, 4.32, 617, 683, 684, 685, 1.5; 217/13, 217/65

See application file for complete search history.

(56) References Cited

U.S. PATENT DOCUMENTS 2,839,750 A * 6/1958 Kaltenbacher ..... 342/428
2,862,640 A 12/1958 Somayia
2,869,750 A 1/1959 Doerr et al.
3,261,493 A * 7/1966 Smith ..... 217/65
3,266,656 A 8/1966 Kridle
3,809,278 A 5/1974 Csumrik
3,968,531 A * 7/1976 Cartwright ..... 449/30
4,057,165 A 11/1977 Kardell
4,422,558 A 12/1983 Mittelmann et al.
4,456,142 A * 6/1984 Burling ..... 220/4.28
(Continued)

FOREIGN PATENT DOCUMENTS

JP 06100074 4/1994
(Continued)

OTHER PUBLICATIONS

Page 1 from www.schoellerarcasystems.com/Europe/Home/ operated by Schoeller Arca Systems and depicting the ComboLife 270, printed Jul. 19, 2007.

*Primary Examiner* — Mickey Yu
*Assistant Examiner* — Niki Eloshway
(74) *Attorney, Agent, or Firm* — Davis Wright Tremaine LLP; George C. Rondeau, Jr.; Heather M. Colburn

(57) ABSTRACT

A collapsible container for containing goods, including a liquid and/or solid/liquid mixture, configured to be assembled and disassembled manually without the use of tools. The container includes a plurality of upright panels coupled to a base by their bottom portions. Each panel of a first type is flanked along its opposing upright edges by a pair of adjacent panels of a second type. Each of the edges of each of the panels is coupled by an edge joining assembly to one of the edges of one of the flanking panels. The assembly comprises a first elongated edge joining member having a longitudinal channel with alternating partially enclosed portions and substantially unenclosed portions and a second elongated edge joining member having longitudinally extending spaced apart locking members. Each unenclosed portion is configured to receive a locking member, which are slid longitudinally within the channel into an adjacent partially enclosed portion.

27 Claims, 38 Drawing Sheets

U.S. PATENT DOCUMENTS

| | | | | | |
|---|---|---|---|---|---|
| 4,711,361 | A | * | 12/1987 | Mischenko | 220/4.28 |
| 4,884,715 | A | * | 12/1989 | Pohlmann | 220/683 |
| 5,012,943 | A | * | 5/1991 | King | 220/4.32 |
| 5,058,746 | A | * | 10/1991 | Morgan, IV | 206/597 |
| 5,289,933 | A | | 3/1994 | Streich et al. | |
| 5,555,980 | A | | 9/1996 | Johnston | |
| 5,638,973 | A | | 6/1997 | Dewey | |
| 5,829,364 | A | | 11/1998 | Urbach | |
| 5,862,931 | A | | 1/1999 | Cox et al. | |
| 6,460,724 | B1 | | 10/2002 | Bradford | |
| 6,577,699 | B1 | * | 6/2003 | Minshall | 376/272 |
| 6,748,876 | B2 | | 6/2004 | Preisler et al. | |
| 6,966,449 | B2 | * | 11/2005 | Williams | 220/4.31 |
| 7,287,661 | B2 | | 10/2007 | Knutsson et al. | |
| 8,033,410 | B2 | | 10/2011 | Afflerbach et al. | |
| 2004/0129699 | A1 | * | 7/2004 | Williams | 220/4.31 |
| 2006/0065655 | A1 | | 3/2006 | Taylor | |

FOREIGN PATENT DOCUMENTS

| | | |
|---|---|---|
| KR | 2019960003666 | 5/1996 |

* cited by examiner

COLLAPSIBLE CONTAINER

BACKGROUND OF THE INVENTION

1. Field of the Invention

The present invention is directed generally to collapsible containers and more particularly to collapsible containers for storing and transporting industrial goods and food products including liquids and solid/liquid mixtures.

2. Description of the Related Art

Presently, many liquid and solid/liquid mixtures are stored and/or transported in wooden boxes or containers lined with one or more sheets of plastic. The wooden containers include a plurality of uprighted and interconnected side panels extending upwardly from a base and defining an open interior of the container. The open interior may be covered by a removable lid disposed along the top portions of the panels. The lid is secured to the top portions of the panels by metal banding or strapping wrapped around the outside of the container. The uprighted panels may also be held in place by metal banding or strapping.

These prior art containers have several drawbacks. For example, they are bulky and heavy. Because the wood is porous, the contents of the container may rot or become infested or otherwise contaminated. Assembly and disassembly of these containers requires tools such as banding tools and cutters to remove bands. The banding is hazardous and creates a risk of injury caused by wood splinters and the sudden release of energy stored in the metal banding. Further, repeated assembly and disassembly damages the wood and after repeated assembly/disassembly cycles, renders the wood unsuitable for container construction.

Therefore, a need exists for a collapsible container for storing liquid and solid/liquid mixtures. A further need exists for a collapsible container that may be assembled and disassembled manually without the use of tools. A need also exists for a method of securing a lid to the panels of the container without the use of metal banding. Further, a need exists for shipping and/or storage containers constructed from a non-porous material that prevents rot, infestation, and contamination.

BRIEF DESCRIPTION OF THE SEVERAL VIEWS OF THE DRAWING(S)

DETAILED DESCRIPTION OF THE INVENTION

As used herein, the term "goods" refers to materials and items that may be placed into a container for storage and/or transport. These materials and items include without limitation personal property, articles of trade, wares, merchandise, agricultural products, processed food products, bulk solid items, liquids, and the like. In particular embodiments, the term "goods" may refer to liquid/solid suspensions including food products As used herein, the term "composite material" refers to a material constructed using two or more component materials combined to produce a material with properties considered superior to the properties of either component material alone. Composite materials may include a fiber material embedded in a matrix material. For example, composite materials may include a synergistic mixture of glass fibers and a polymer, such as polypropylene, polyethylene terephthalate (PET), and polyvinyl chloride (PVC). When glass fibers are properly combined with the polymer, the resultant composite material may have substantial strength and stiffness relative to its weight. Composite materials characteristically perform over a broad temperature range and may be used to reduce the complexity of many structures.

Figure 1A:
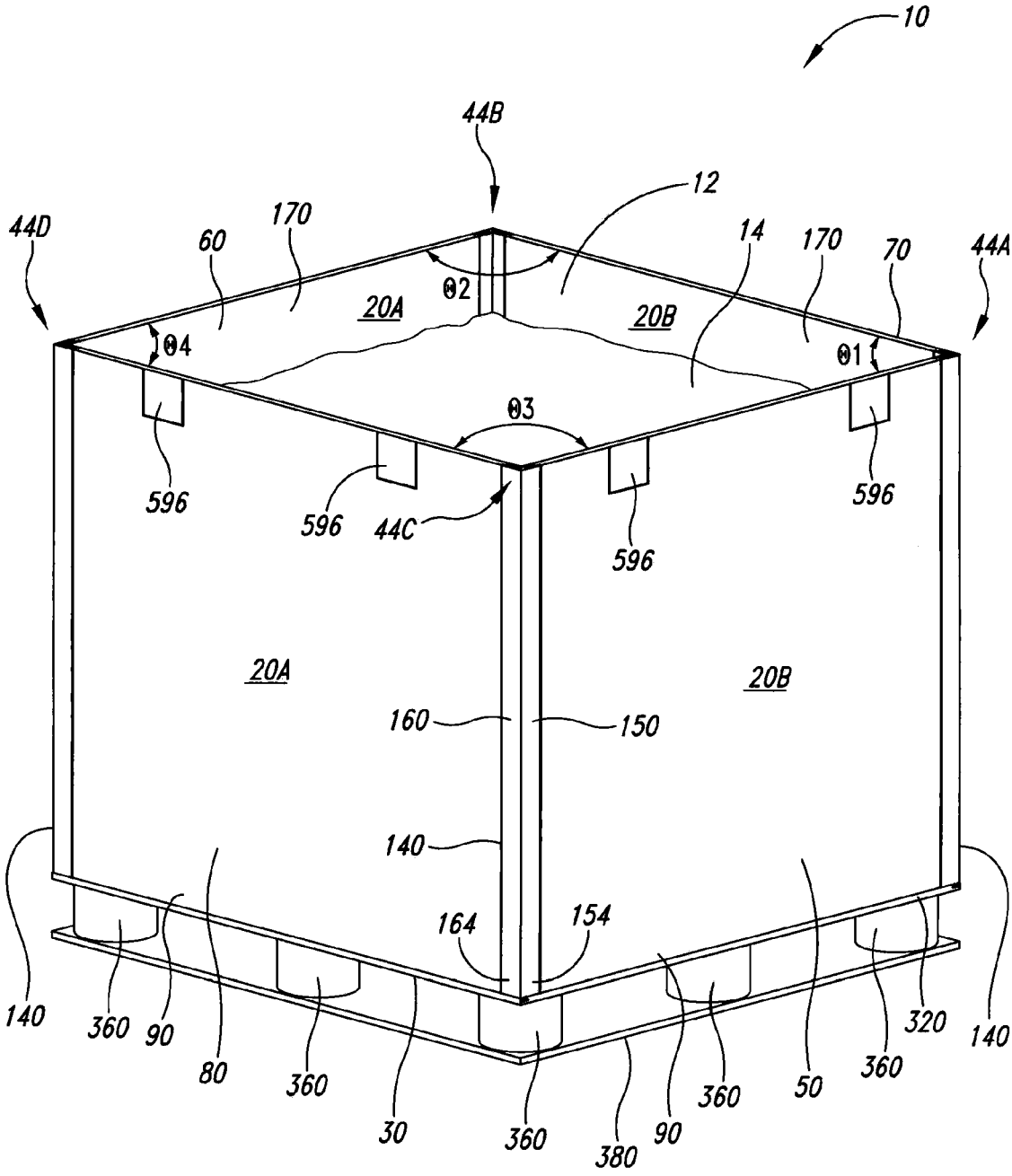
FIG. 1A is a perspective view of a collapsible container constructed in accordance with the present invention.

The present invention is directed toward a collapsible container 10. Referring to FIG. 1A, the container 10 has an interior 12 containing or housing one or more goods 14. The container 10 is configured to be disassembled or collapsed manually without the aid of tools. Further, the container 10 may be reassembled manually without the aid of tools. The container 10 maintains its functional characteristics after repeated assembly/disassembly cycles. The container 10 is configured to store goods during transport, such as transport via conventional means known in the art including truck, rail, airplane, barge, ship, and the like. The container 10 may be transported by a forklift, pallet jack, and the like. In various embodiments, several containers 10 may be stacked atop one another during transport and/or storage.

Figure 1B:
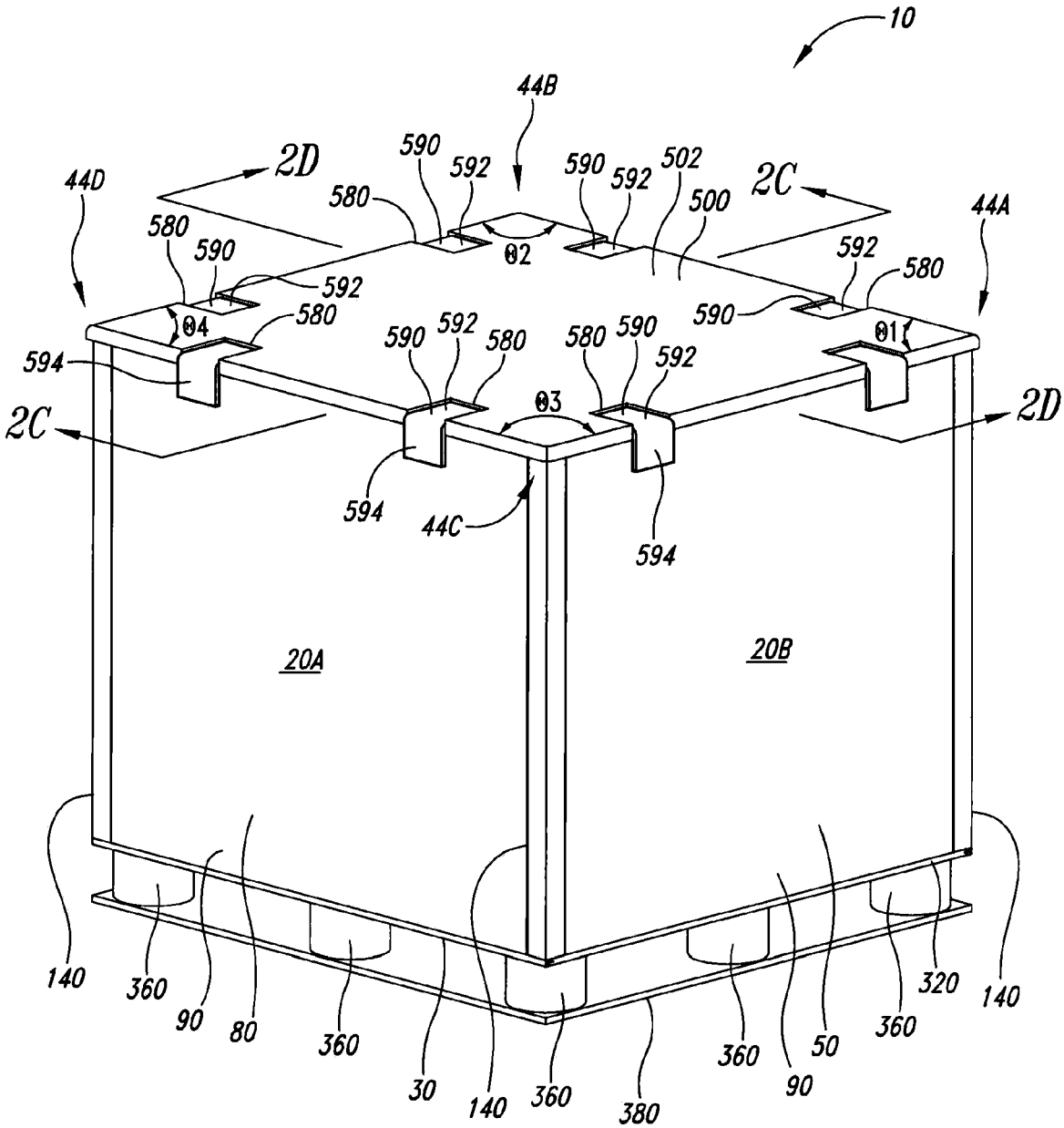
FIG. 1B is a perspective view of the collapsible container of FIG. 1A including an optional lid and Velcro straps used to secure the lid.

Referring to FIGS. 1A-1B, the collapsible container 10 includes a plurality of panels 20, referred to specifically as a plurality of uprighted panels 20A of a first panel type and a plurality of uprighted panels 20B of a second panel type. The uprighted panels 20A and 20B are constructed from a composite material. By way of example, suitable composite materials for use with the present invention may be obtained from High Impact Technology (PO Box 230196, Tigard, Oreg. 97281 having a website at www.hit-usa.com), Plascore Inc. (615 N. Fairview Street, Zeeland Mich. 49464 having a website at http://www.plascore.com/), WebCore Technologies, Inc. (8821 Washington Church Road, Miamisburg, Ohio 45342 having a website at http://www.webcoreonline.com/), and the like. In various embodiments, the panels 20A and 20B may be constructed using a foam core sandwiched between two sheets of composite material. Suitable foam core material may be purchased from Sealed Air Corporation having a website at http://www.sealedair.com/.

The use of composite materials to construct the panels 20A and 20B may produce panels that are lightweight when compared to the prior art wooden panels used to construct containers. The challenges of using the composite material to construct the container 10 led to the invention of novel edge joining components and structures. Aspects of the present invention relate to how the panels 20A and 20B are joined to a base 30 as well as how adjoining panels 20A and 20B are connected together to form corners 44A, 44B, 44C, and 44D of the container 10. As will be discussed in detail below, the panels 20A of the first panel type differ from the panels 20B of the second panel type in the manner in which the panels 20A of the first panel type are coupled to the base 30.

Referring to FIGS. 2A-2D, each of the uprighted panels 20A and 20B are substantially planar and rectangular in shape, having a bottom portion 90, a top portion 100 opposing the bottom portion 90, a first side portion 110 extending between the bottom portion 90 and the top portion 100, and a second side portion 120 opposite the first side portion 110 and extending between the bottom portion 90 and the top portion 100.

Each of the panels 20A and 20B is coupled by its bottom portion 90 to the base 30. The base 30 has a perimeter portion 130 defining a central or center portion 132. The bottom portion 90 of each of the uprighted panels 20 is arranged around the perimeter portion 130 of the base 30 in an alternating fashion with each of the panels 20A of the first panel type being flanked by a pair of panels 20B of the second panel type. Each of the panels 20 has an inside facing face 170 defining a portion of the interior 12 of the container 10 and an outward facing face 180 opposing the inside facing face 170. Each of the panels 20 may have a thickness defined between the outward facing face 180 and the inside facing face 170 of about 0.5 inches to about 2 inches. In particular embodiments, the thickness of the panels 20 may be about 0.75 inches to about one inch.

In the embodiment depicted in FIGS. 2A-2D, the plurality of panels 20 includes a front panel 50, a back panel 60, a first side panel 70, and a second side panel 80. The first side panel 70 and the second side panel 80 are of the first panel type. The front panel 50 and the back panel 60 are of the second panel type. In alternate embodiments, the first side and the second side panels 70 and 80 are of the second panel type and the front and the back panels 50 and 60 are of the first panel type. Because the container 10 may be perceived in various orientations the terms "front," "back," "first side," and "second side" are used merely for illustrative purposes and do not limit the scope of the present invention.

Each of the panels 20A and 20B is coupled to the pair of panels flanking it by an edge joining assembly 140 (see FIG. 1A). Each of the edge joining assemblies 140 may be used to construct one of the corners 44A, 44B, 44C, and 44D of the container 10. However, as will be described with reference to an alternate embodiment (see FIGS. 11-13), the corners 44A, 44B, 44C, and 44D may be formed in the panels 20A of the first panel type or the panels 20B of the second panel type separate from the edge joining assemblies 140. Each of the panels 20A of the first panel type is coupled along its first side portion 110 to the first side portion 110 of one of the panels 20B of the second panel type flanking the panel 20A. Each of the panels 20A of the first panel type is also coupled along its second side portion 120 to the second side portion 120 of the other panel 20B of the second panel type flanking the panel 20A.

The edge joining assembly 140 may include a first elongated joining member 150 and a second elongated joining member 160. The first elongated joining member 150 longitudinally engages the second elongated joining member 160 and locks therewith to prevent the lateral disengagement of the first elongated joining member 150 from the second elongated joining member 160.

Figure 2A:
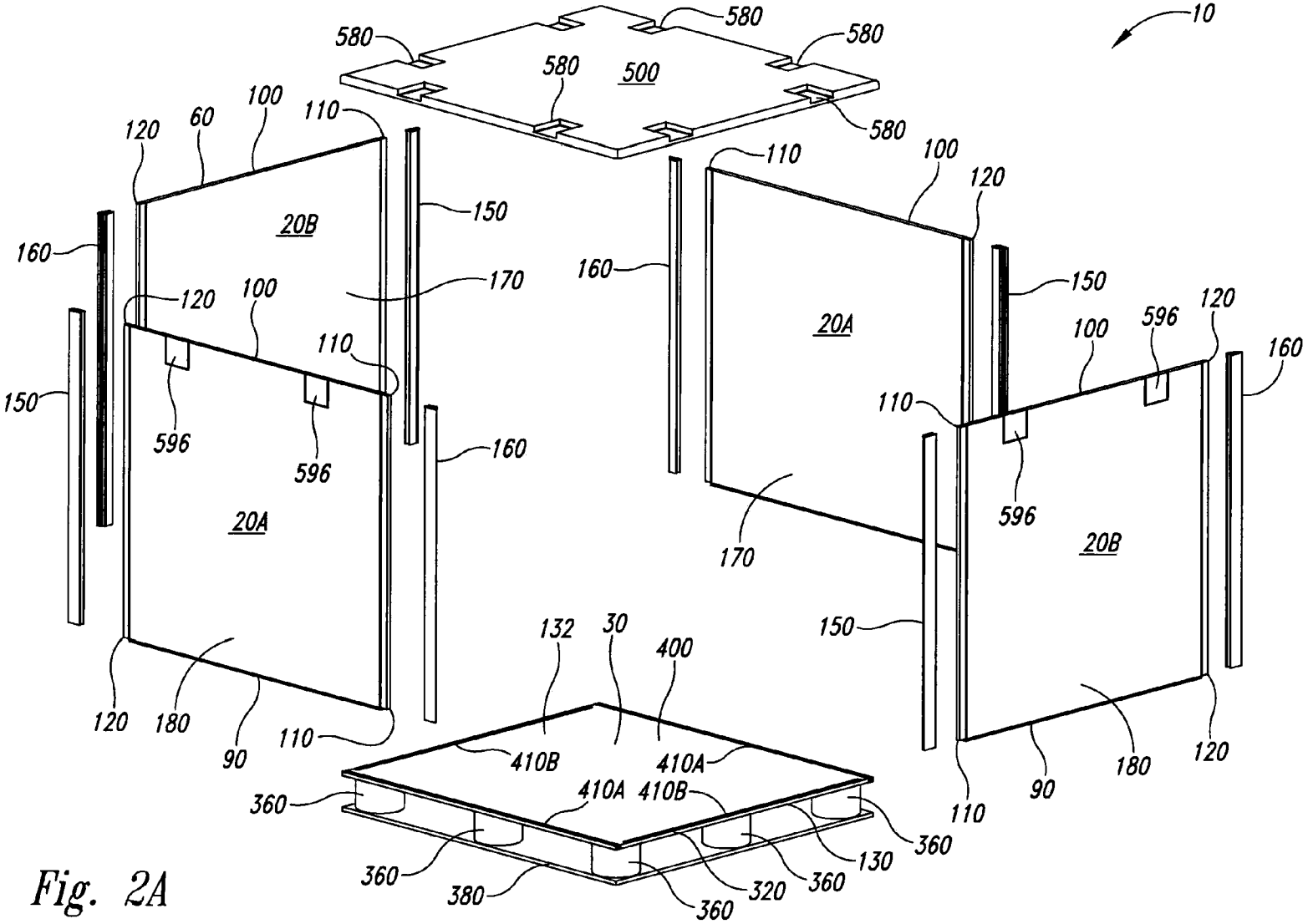
FIG. 2A is an exploded perspective view of the collapsible container of FIG. 1B including the optional lid. The Velcro straps used to secure the lid have been removed to provide a better view of aspects of the container.
Figure 2B:
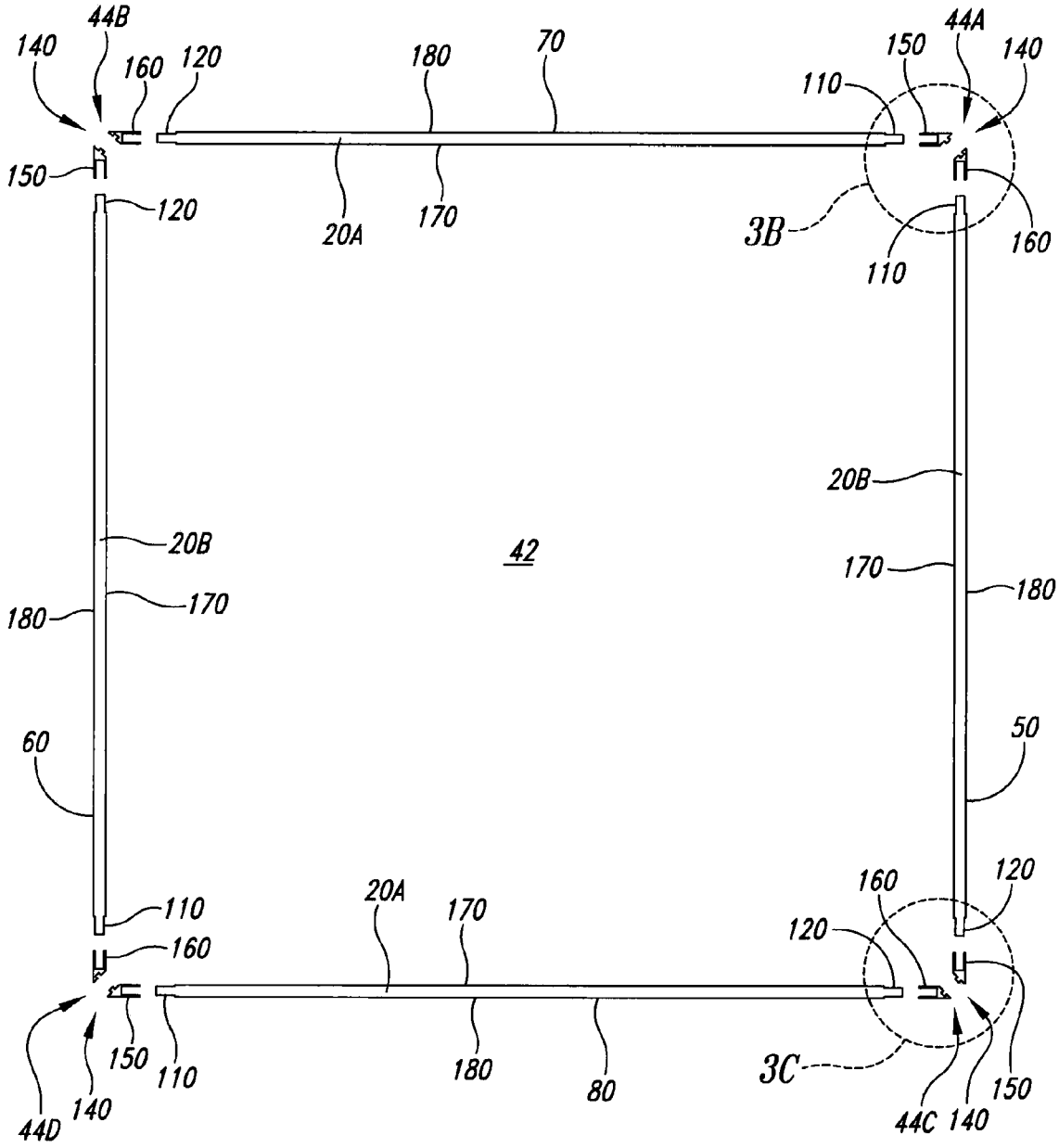
FIG. 2B is an exploded cross-sectional top view of the collapsible container of FIG. 2A taken through a plane substantially parallel to the bottom panel of the base of the container.
Figure 2C:
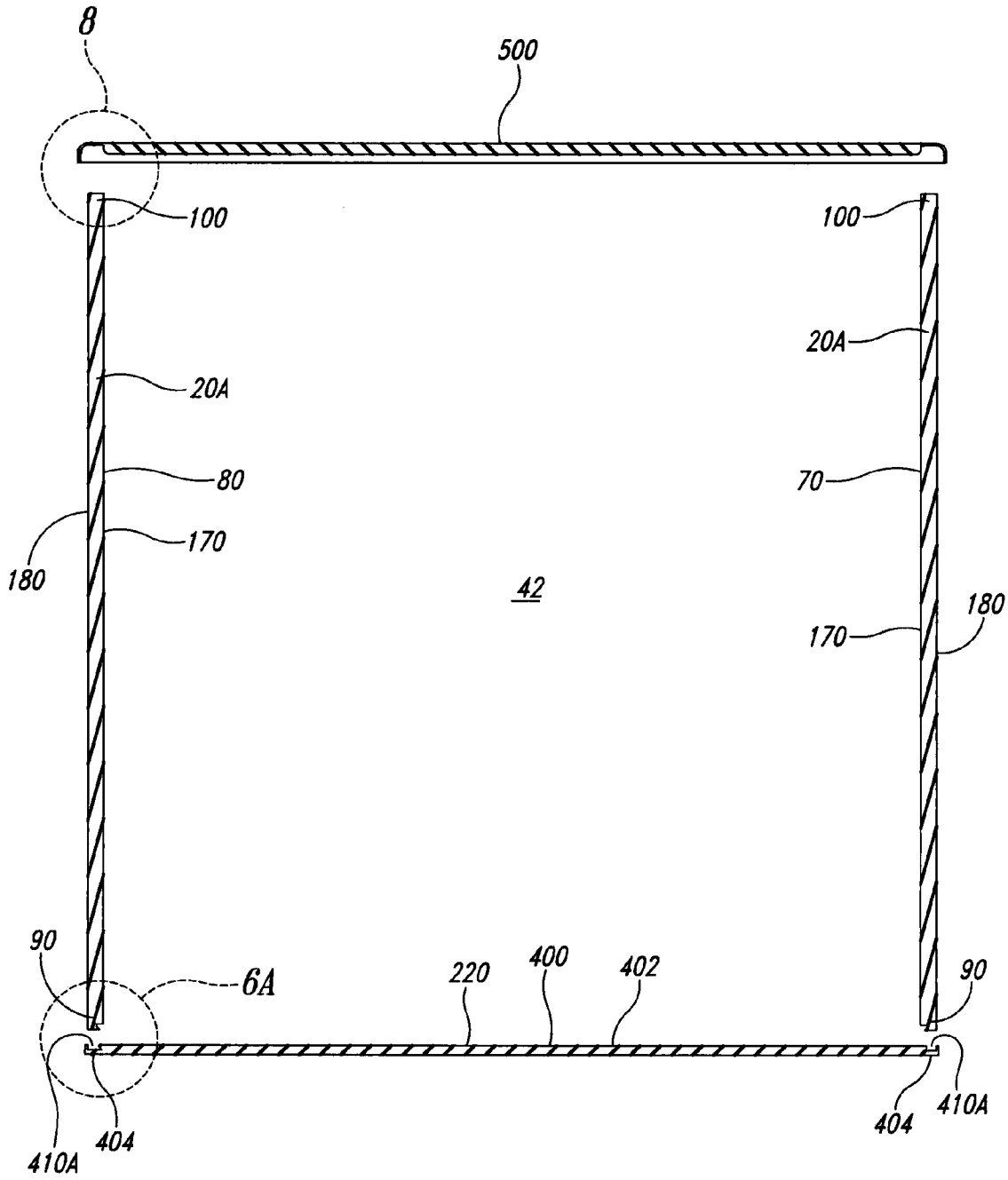
FIG. 2C is an exploded cross-sectional view of the collapsible container of FIG. 2A with its optional lid raised slightly taken through a plane substantially parallel to the front panel of the container.
Figure 2D:
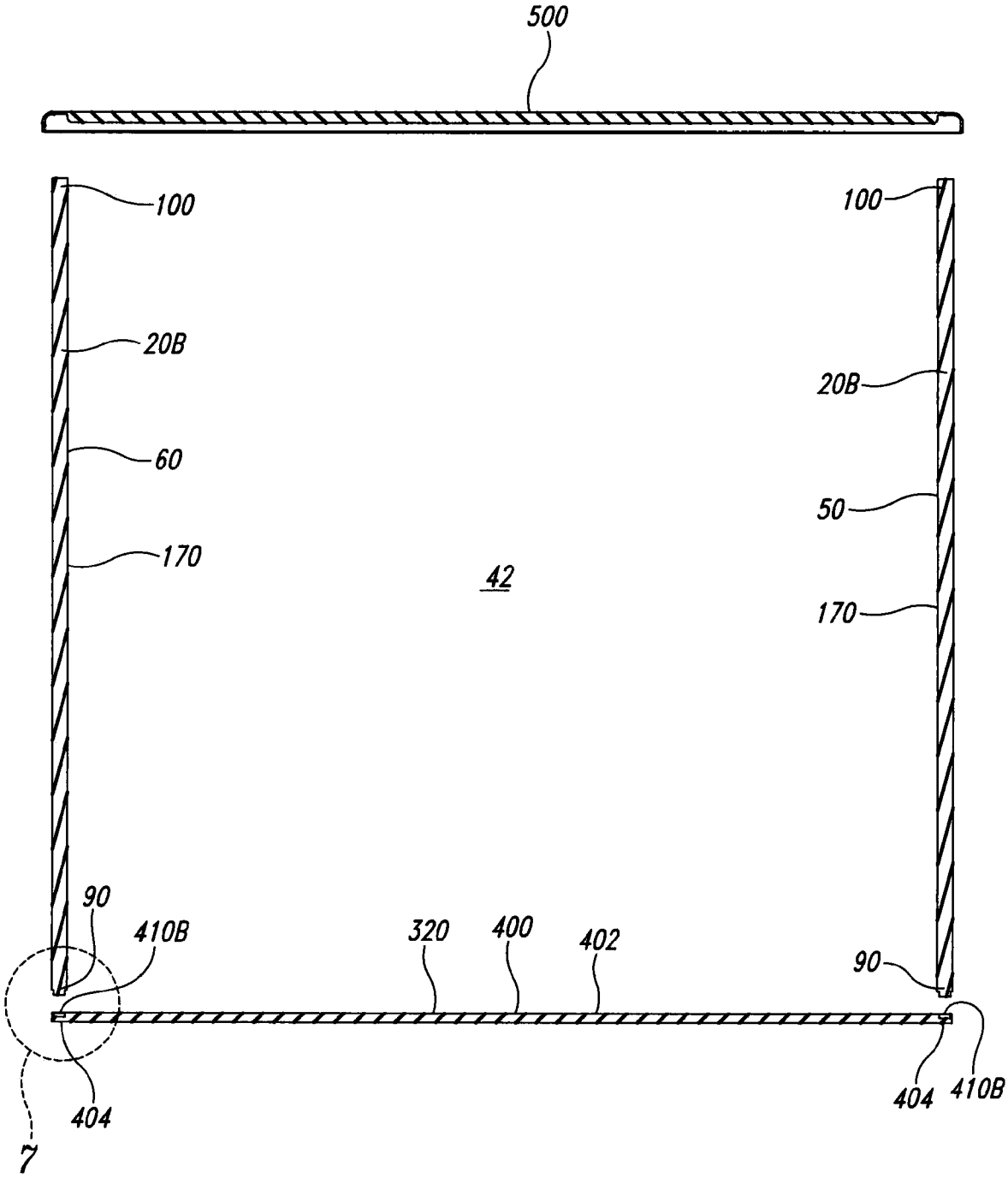
FIG. 2D is an exploded cross-sectional view of the collapsible container of FIG. 2A with its optional lid raised slightly taken through a plane substantially parallel to the first side panel of the container.

In the embodiment depicted in FIG. 2B, the first side portion 110 of the front panel 50 is adjacent to the first side portion 110 of the first side panel 70. Either the first elongated joining member 150 or second elongated joining member 160 is coupled to the first side portion 110 of the front panel 50. The other of the first elongated joining member 150 and second elongated joining member 160 is coupled to the first side portion 110 of the first side panel 70. The longitudinal locking engagement of the first elongated joining member 150 and the second elongated joining member 160 couples the front panel 50 to the first side panel 70 and prevents their lateral disengagement. The longitudinally locked together first elongated joining member 150 and the second elongated joining member 160 may form a first corner 44A between the front panel 50 and the first side panel 70. The first corner 44A may have a first angle "θ1." The first angle "θ1" is preferably about 90°. However, embodiments in which the angle "θ1" is greater or less than about 90° are also within the scope of the present invention.

The second side portion 120 of the back panel 60 is adjacent to the second side portion 120 of the second side panel 80. Either the first elongated joining member 150 or second elongated joining member 160 is coupled to the second side portion 120 of the back panel 60. The other of the first elongated joining member 150 and second elongated joining member 160 is coupled to the second side portion 120 of the second side panel 80. The longitudinal locking engagement of the first elongated joining member 150 and the second elongated joining member 160 couples the back panel 60 to the second side panel 80 and prevents their lateral disengagement. The longitudinally locked together first elongated joining member 150 and the second elongated joining member 160 may form a second corner 44B between the back panel 60 and the second side panel 80. The second corner 44B may have a second angle "θ2." The second angle "θ2" is preferably about 90°. However, embodiments in which the angle "θ2" is greater or less than about 90° are also within the scope of the present invention.

The second side portion 120 of the front panel 50 is adjacent to the second side portion 120 of the second side panel 80. Either the first elongated joining member 150 or second elongated joining member 160 is coupled to the second side portion 120 of the front panel 50. The other of the first elongated joining member 150 and second elongated joining member 160 is coupled to the second side portion 120 of the second side panel 80. The longitudinal locking engagement of the first elongated joining member 150 and the second elongated joining member 160 couples the front panel 50 to the second side panel 80 and prevents their lateral disengagement. The longitudinally locked together first elongated joining member 150 and the second elongated joining member 160 may form a third corner 44C between the front panel 50 and the second side panel 80. The third corner 44C may have a third angle "θ3." The third angle "θ3" is preferably about 90°. However, embodiments in which the angle "θ3" is greater or less than about 90° are also within the scope of the present invention.

The first side portion 110 of the back panel 60 is adjacent to the first side portion 110 of the second side panel 80. Either the first elongated joining member 150 or second elongated joining member 160 is coupled to the first side portion 110 of the back panel 60. The other of the first elongated joining member 150 and second elongated joining member 160 is coupled to the first side portion 110 of the second side panel 80. The longitudinal locking engagement of the first elongated joining member 150 and the second elongated joining member 160 couples the back panel 60 to the second side panel 80 and prevents their lateral disengagement. The longitudinally locked together first elongated joining member 150 and the second elongated joining member 160 may form a fourth corner 44D between the back panel 60 and the second side panel 80. The fourth corner 44D may have a fourth angle "θ4." The fourth angle "θ4" is preferably about 90°. However, embodiments in which the angle "θ4" is greater or less than about 90° are also within the scope of the present invention.

As is also appreciated by those of ordinary skill, while the container 10 has been described as having a total of four panels, two each of panels 20A and 20B, it is apparent to those of ordinary skill that a container (not shown) having more than four panels 20A and 20B may be constructed by joining a greater number of panels 20A and 20B together pair-wise using the edge joining assemblies 140 and such embodiments are within the scope of the present invention.

Edge Joining Assembly 140

Figure 3A:
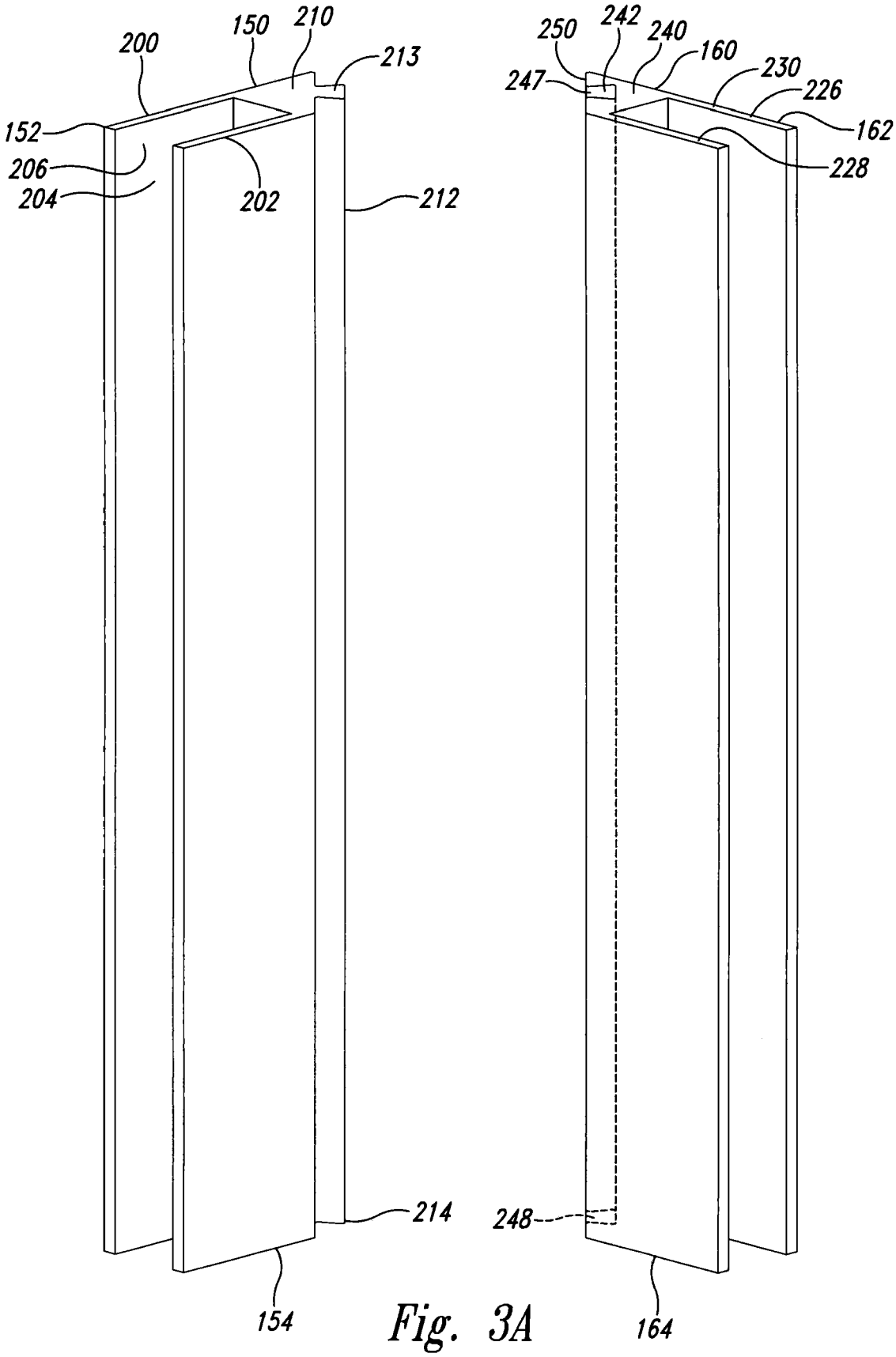
FIG. 3A is an enlarged perspective view of first and second elongated edge joining members of an edge joining assembly of the container of FIG. 1A.
Figure 3B:
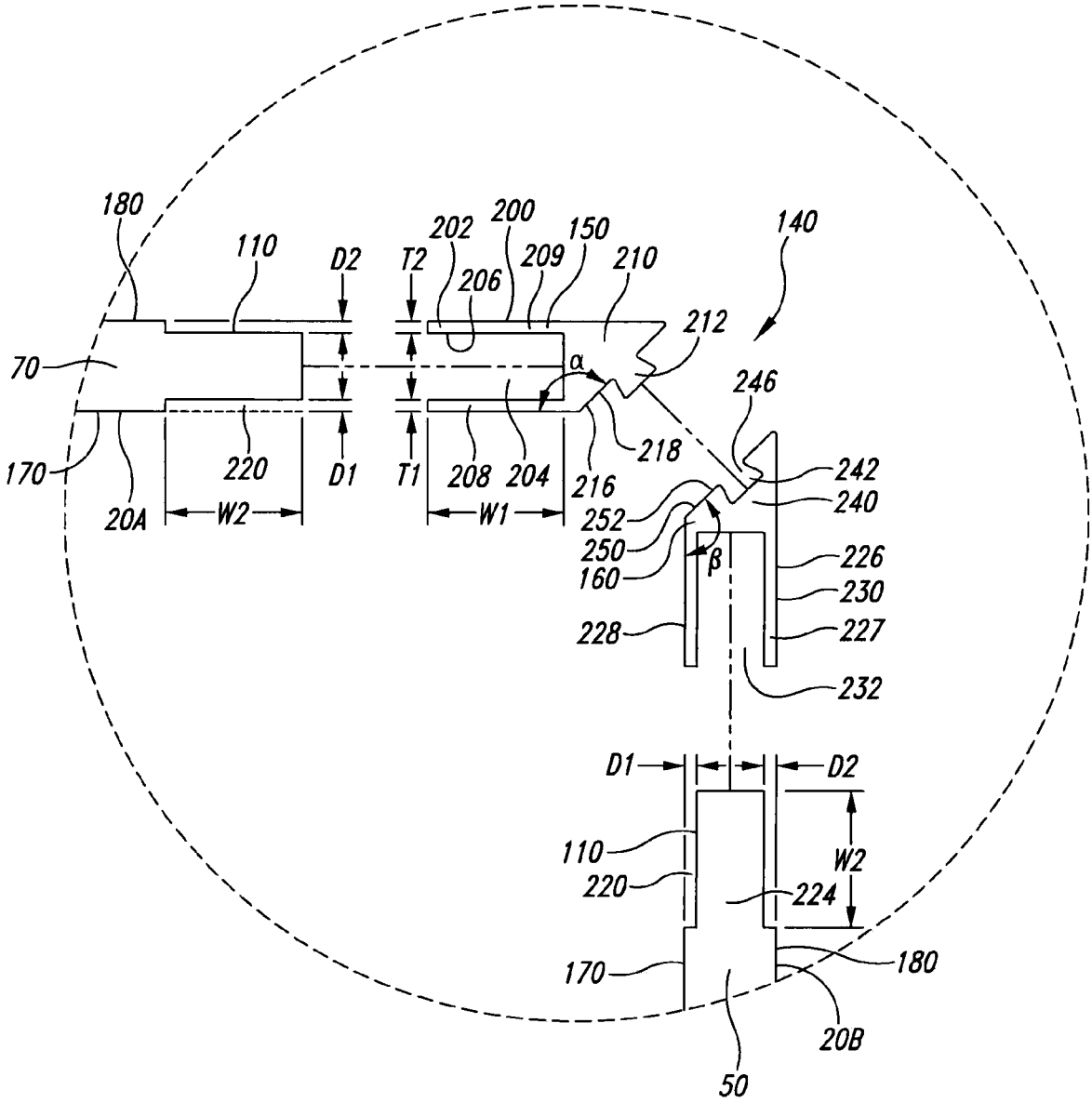
FIG. 3B is an enlarged fragmentary view of a portion of FIG. 2B depicting one of the corners of the container.
Figure 3C:
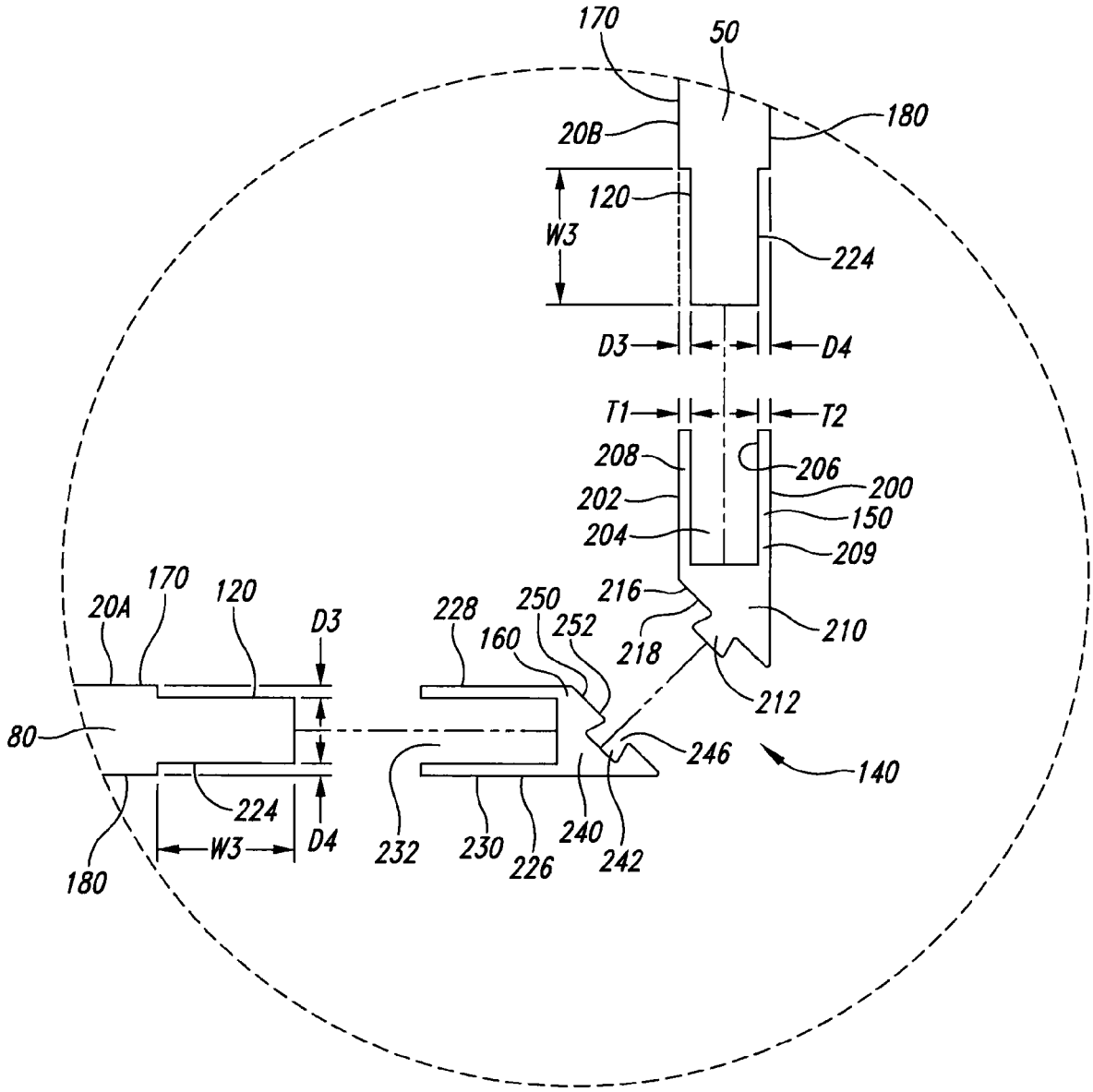
FIG. 3C is an enlarged fragmentary view of a portion of FIG. 2B depicting another one of the corners of the container.

Referring to FIGS. 3A-3C, the structure of the edge joining assembly 140 will now be described. The first elongated joining member 150 has a top end portion 152 opposing a bottom end portion 154. The second elongated joining member 160 has a top end portion 162 opposing a bottom end portion 164. The first elongated joining member 150 and the second elongated joining member 160 of the edge joining assembly 140 may be constructed using conventional plastic processing technologies, including extrusion. In particular embodiments, the first elongated joining member 150 and the second elongated joining member 160 may be constructed using extruded PVC. By way of a non-limiting example, Extrusion Technology Company (2411 104th Street Court South, Lakewood, Wash. 98499) offers suitable plastic processing technology to construct the first elongated joining member 150 and the second elongated joining member 160.

The first elongated joining member 150 includes a connector 200 integrally formed with or coupled to a locking portion 210. The connector 200 is configured to be coupled to either the first side portion 110 or the second side portion 120 of one of the panels 20A and 20B.

In the embodiment depicted in FIGS. 3A-3C, the connector 200 includes a longitudinally extending sleeve or connector portion 202. The connector portion 202 may have a generally U-shaped cross-sectional shape with an interior 204 sized and shaped to receive one of the first side portion 110 and the second side portion 120 of one of the panels 20A and 20B. As is apparent to those of ordinary skill in the art, the connector portion 202 may be configured to receive selectively only the first side portion 110 or the second side portion 120. Alternatively and as depicted in FIGS. 3B and 3C, the connector portion 202 may be configured to receive the first side portion 110 and the second side portion 120 interchangeably.

In various embodiments, the first side portion 110 includes a relieved portion 220 (see FIG. 3B). In these embodiments, the connector portion 202 may be sized and shaped to receive the relieved portion 220 of the first side portion 110 therein. In various embodiments, the second side portion 120 includes a relieved portion 224 (see FIG. 3C). In these embodiments, the connector portion 202 may be sized and shaped to receive the relieved portion 224 of the first second side portion 120 therein.

One or more of the inside surfaces 206 disposed along the interior 204 of the connector portion 202 may be affixed to the relieved portion 220 of the first side portion 110 or the relieved portion 224 of the second side portion 120. In various embodiments, the inside surfaces 206 of the connector portion 202 are adhered to the relieved portion 220 of the first side portion 110 or the relieved portion 224 of the second side portion 120 using chemical or mechanical means known in the art.

Referring to FIG. 3B, the interior 204 of the connector portion 202 may be defined between a longitudinally extending inside sidewall 208 and a substantially identical longitudinally extending spaced apart outside sidewall 209. The relieved portion 220 of the first side portion 110 may have a depth "D1" from the inside facing face 170 and a depth "D2" from the outside facing face 180. Referring to FIG. 3C, the relieved portion 224 of the second side portion 120 may have a depth "D3" from the inside facing face 170 and a depth "D4" from the outside facing face 180.

Returning to FIG. 3B, in various embodiments, the inside sidewall 208 may have a thickness T1 that is approximately equal to the depth "D1" of the relieved portion 220. The outside sidewall 209 may have a thickness "T2" that is approximately equal to the depth "D2" of the relieved portion 220. In alternate embodiments, the inside sidewall 208 may have a thickness T1 that is approximately equal to the depth "D3" (see FIG. 3C) of the relieved portion 224. The outside sidewall 209 may have a thickness "T2" that is approximately equal to the depth "D4" (see FIG. 3C) of the relieved portion 224. As is apparent to those of ordinary skill, the connector portion 202 may receive either the first side portion 110 or the second side portion 120, interchangeably without an appreciable difference in the outside appearance of the container 10, if the depth "D1" is approximately equal to the depth "D3" and the depth "D2" is approximately equal to the depth "D4." Consequently, it may be desirable for the depth "D1" to be approximately equal to the depth "D3" and the depth "D2" to be approximately equal to the depth "D4."

Each of the inside sidewall 208 and the outside sidewall 209 may have a width "W1." The relieved portion 220 may have a width "W2" that is approximately equal to the width "W1" of the inside sidewall 208 and the outside sidewall 209. The relieved portion 224 may have a width "W3" that is approximately equal to the width "W1" of the inside sidewall 208 and the outside sidewall 209. The relieved portion 220 may be formed in the first side portion 110 by removing surface material from the inside facing face 170 and/or the outside facing face 180 along a portion of the first side portion 110 using any conventional method(s) known in the art such as milling, planing, sanding, sawing, and the like Alternatively, the relieved portion 220 may be molded or otherwise formed at the desired size without the need for removing material. In particular embodiments, the first side portion 110 may be compressed to form the relieved portion 220. The relieved portion 224 may be similarly formed in the second side portion 120 using any method suitable for forming the relieved portion 220 in the first side portion 110.

The locking portion 210 includes an outwardly projecting, longitudinally extending key portion 212. The elongated key portion 212 has a top end portion 213 formed in the top end portion 152 of the first elongated joining member 150 and a bottom end portion 214 formed in the bottom end portion 154 of the first elongated joining member 150. In the embodiment depicted in FIGS. 3A-3C, the locking portion 210 includes an angled stop wall 216. In various embodiments, the key portion 212 projects outwardly in a direction substantially orthogonal to the angled stop wall 216.

While the embodiment of the key portion 212 depicted in the drawings has a generally tapered cross-sectional shape that is narrower near mating surface 218 and widens the farther the key portion 212 projects therefrom, those of ordinary skill in the art appreciate that alternate cross-sectional shapes, including a generally T-shaped or knob-shaped cross-sectional shape (see a key portion 1212 depicted in FIG. 14B), are within the scope of the present invention.

An angle "$\alpha$" may be defined between the mating surface 218 of the angled stop wall 216 and the inside sidewall 208. In various embodiments, the angle "$\alpha$" is about 45°. In alternate embodiments, the angle "$\alpha$" is about 90°. In further embodiments, the angle "$\alpha$" is about 180°. The invention is not limited by the magnitude of the angle "$\alpha$" and alternate magnitudes of the angle "$\alpha$" are within the scope of the invention.

The second elongated joining member 160 may include a connector 226 integrally formed with or coupled to a locking portion 240. The connector 226 is configured to be coupled to either the first side portion 110 or the second side portion 120 of one of the panels 20. The connector 226 may be substantially identical to the connector 200 of the first elongated long member 150. The connector 226 may include a connector portion 227 substantially similar to the connector portion 202. In particular embodiments, the connector 226 may include an inside sidewall 228 spaced from an outside sidewall 230 and defining an interior 232 therebetween. The inside sidewall 228 may be substantially identical to the inside sidewall 208 of the connector portion 202 and the outside sidewall 230 may be substantially identical to the outside sidewall 209 of the connector portion 202.

Referring to FIG. 3A, the locking portion 240 includes a longitudinally extending keyway portion 242 having a longitudinally extended open-ended channel 246 configured to receive the key portion 212 of the first elongated joining member 150. The open-ended channel 246 has a top open end 247 formed in the top end portion 162 of the second elongated joining member 160 and a bottom open end 248 formed in the bottom end portion 164 of the second elongated joining member 160. A first portion of the edge joining assemblies 140 may be assembled by slidably inserting the bottom end portion 214 of the key portion 212 into the top open end 247 or the bottom open end 248 of the channel 246, depending on the orientation of the first elongated joining member 150 and the second elongated joining member 160. A second portion of the edge joining assemblies 140 may be assembled by slidably inserting the top end portion 213 of the key portion 212 into the top open end 247 or the bottom open end 248 of the channel 246, depending on the orientation of the first elongated joining member 150 and the second elongated joining member 160.

Referring to FIGS. 2B and 3A, at the corner 44A, the edge joining assembly 140 is assembled by slidably inserting the top end portion 213 of the key portion 212 into the bottom open end 248 of the channel 246. At the corner 44B, the edge joining assembly 140 is assembled by slidably inserting the bottom end portion 214 of the key portion 212 into the top open end 247 of the channel 246. At the corner 44C, the edge joining assembly 140 is assembled by slidably inserting the bottom end portion 214 of the key portion 212 into the top open end 247 of the channel 246. At the corner 44D, the edge joining assembly 140 is assembled by slidably inserting the top end portion 213 of the key portion 212 into the bottom open end 248 of the channel 246. As is apparent to those of ordinary skill, in the embodiment depicted in the drawings, the corners 44A and 44C may be assembled simultaneously and the corners 44B and 44D may be assembled simultaneously.

The locking portion 240 of the second elongated joining member 160 may include an angled stop wall 250. In various embodiments, the channel 246 of the keyway portion 242 extends inwardly into the locking portion 240 in a direction substantially orthogonal to the angled stop wall 250.

While the embodiment of the channel 246 of the keyway portion 242 depicted in the drawings has a generally tapered cross-sectional shape that is wider near mating surface 252 and narrows as the keyway portion 242 extends inwardly into the locking portion 240, those of ordinary skill in the art appreciate that alternate cross-sectional shapes, including a generally T-shaped or knob-shaped cross-sectional shape (see a keyway portion 1242 depicted in FIG. 14B), are within the scope of the present invention. As is appreciated by those of ordinary skill in the art, the keyway portion 242 has a shape that complements and locks with the key portion 212.

An angle "β" may be defined between the mating surface 252 of the angled stop wall 250 and the inside sidewall 228 of the connector 226. In various embodiments, the angle "β" is about 45°. In alternate embodiments, the angle "β" is about 90°. In further embodiments, the angle "β" is about 180°. The invention is not limited by the magnitude of the angle "β" and alternate magnitudes of the angle "β" are within the scope of the invention.

The angled stop wall 216 of the locking portion 210 of the first elongated joining member 150 bears against the angled stop wall 250 of the locking portion 240 of the second elongated joining member 160 when the key portion 212 of the first elongated joining member 150 is received inside the keyway portion 242 of the second elongated joining member 160. In this manner, the angles "α" and "β" of the angled stop walls 216 and 250 determine the angles "θ1," "θ2," "θ3," and "θ4," defined between the adjacent panels 20 at the corners 44A, 44B, 44C, and 44D, respectively.

Figure 4A:
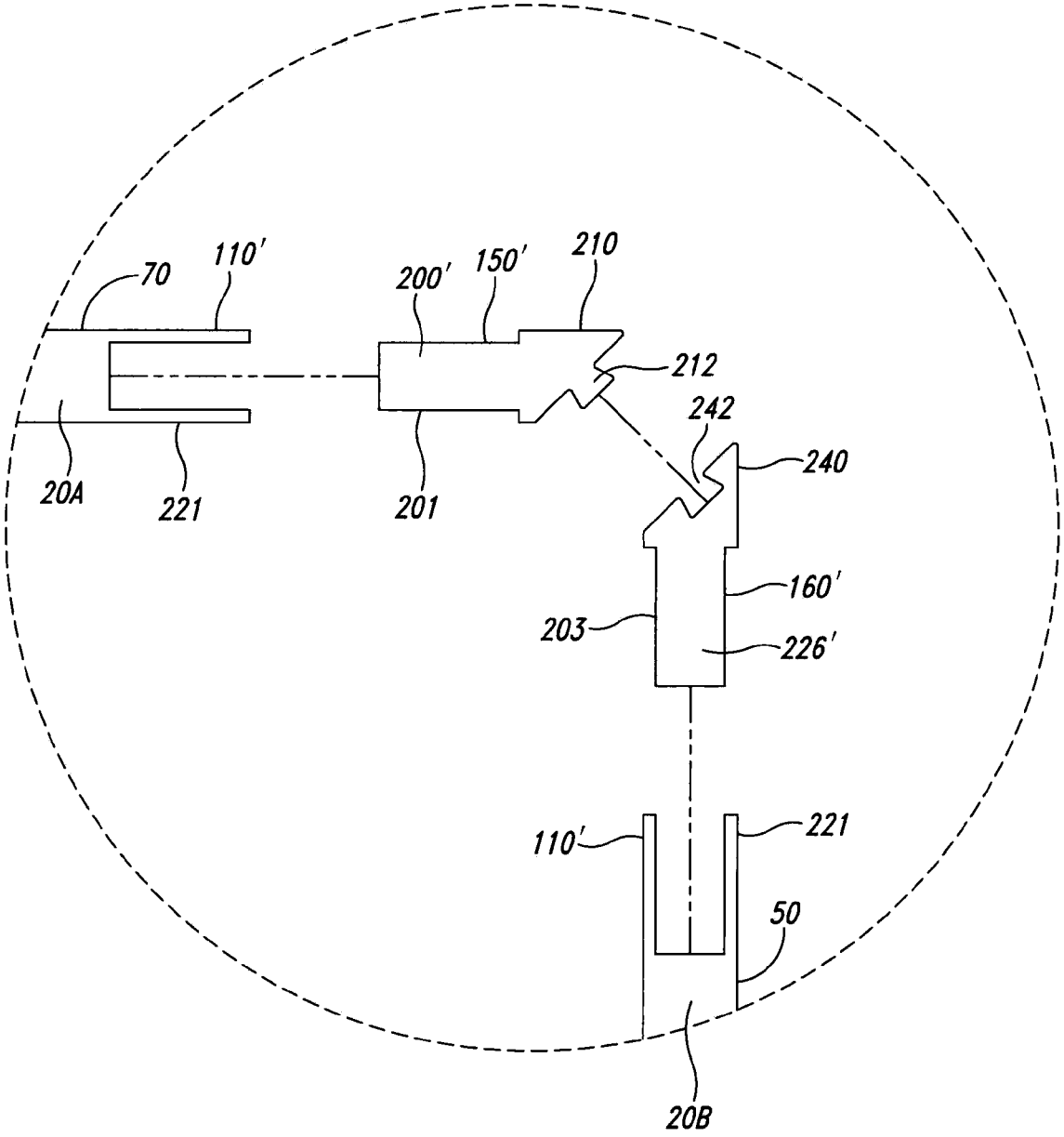
FIG. 4A is a fragmentary cross-sectional top view taken through a plane substantially parallel to the bottom panel of the base depicting an alternate embodiment of the first and second elongated edge joining members of a first edge joining assembly.
Figure 4B:
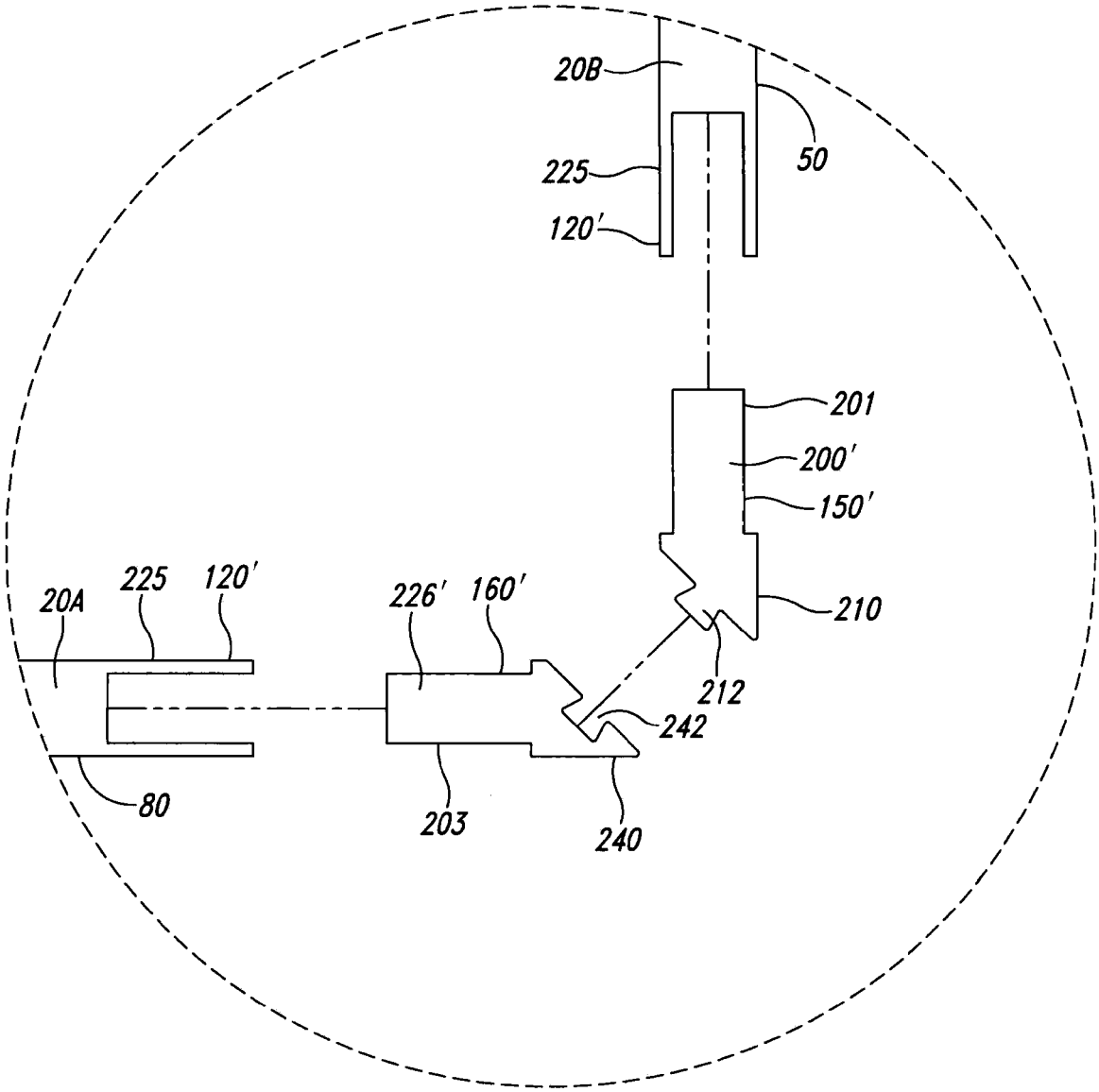
FIG. 4B is a fragmentary cross-sectional top view taken through a plane substantially parallel to the bottom panel of the base depicting an alternate embodiment of the first and second elongated edge joining members of a second edge joining assembly.

With reference to FIGS. 4A and 4B, an alternate embodiment of the connector 200 of the first elongated joining member 150 and the connector 226 of the second elongated joining member 160 will now be described. The first elongated joining member 150' includes a connector 200' having a relieved portion 201 substantially similar to the relieved portion 220 of the first side portion 110. The second elongated joining member 160' includes a connector 226' having a relieved portion 203 substantially similar to the relieved portion 201. In this embodiment, the first side portions 110' of each of the panels 20A and the panels 20B include a connector portion 221 formed therein that is substantially similar to the connector portion 202 of the connector 200. The second side portions 120' of each of the panels 20A and the panels 20B include a connector portion 225 formed therein that is substantially similar to the connector portion 227 of the connector 200.

As is apparent to those of ordinary skill, the connector portion 221 may be configured to receive preferentially only the relieved portion 201. Alternatively, the connector portion 221 may be configured to receive preferentially only the relieved portion 203. In alternate embodiments, such as the one shown in FIGS. 4A and 4B, the connector portion 221 is configured to receive non-preferentially either the relieved portion 201 or the relieved portion 203. Similarly, the connector portion 225 may be configured to preferentially receive only the relieved portion 201 or preferentially receive only the relieved portion 203. In the embodiment depicted in FIGS. 4A and 4B, the connector portion 225 is configured to receive non-preferentially either the relieved portion 201 or the relieved portion 203.

The connector portion 221 may be coupled or affixed to the relieved portion 201 or the relieved portion 203 in any manner suitable for coupling the connector portion 202 to the relieved portion 220 of the first side portion 110. The connector portion 225 may be coupled or affixed to the relieved portion 201 or the relieved portion 203 using any method suitable for coupling or affixing the connector portion 221 to one of the relieved portion 201 and the relieved portion 203.

The connector portion 221 may be formed in the first side portion 110' using any conventional method(s) known in the art such as milling, planing, sanding, sawing, and the like, or formed at the desired size without removing material. In particular embodiments, the connector portion 221 may be formed using extrusion techniques. The connector portion 225 may be formed in the second side portion 120' using any method suitable for forming connector portion 221 in the first side portion 110'. The relieved portion 201 may be formed in the connector 200' using any method suitable for forming the relieved portion 220 in the first side portion 110. Alternatively, the relieved portion 201 may be formed in the connector 200' in the same manner the key portion 212 is formed in the locking portion 210 of the first elongated joining member 150. The relieved portion 203 may be formed in the connector 226' using any method suitable for forming the relieved portion 201 in the connector 200'.

As is apparent to those of ordinary skill, one of the first and second elongated joining members 150 and 160 may include the connector 200 while the other of the first and second elongated joining members 150 and 160 includes the connector 200'. In various embodiments, the relieved portion 220 may be formed in the first side portion 110 permitting it to be coupled to one of the first elongated joining member 150 and the second elongated joining member 160 but not the other. As is apparent to those of ordinary skill, in such embodiments, because the first side portion 110 includes the relieved portion 220, the second side portion 120 includes the connector portion 225. In alternate embodiments, the first side portion 100 includes the connector portion 202 and the second side portion 120 includes the relieved portion 220.

Figure 14A:
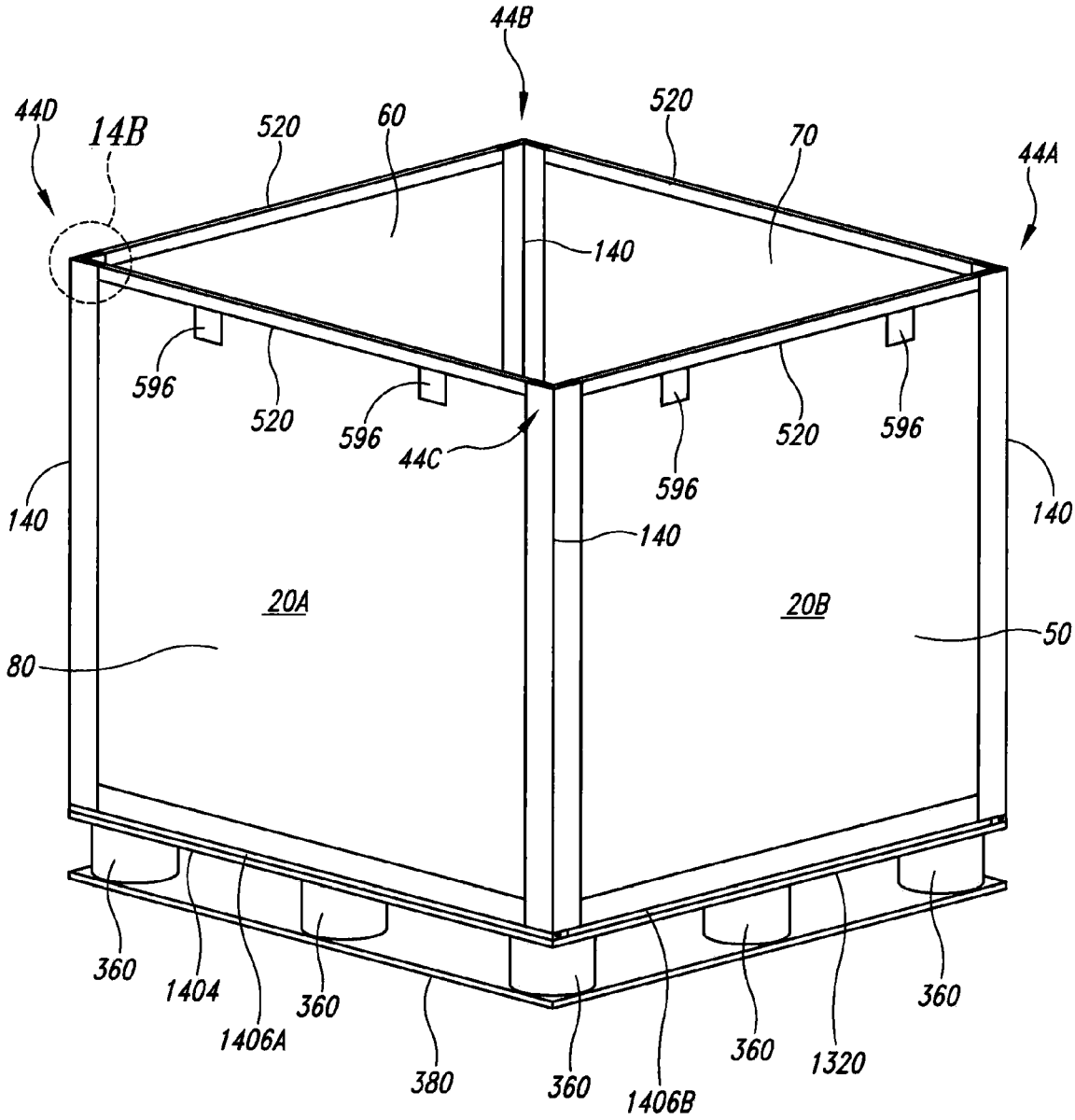
FIG. 14A is a perspective view of an alternate embodiment of the collapsible container constructed in accordance with the present invention.
Figure 14B:
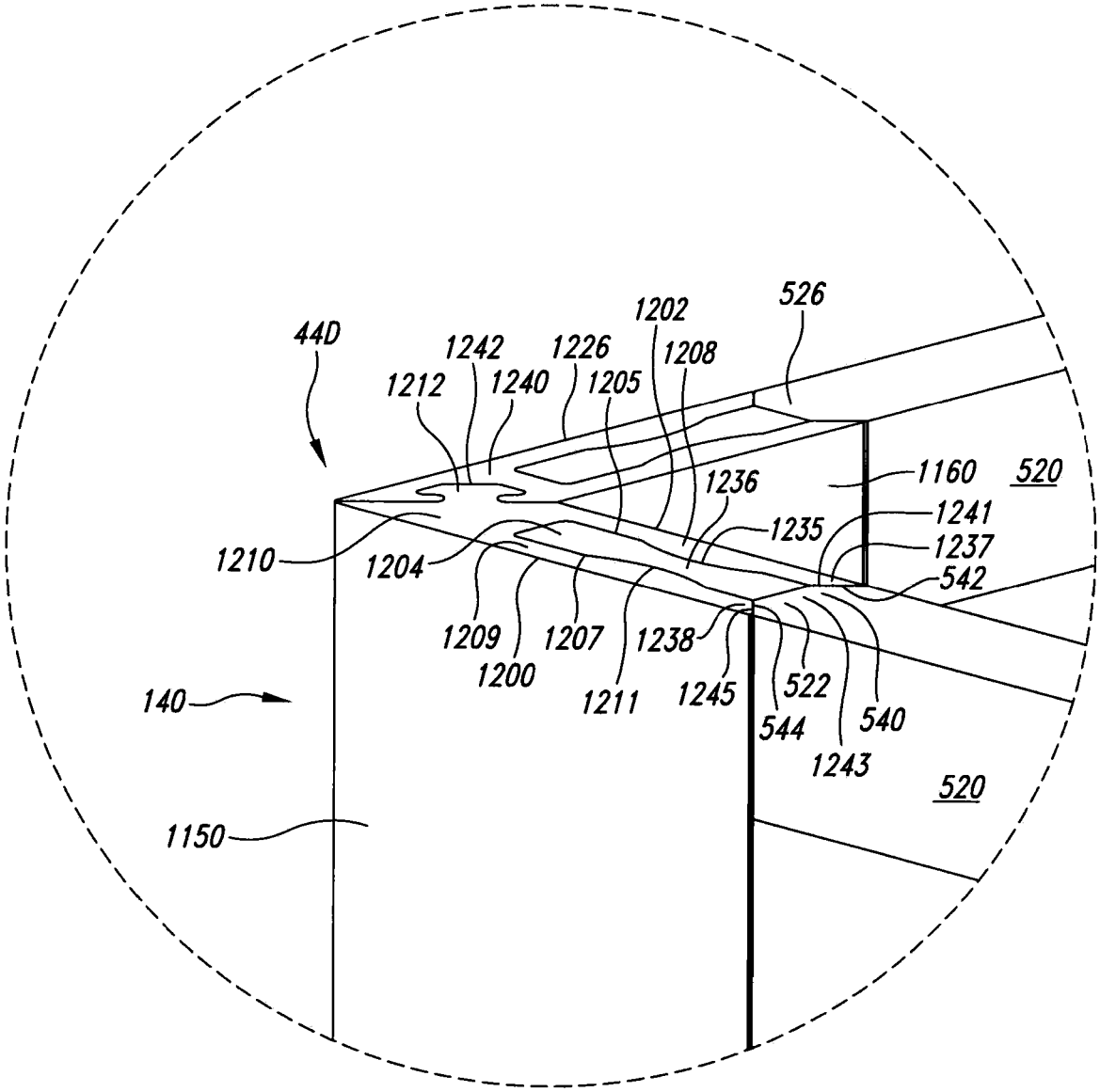
FIG. 14B is an enlarged fragmentary perspective view of a portion of FIG. 14A depicting a corner and edge joining assembly of the container.

With reference to FIGS. 14A and 14B, another alternate embodiment of the first elongated joining member 150 and the second elongated joining member 160 will now be described. The first elongated joining member 1150 includes a connector 1200 integrally formed or coupled to a locking portion 1210. The locking portion 1210 may be substantially similar to the locking portion 210 depicted in FIG. 3A. Alternatively, as illustrated in FIG. 14B, the key portion 1212 may have a generally T-shaped or knob-shaped cross-sectional shape.

The connector 1200 includes a connector portion 1202. The connector portion 1202 includes a longitudinally extending inside sidewall 1208 spaced apart from a longitudinally extending spaced apart outside sidewall 1209 and defining an interior 1204 therebetween. The inside sidewall 1208 includes a contoured surface 1205 facing into the interior 1204. The contoured surface 1205 includes an inwardly projecting portion 1235 that projects into the interior 1204 between the sidewalls 1208 and 1209, thereby narrowing a portion 1236 of the interior 1204 adjacent the inwardly projecting portion 1235.

The outside sidewall 1209 includes a contoured surface 1207 facing the interior 1204. The contoured surface 1207 includes an inwardly projecting portion 1211 that projects into the interior 1204 between the sidewalls 1208 and 1209, thereby further narrowing the portion 1236 of the interior 1204 adjacent the inwardly projecting portion 1211. In the embodiment depicted in FIG. 14B, the inwardly projecting portion 1235 of the inside sidewall 1208 is juxtaposed across the interior 1204 with the inwardly projecting portion 1211 of the outside sidewall 1209.

The inside sidewall 1208 has an inside distal end 1237 and the outside sidewall 1209 has an outside distal end 1238. The inside distal end 1237 includes a tapered sidewall 1241 extending distally and outwardly from the inside facing contoured surface 1205, widening the interior 1204 between the distal ends 1237 and 1238. The outside distal end 1238 includes a tapered sidewall 1245 extending distally and outwardly from the inside facing contoured surface 1207, widening the interior 1204 between the distal ends 1237 and 1238. An open-ended tapered portion 1243 of the interior 1204 may be defined between the tapered sidewalls 1241 and 1245.

The second elongated joining member 1160 includes a connector 1226 integrally formed or coupled to a locking portion 1240. The connector 1226 may be substantially identical to the connector 1200 of the first elongated joining member 1150. The locking portion 1240 may be substantially similar to the locking portion 240 depicted in FIG. 3A. Alternatively, as illustrated in FIG. 14B, the keyway portion 1242 may have a generally T-shaped or knob-shaped cross-sectional shape configured to receive the generally T-shaped or knob-shaped key portion 1212.

In embodiments of the container 10 that include the first elongated joining member 1150 and second elongated joining member 1160, the relieved portion 220 of the first side portion 110 and the relieved portion 224 of the second side portion 120 may be shaped substantially similarly to the interior 1204 of the connector 1200 of the first elongated joining member 1150. For example, the inside facing face 170 along the relieved portion 220 of the first side portion 110 may include a recessed portion (not shown) configured to receive the inwardly projecting portion 1235 of the inside sidewall 1208 and the outside facing face 180 along the relieved portion 220 of the first side portion 110 may include a recessed portion (not shown) configured to receive the inwardly projecting portion 1211 of the outside sidewall 1209. In this manner, the inwardly projecting portions 1235 and 1211 may be seated inside the recessed portions to resist disengagement of the first elongated joining member 1150 or the second elongated joining member 1160 from the first side portion 110. The recessed portions may formed by compressing a portion of the first side portion 110. Alternatively, the recessed portions may be formed using any conventional method(s) known in the art such as milling, planing, sanding, sawing, and the like. In further embodiments, the recessed portions may be molded or otherwise formed at the desired size without the need for removing material.

In various embodiments, the relieved portion 224 of the second side portion 120 may be shaped in a substantially identical manner allowing the inwardly projecting portions 1235 and 1211 to be seated inside the recessed portions and thereby resist disengagement of the first elongated joining member 1150 or the second elongated joining member 1160 from the second side portion 120.

The connector portion 1202 may be coupled or affixed to the relieved portion 220 or the relieved portion 224 in any manner suitable for coupling the connector portion 202 to the relieved portion 220 of the first side portion 110 or the relieved portion 224 of the second side portion 120. As is apparent to those of ordinary skill, the various corners 44A, 44B, 44C, and 44D may be constructed using any of the of the embodiments of the edge joining assembly 140 disclosed herein. Further, different embodiments of the edge joining assembly 140 may be used to construct the various corners 44A, 44B, 44C, and 44D of a single embodiment of the container 10.

Base 30

Referring to FIGS. 1A and 2A, the base 30 may include a bottom panel 320 supported above the ground by a plurality of spaced apart legs 360. The spaced apart legs 360 may be arranged to permit the tines of a forklift or pallet jack to be inserted therebetween. In this manner, the container 10 may be lifted by the bottom panel 320 of the base 30 using a forklift, pallet jack, and the like. The spaced apart legs 360 may be arranged upon and affixed to a platform 380. The vertical distance between the bottom panel 320 and the platform 380 traversed by the spaced apart legs 360 may be large enough to accommodate the tines of a forklift, pallet jack, and the like. In the embodiment depicted in the figures, each of the spaced apart legs 360 has a substantially cylindrical shape. However as apparent to those of ordinary skill in the art alternate shapes, such as rectangular, square, tapered, and the like, are within the scope of the present invention. As a non-limiting example, an embodiment of the base 30 may be purchased from Buckhorn Inc. of 55 West TechneCenter Drive, Milford, Ohio 45150, which has a website at http://www.buckhorninc.com/.

Figure 5:
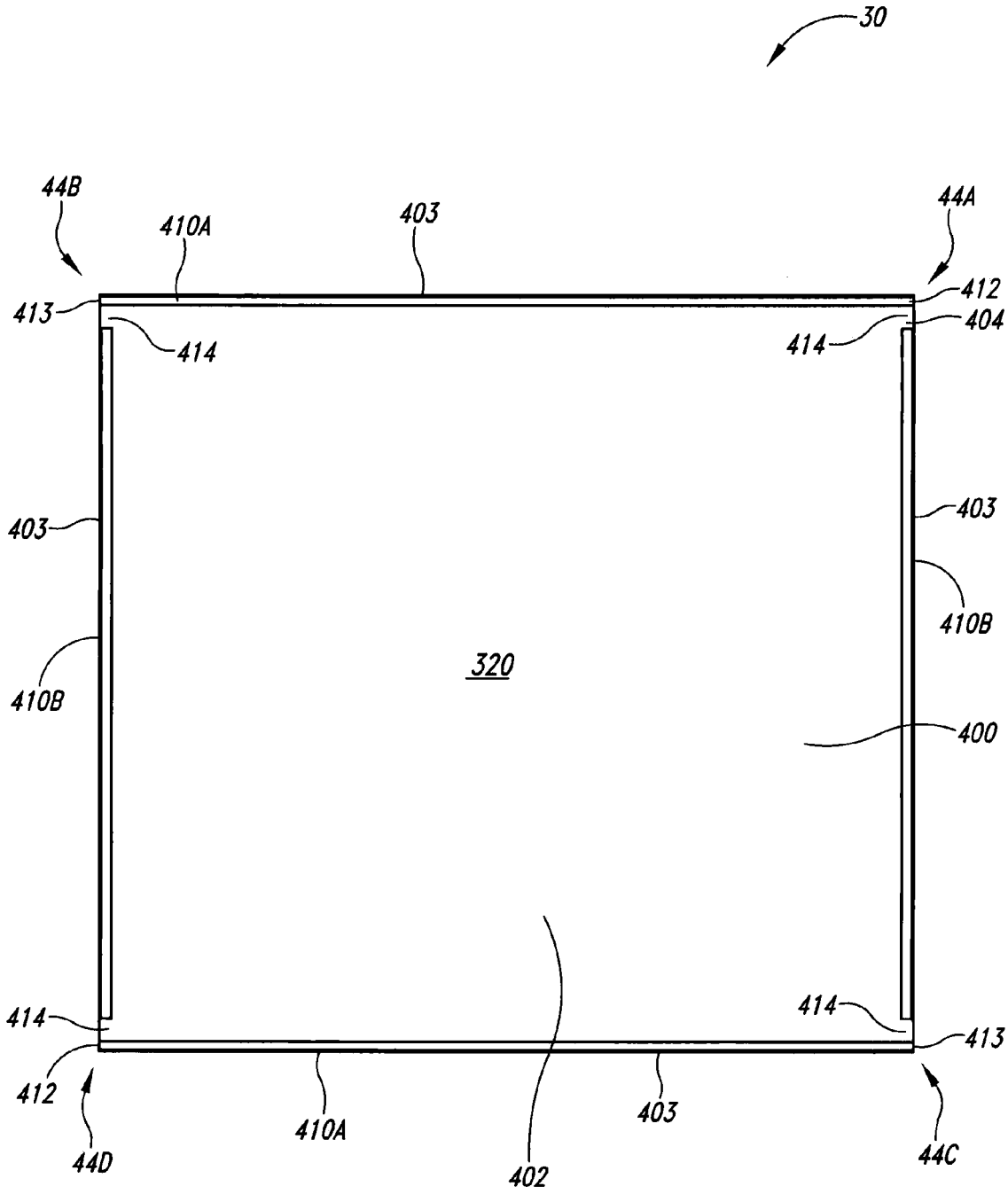
FIG. 5 is a top view of the bottom panel of the base of the collapsible container of FIG. 1A.

Referring to FIG. 5, the bottom panel 320 has a top surface 400 for receiving and supporting the goods 14 contained in the container 10. The top surface 400 includes a perimeter portion 404 defining an inside portion 402. The inside portion 402 serves as a bottom for the interior 12 of the container 10. The perimeter portion 404 may include a side 403 corresponding to each of the panels 20A and 20B.

In the embodiment depicted in FIG. 5, the top surface 400 of the bottom panel 320 includes a plurality of grooves 410A and 410B arranged along the perimeter portion 404. Each of the grooves 410A and 410B corresponds to one of the panels 20A and 20B, respectively. As mentioned above, the panels 20A are of the first panel type and the panels 20B are of the second panel type. Similarly, the grooves 410A are of a first groove type and grooves 410B are of a second groove type. Each of the grooves 410A of the first groove type corresponds to a single panel 20A of the first panel type and each of the grooves 410B of the second groove type corresponds to a single panel 20B of the second panel type.

In particular embodiments, a single groove 410A or 410B is formed along each of the sides 403 of the perimeter portion 404. In the embodiment depicted in the figures, each of the grooves 410A of the first groove type are open ended, extending along the entire side 403 in which the groove 410A is formed to create a first open end 412 and a second open end 413 opposite the first open end 412. Each of the grooves 410B of the second groove type extend along only a portion of the side 403 in which the groove 410B is formed and terminate short of the groove 410A. In such embodiments, a portion 414 of the top surface 400 of the bottom panel 320 separates each groove 410A from the adjacent grooves 410B flanking it. In alternate embodiments, each of the grooves 410A of the first groove type extends only a portion of the length of the side 403 in which the groove 410A is formed. In some embodiments, each of the grooves 410B of the second groove type extend along the entire side 403 in which the groove 410B is formed.

Figure 16:
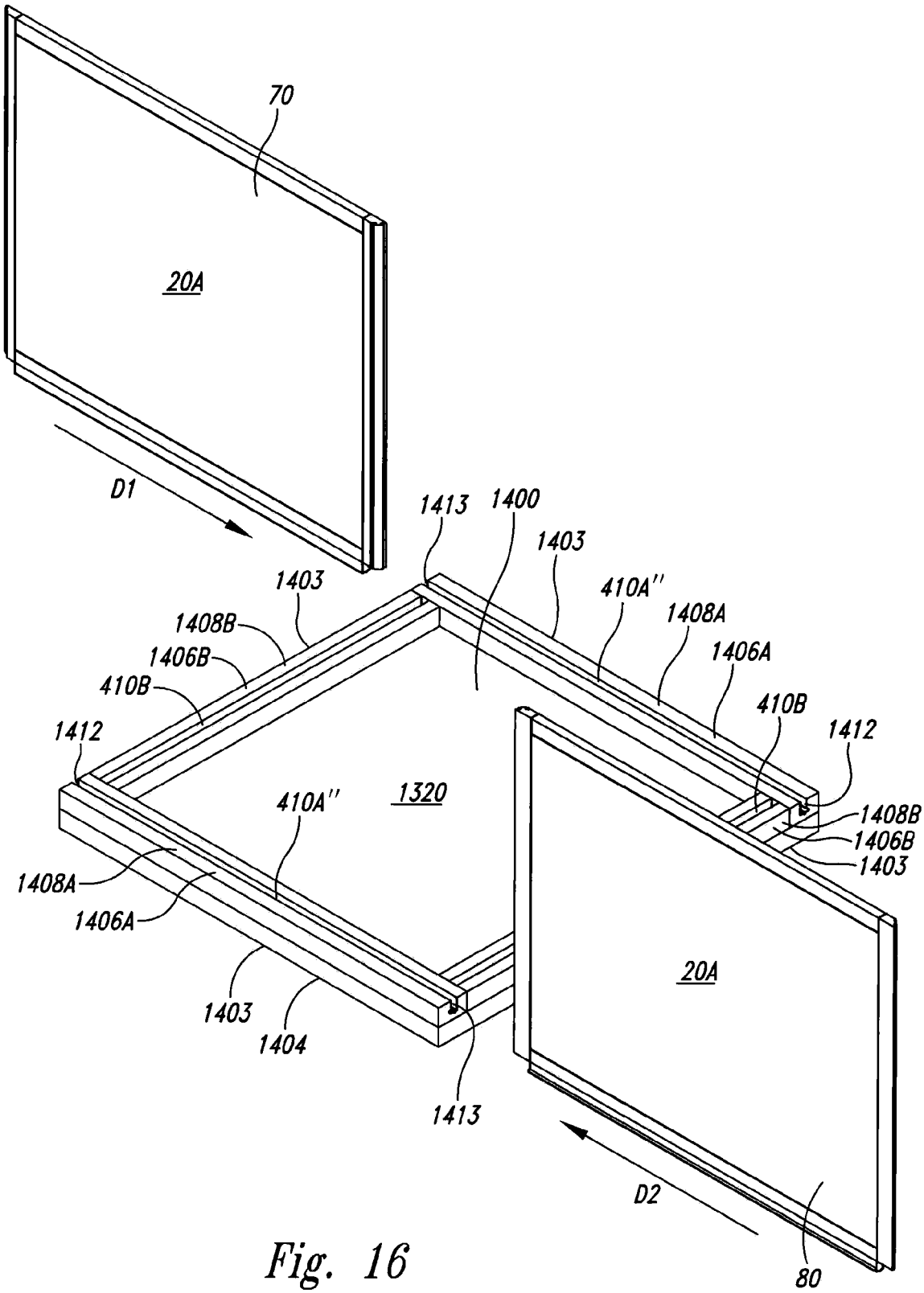
FIG. 16 is perspective view depicting the assembly of the first and second side panels of the container of FIG. 14A into the grooves of the panel anchor strips disposed on the bottom panel.

In an alternate embodiment of the bottom panel 320 depicted in FIG. 16, a bottom panel 1320 includes a perimeter portion 1404 having a plurality of elongated panel anchor strips 1406A and 1406B. A panel anchor strip 1406A or 1406B is affixed to the top surface 1400 of the bottom panel 1320 along each side 1403 of the perimeter portion 1404. As mentioned above, the panels 20A are of the first panel type and the panels 20B are of the second panel type. Similarly, the panel anchor strips 1406A are of a first anchor strip type and the panel anchor strips 1406B are of a second anchor strip type. Each of the panel anchor strips 1406A of the first anchor strip type corresponds to a single panel 20A of the first panel type and each of the panel anchor strips 1406B of the second anchor strip type corresponds to a single panel 20B of the second panel type. Each of the panel anchor strips 1406B may be flanked by a pair of panel anchor strips 1406A and extend therebetween. As is apparent to those of ordinary skill, in other embodiments, the structure described below with respect to the anchor strips 1406A and the anchor strips 1406B may be may be formed in the bottom panel 1320 instead of being included in the anchor strips 1406A and the anchor strips 1406B.

Figure 15A:
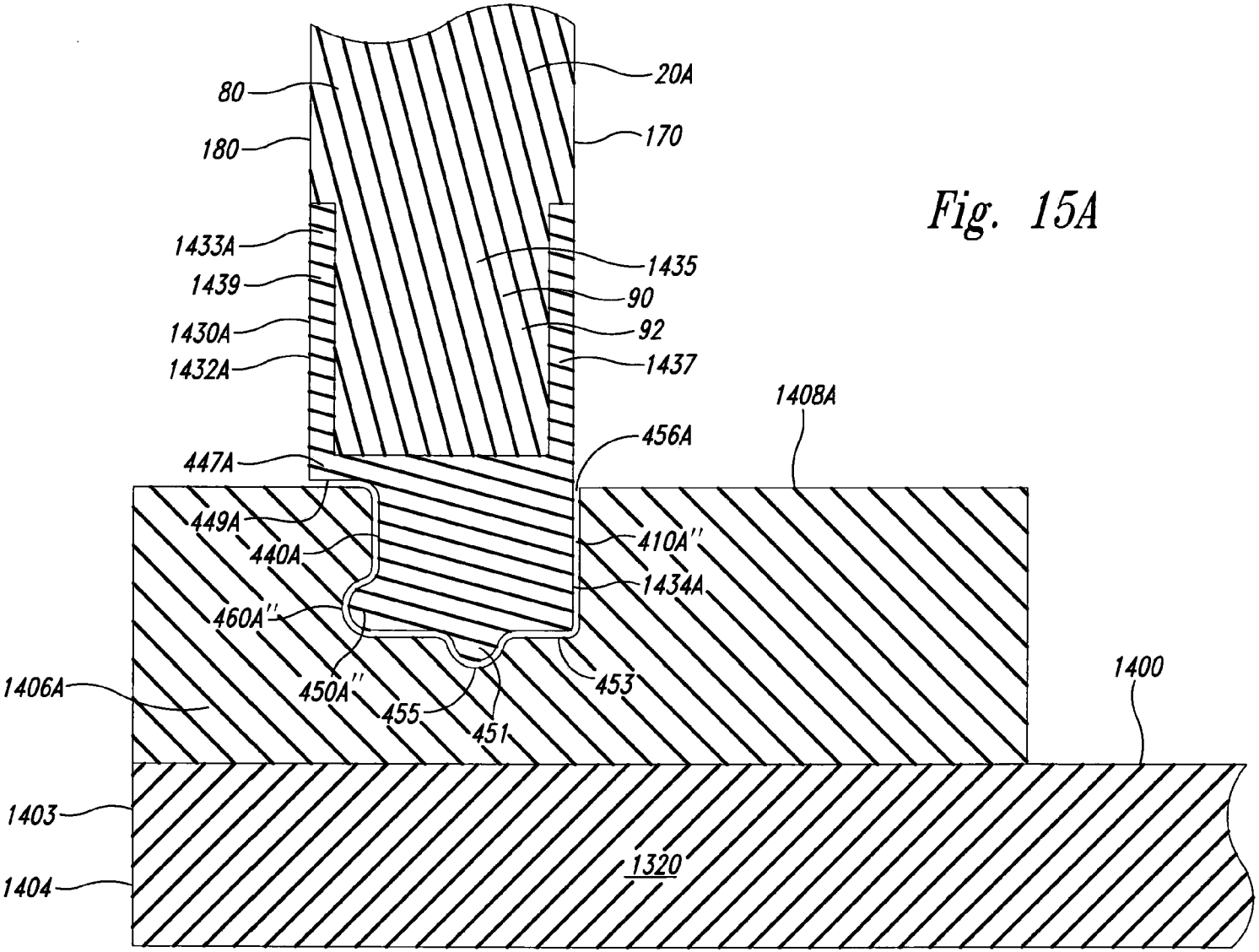
FIG. 15A is a fragmentary cross-sectional view taken through a plane substantially parallel to the front panel of the container of FIG. 14A depicting the bottom portion of the second side panel and a groove of a panel anchor strip disposed on the bottom panel.
Figure 15B:
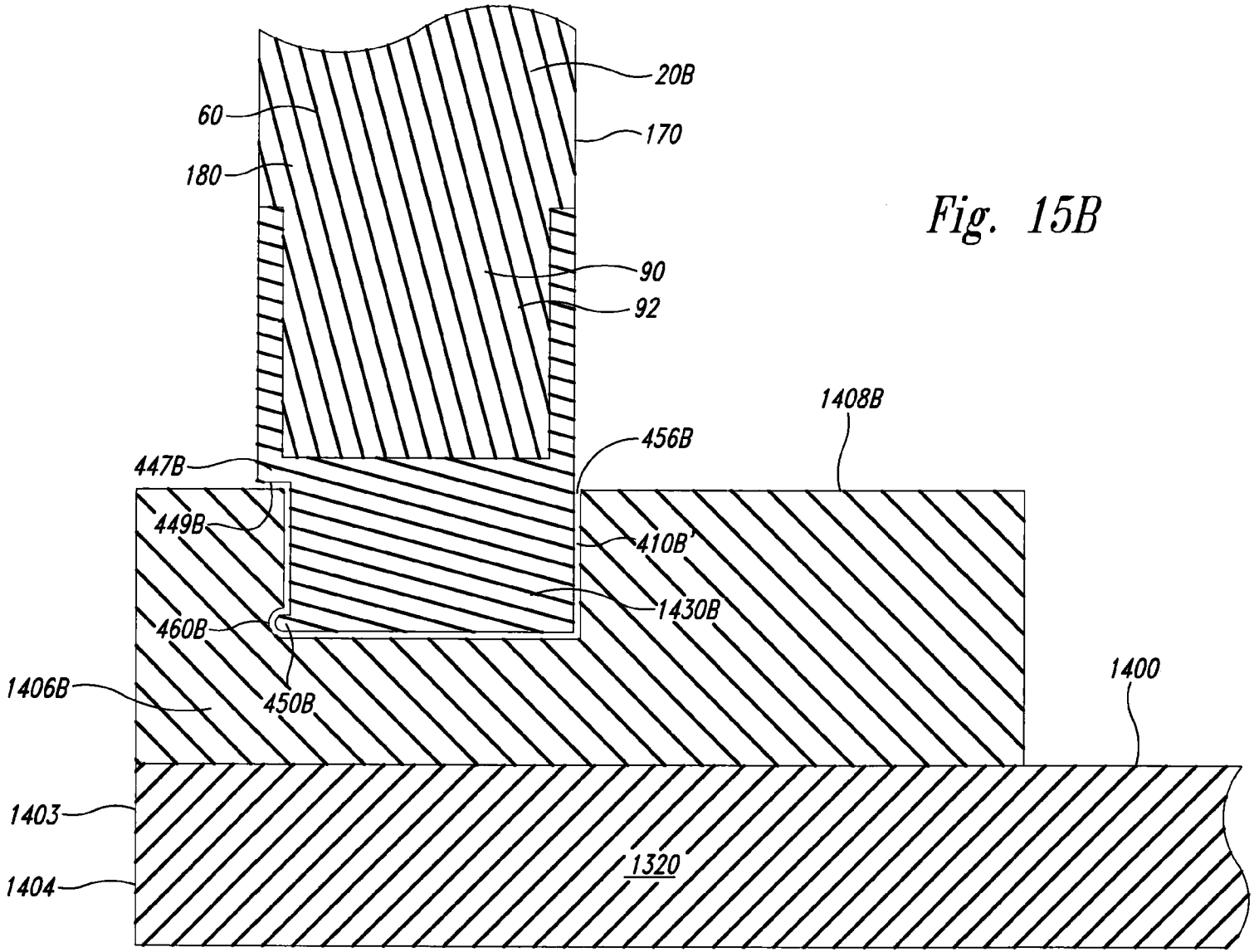
FIG. 15B is a fragmentary cross-sectional view taken through a plane substantially parallel to the first side panel of the container of FIG. 13A depicting the bottom portion of the back panel and a groove of a panel anchor strip disposed on the bottom panel.

The grooves 410A or 410A', or in the alternative, the groove shape shown as grooves 410A" in FIG. 15A, may be formed in the top surface 1408A of the panel anchor strips 1406A and the grooves 410B, or in the alternative, the groove shape shown as grooves 410B' in FIG. 15B, may be formed in the top surface 1408B of the panel anchor strips 1406B.

As mentioned above, the panels 20A of the first panel type differ from the panels 20B of the second panel type in the manner in which the panels 20A of the first panel type are coupled to the base 30. Specifically, the bottom portion 90 of the panels 20A of the first panel type differs from the bottom portion 90 of the panels 20B of the second panel type. The grooves 410A and grooves 410A" of the first groove type are configured to receive the bottom portion 90 of the panels 20A of the first panel type. The grooves 410B of the second groove type are configured to receive the bottom portion 90 of the panels 20B of the second panel type.

Figure 6A:
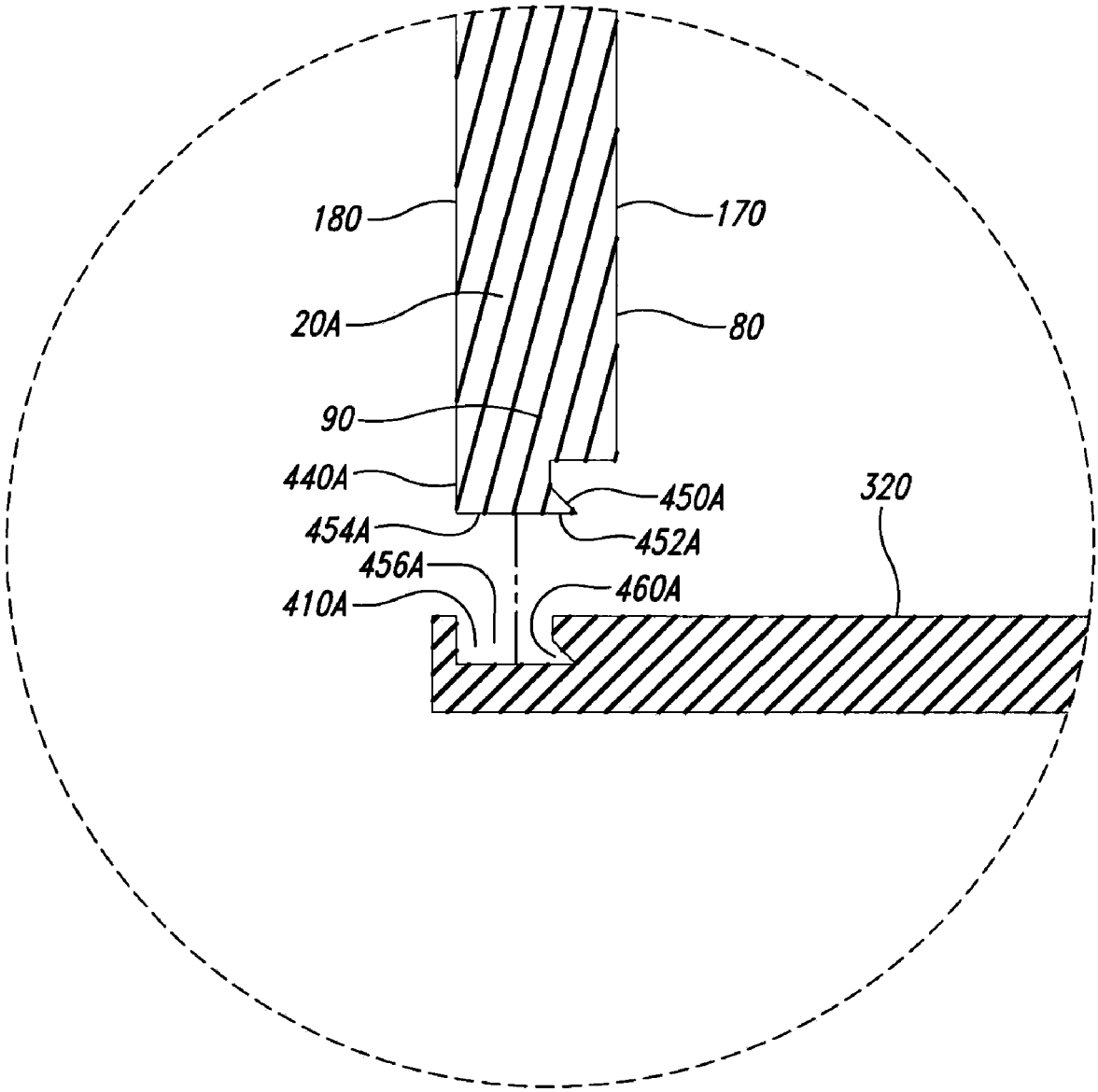
FIG. 6A is an enlarged fragmentary view of a portion of FIG. 2C depicting the bottom portion of the second side panel and a groove formed in the bottom panel.

Referring to FIG. 6A, an embodiment of the panels 20A of the first panel type and the grooves 410A of the first groove type is illustrated. The bottom portion 90 of each of the panels 20A of the first panel type has a relieved portion 440A with a toe portion 450A projecting laterally and outwardly therefrom. In the embodiment depicted in FIG. 6A, a bottom surface 452A of the toe portion 450A is contiguous with a bottom surface 454A of the relieved portion 440A. The toe portion 450A of the panels 20A of the first panel type extends inwardly toward the center portion 132 of the base 30 when the panels 20A are ready for assembly with the base 30. As depicted in the cross-sectional view of FIG. 6A, the toe portion 450A may have a generally triangular cross-sectional shape.

The grooves 410A of the first groove type include an undercut portion 460A sized and shaped to receive the toe portion 450A of the bottom portion 90 of the panels 20A. The undercut portion 460A extends inwardly from the groove 410A and toward the center portion 132 of the base 30. The undercut portion 460A extends the entire length of the groove 410A at a location juxtaposed with the toe portion 450A when the bottom portion 90 is received within the groove 410A. In the embodiment depicted in the figures, the toe portion 450A traverses the entire length of the relieved portion 440A. However, in alternate embodiments, the toe portion 450A and corresponding undercut portion 460A may traverse only a portion of the length of the relieved portion 440A and groove 410A, respectively.

Figure 6B:
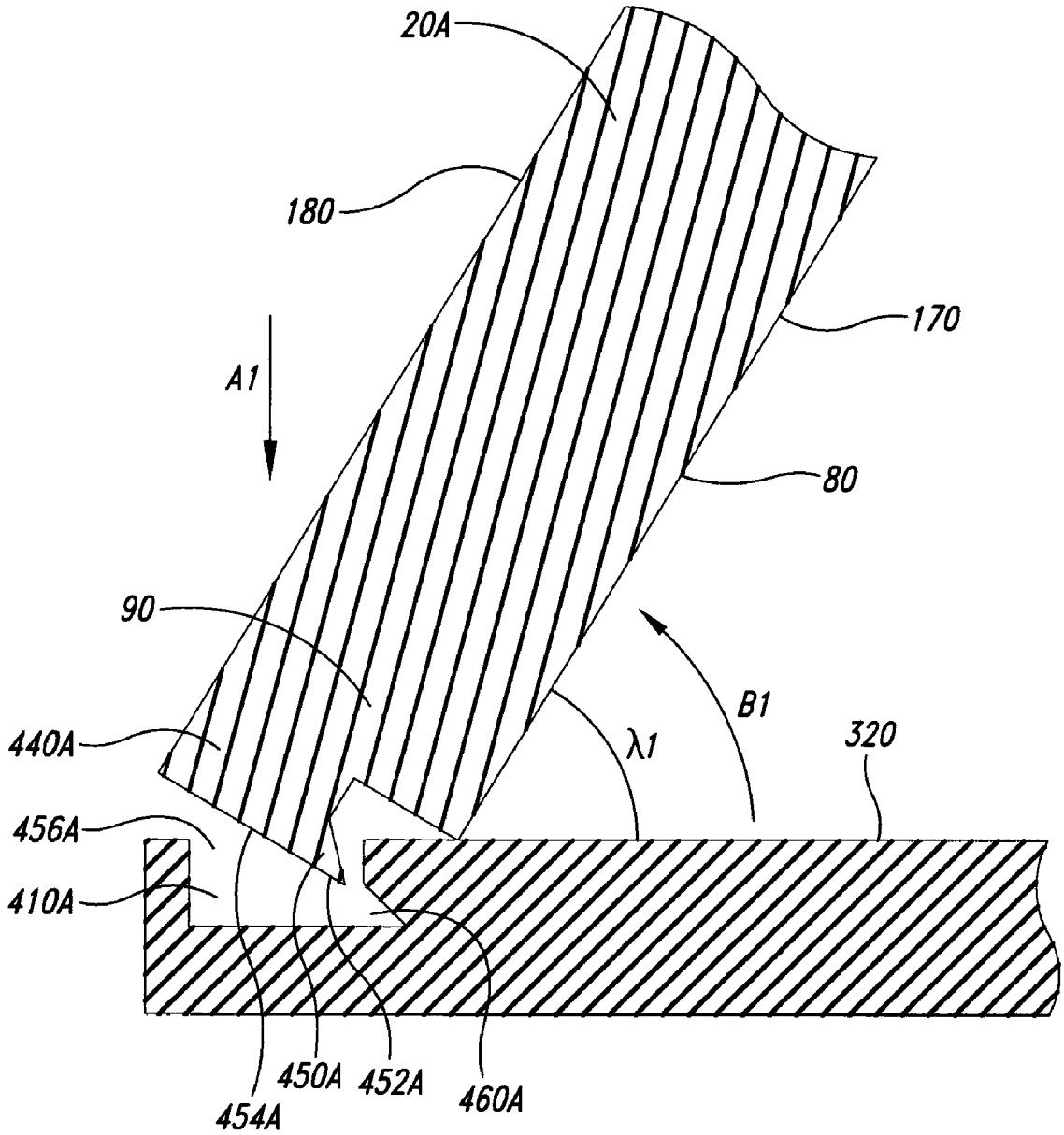
FIG. 6B is an enlarged fragmentary cross-sectional view depicting the assembly of the bottom portion of the second side panel into the groove of the bottom panel of FIG. 6A.

Referring to FIG. 6B, a method of assembling the panel 20A into the groove 410A will now be described. First, each of the panels 20A of the container 10 is uprighted with the bottom surface 454A of the relieved portion 440A of the bottom portion 90 of each panel 20A placed adjacent to an opening 456A of the corresponding groove 410A with the inside facing face 170 facing the interior 42 of the container, as shown in FIG. 6B. Each of the panels 20A is leaned inwardly at a predetermined inside angle "λ1" toward the interior 42 of the container 10. In various embodiments, the angle "λ1" ranges from about 45° to about 75°. The relieved portion 440A of each of the panels 20A is then directed downwardly, i.e., the direction indicated by arrow "A1," to first position the toe portion 450A, into the groove 410A. The panel 20A may be directed downwardly by pressure applied by a user to the top portion 100 of or elsewhere on the panel 20A. As the panel 20A is directed downwardly, it is also rotated by the user in the direction indicated by arrow "B1" into an upright position, forcing or directing the toe portion 450A into the undercut portion 460A of the groove 410A. Alternatively, in embodiments, such as the embodiment depicted in the figures, wherein each of the grooves 410A of the first groove type extend along the entire side 403 in which the groove 410A is formed, the relieved portion 440A may be installed in the groove 410A by placing the panel 20A in an upright orientation and sliding the relieved portion 440A into the groove (and the toe portion 450A into the undercut portion 460A) via one of the open ends 412 and 413 of the groove 410A.

Engagement between the toe portion 450 and the undercut portion 460A prevents the panel 20A from pivoting outwardly away from the interior 42 of the container 10. However, a predetermined amount of inwardly directed rotational force (i.e., force applied in a direction opposite the direction indicated by arrow "B1") could pivot the panel 20A inside the groove 410A inwardly toward the interior 42 of the container 10, and thereby extract the toe portion 450A from the undercut portion 460A, and dislodge the relieved portion 440A from the groove 410A. In this manner, each of the panels 20A may be disassembled from the base 30.

Figure 6C:
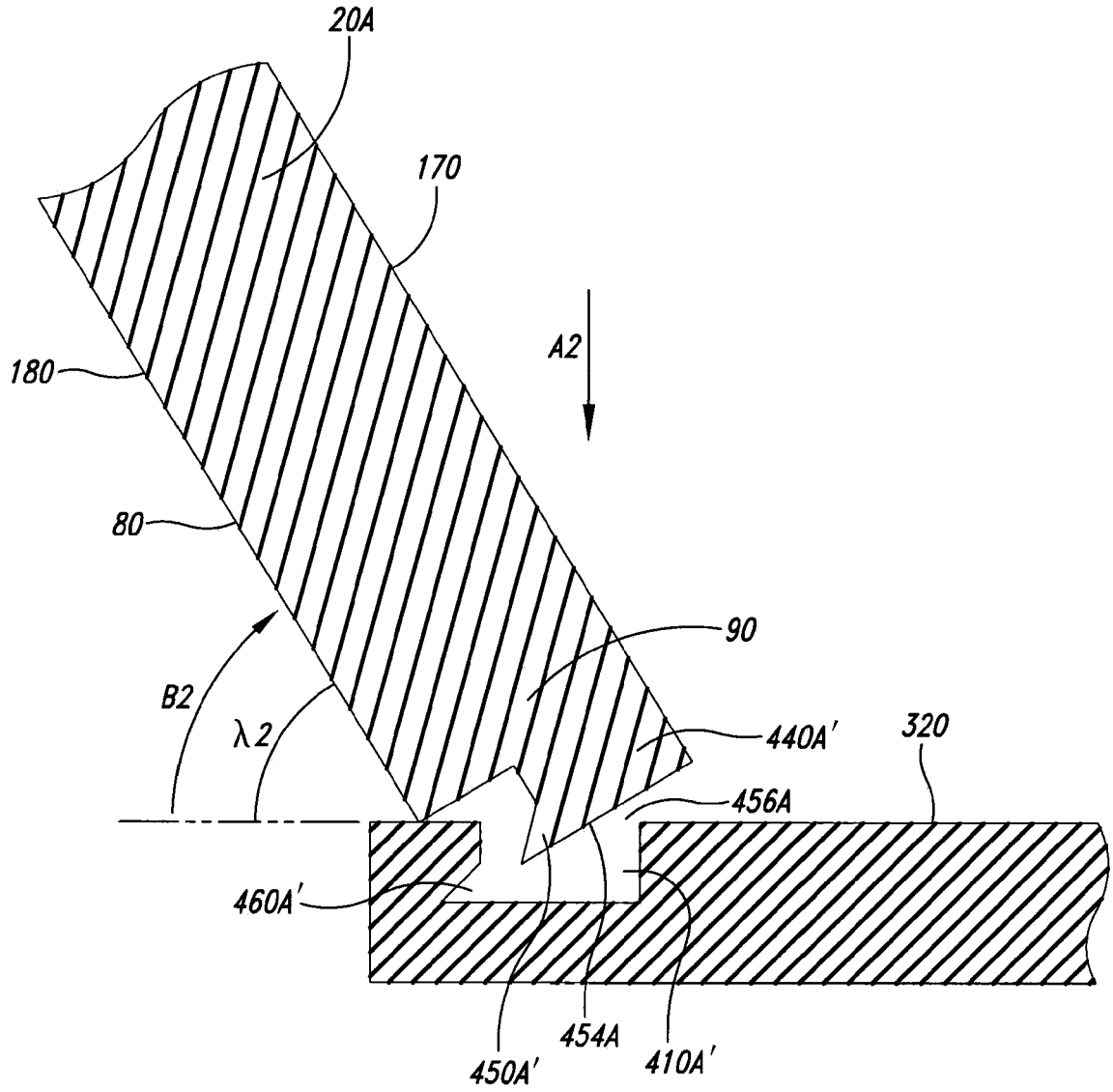
FIG. 6C is an enlarged fragmentary cross-sectional view depicting the assembly of an alternate embodiment of the bottom portion of the second side panel into an alternate embodiment of the groove of the bottom panel.

An alternate embodiment of the panels 20A of the first panel type and the grooves 410A' of the first groove type is illustrated in FIG. 6C. Reference numerals identical to those used in FIG. 6B have been used to identify substantially identical components in FIG. 6C. Only the components of the embodiment depicted in FIG. 6C that differ substantially from the components of the embodiment depicted in FIG. 6B will be described in detail.

Referring to FIG. 6C, the bottom portion 90 of each of the panels 20A of the first panel type has a relieved portion 440A' with a toe portion 450A' projecting laterally and outwardly therefrom. The toe portion 450A' may be substantially similar to the toe portion 450A (see FIGS. 6A and 6B). However, instead of extending inwardly toward the center portion 132 of the base 30 when the panels 20A are ready for assembly with the base 30, the toe portion 450A' extends outwardly away from the center portion 132 of the base 30.

In the embodiment depicted in FIG. 6C, the grooves 410A' of the first groove type include an undercut portion 460A' sized and shaped to receive the toe portion 450A' of the bottom portion 90 of the panels 20A. The undercut portion 460A' may be substantially similar to the undercut portion 460A (see FIGS. 6A and 6B). However, instead of extending inwardly toward the center portion 132 of the base 30, the undercut portion 460A' extends away from the center portion 132 of the base 30. The undercut portion 460A' extends the entire length of the groove 410A' at a location juxtaposed with the toe portion 450A' when the bottom portion 90 is received within the groove 410A'. In the embodiment depicted in the figures, the toe portion 450A' traverses the entire length of the relieved portion 440A'. However, in alternate embodiments, the toe portion 450A' and corresponding undercut portion 460A' may traverse only a portion of the length of the relieved portion 440A' and groove 410A', respectively.

Referring to FIG. 6C, a method of assembling the panel 20A into the groove 410A' will now be described. First, each of the panels 20A of the container 10 is uprighted with the bottom surface 454A of the relieved portion 440A' of the bottom portion 90 of each panel 20A placed adjacent to an opening 456A of the corresponding groove 410A' with the inside facing face 170 facing the interior 42 of the container, as shown in FIG. 6C. Each of the panels 20A is leaned outwardly at a predetermined inside angle "λ2" away from the interior 42 of the container 10. In various embodiments, the angle "λ2" ranges from about 45° to about 75°. The relieved portion 440A' of each of the panels 20A is then directed downwardly, i.e., the direction indicated by arrow "A2," to first position the toe portion 450A' , into the groove 410A'. The panel 20A may be directed downwardly by pressure applied by a user to the top portion 100 of or elsewhere on the panel 20A. As the panel 20A is directed downwardly, it is also rotated by the user in the direction indicated by arrow "B2" into an upright position, forcing or directing the toe portion 450A' into the undercut portion 460A' of the groove 410A'.

Like each of the grooves 410A, which are open ended, extending along the entire side 403 in which the groove 410A is formed to create a first open end 412 and a second open end 413 opposite the first open end 412, the grooves 410A' may be open ended. In alternate embodiments, the relieved portion 440A' may be installed in the groove 410A' by placing the panel 20A in an upright orientation and sliding the relieved portion 440A' into one of the open ends of the groove (and thereby the toe portion 450A' into the undercut portion 460A') adjacent to one of the sides 403 (see FIG. 5) of the perimeter portion 404.

In the embodiment depicted in FIG. 6C, engagement between the toe portion 450' and the undercut portion 460A' prevents the panel 20A from pivoting inwardly toward the interior 42 of the container 10. However, a predetermined amount of outwardly directed rotational force (i.e., force applied in a direction opposite the direction indicated by arrow "B2") could pivot the panel 20A inside the groove 410A' outwardly away from the interior 42 of the container 10, and thereby extract the toe portion 450A' from the undercut portion 460A' , and dislodge the relieved portion 440A' from the groove 410A'. In this manner, each of the panels 20A may be disassembled from the base 30. Referring to FIG. 15A, alternate embodiments of the bottom portion 90 of the panels 20A of the first panel type and the grooves 410A" of the first groove type are illustrated. In this embodiment, the bottom portion 90 of the panels includes a relieved portion 92. The relieved portion 92 may be substantially similar to the relieved portion 220 in the first side portion 110. In particular embodiments, the relieved portion 92 extends along a larger portion of the inside facing face 170 and outside facing face 180 than the relieved portion 220 in the first side portion 110. The relieved portion 92 may be formed using any method suitable for forming the relieved portion 220 in the first side portion 110.

Each of the panels 20A is connected to the base 30 by an elongated anchor member 1430A coupled to a corresponding panel anchor strip 1406A disposed on the top surface 1400 of the bottom panel 1320. The anchor member 1430A includes a connector 1432A integrally formed with or coupled to an anchor portion 1434A. The relieved portion 92 is received inside the connector 1432A of the anchor member 1430A. The connector 1432A may be substantially identical to the connector 200 of the first elongated joining member 150. In the embodiment depicted in the figures, the connector 1432A includes a longitudinally extending sleeve or connector portion 1433A having an interior 1435 defined between a pair of sidewalls 1437 and 1439. The interior 1435 is sized and shaped to receive the relieved portion 92 therein. Each of the sidewalls 1437 and 1439 may extend laterally and upwardly along the relieved portion 92.

The connector 1432A may be affixed to the relieved portion 92 in any manner suitable for affixing the connector 200 of the first elongated joining member 150 to the first or second side portions 110 and 120 of one of the panels 20A and 20B.

In the embodiment depicted in the figures, the connector 1432A is offset laterally from the anchor portion 1434A creating an overhanging portion 447A. The overhanging portion 447A may be adjacent to the outside facing face 180 of the panel 20A. An underside 449A of the overhanging portion 447A may bear against the top surface 1408A of the panel anchor strips 1406A when the anchor member 1430A is coupled thereto.

The anchor portion 1434A may be substantially identical to the relieved portion 440A described above. Alternatively, the anchor portion 1434A may include a toe portion 4450A" that extends laterally therefrom away from the center portion 132 of the base 30 when assembled therewith.

The toe portion 4450A" may have a bead-like cross-sectional shape. As is apparent to those of ordinary skill in the art, while the cross-sectional shape of the toe portion 4450A" differs from the cross-sectional shape of toe portion 450A depicted in the figures, the toe portion 4450A" is equivalent to the toe portion 450A and functions in a substantially identical manner thereto. Further, those of ordinary skill will readily recognize alternate cross-sectional shapes suitable for use with the toe portion 450A and the toe portion 4450A", such as square, rectangular, oval, trapezoidal, arbitrary, and the like, and such embodiments are within the scope of the present invention.

In various embodiments, the anchor portion 1434A includes a downwardly extending projection 451. In embodiments wherein the connector 1432A is offset laterally from the anchor portion 1434A, the downwardly extending projection 451 may be offset laterally from the bottom portion 90 of the panel 20A.

The groove 410A" formed in the panel anchor strip 1406A may include an undercut portion 4460A" configured to receive the toe portion 4450A" in substantially the same manner the undercut portion 460A (see FIG. 6B) configured receives the toe portion 450A. However, unlike the undercut portion 460A, the undercut portion 4460A" extends outwardly away from the center portion 132 of the base 30.

Referring to FIG. 16, the grooves 410A" may be open ended, having a first open end 1412 and a second open end 1413 opposite the first open end 1412. The panel 20A may be installed in the groove 410A" by placing the panel 20A in an upright orientation and sliding the anchor portion 1434A into one of the open ends 1412 or 1413 of the groove 410A". For example, in FIG. 16, the first side panel 70 is uprighted and slid into the second open end 1413 of one of the grooves 410A" in the direction indicated by an arrow "D1" and the second side panel 80 is uprighted and slid into the second open end 1413 of the other groove 410A" in the direction indicated by an arrow "D2." Each of the panels 20A may be disassembled from the groove 410A" by sliding the anchor portion 1434A within the groove 410A" in the direction of one of the open ends 1412 or 1413 until the anchor portion 1434A completely disengages with the groove 410A".

The groove 410A" may include a bottom surface 453 having an interior longitudinally extending groove 455 formed therein. The interior groove 455 is sized and shaped to receive the downwardly extending projection 451 when the anchor portion 1434A is received inside the groove 410A". Engagement between the downwardly extending projection 451 and the interior groove 455 may help maintain the panel 20A in an upright orientation. Engagement between the overhanging portion 447A and the top surface 1400 of the bottom panel 1320 may help prevent the panel 20A from rotating outwardly within the groove 410A".

Figure 7:
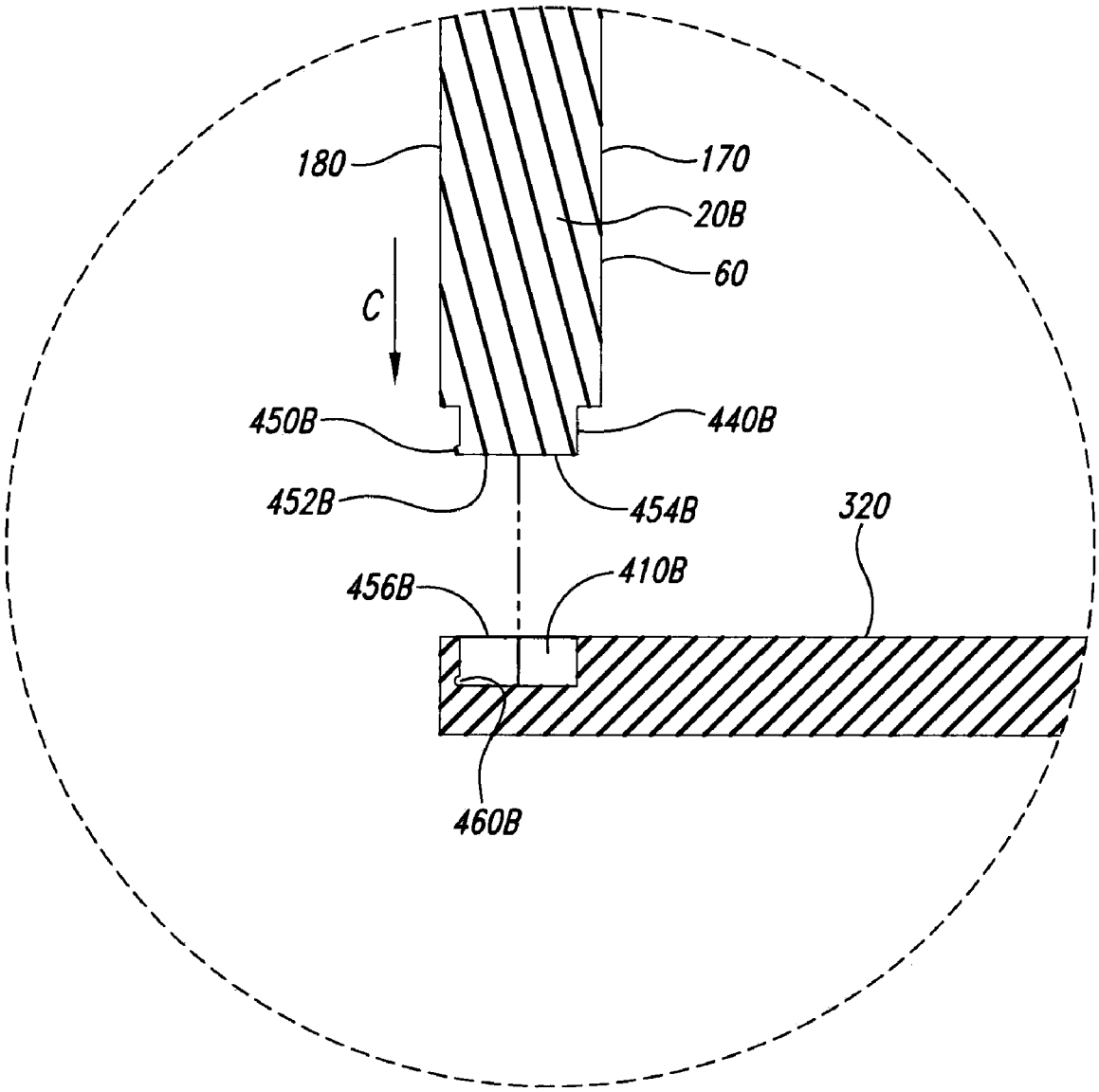
FIG. 7 is an enlarged fragmentary view of a portion of FIG. 2C depicting the bottom portion of the back panel and a groove formed in the bottom panel.

Referring to FIG. 7, the panels 20B of the second panel type and grooves 410B of the second groove type are illustrated. The bottom portion 90 of each of the panels 20B of the second panel type has a relieved portion 440B with a toe portion 450B projecting laterally outward therefrom. In the embodiment depicted in FIG. 7, a bottom surface 452B of the toe portion 450B is contiguous with a bottom surface 454B of the relieved portion 440B. The toe portion 450B of the panels 20B of the second panel type extends outwardly away from the center portion 132 of the base 30. As depicted in the cross-sectional view of FIG. 7, the toe portion 450B of the panels 20B of the second panel type may be generally bead shaped and substantially smaller than the toe portion 450A of the panels 20A of the first panel type.

The grooves 410B of the second groove type include an undercut portion 460B sized and shaped to receive the toe portion 450B of the bottom portion 90 of the panels 20B. The undercut portion 460B extends laterally outwardly from the groove 410B and away from the center portion 132 of the base 30. The undercut portion 460B extends along the groove 410B with the toe portion 450B received therein when the bottom portion 90 is received within the groove 410B. In the embodiment depicted in the figures, the toe portion 450B extends along the entire length of the relieved portion 440B. However, in alternate embodiments, the toe portion 450B and corresponding undercut portion 460B may extends along only a portion of the length of the relieved portion 440B and groove 410B, respectively.

A method of assembling the panel 20B into the groove 410B will now be described. First, each of the panels 20B of the container 10 is uprighted, with the bottom surface 454B of the bottom portion 90 of each panel 20B placed adjacent to an opening 456B of the corresponding groove 410B with the inside facing face 170 facing the interior 42 of the container 10. The relieved portion 440B of each of the panels 20B is then directed downwardly, in the direction indicated by arrow "C" to snap fit into the groove 410B. The panel 20B may be directed downwardly by pressure applied by the user to the top portion 100 or elsewhere on the panel 20A. A predetermined amount of outwardly directed force or pressure applied to the inside facing face 170 of the panel 20B forces or directs the toe portion 450B into the undercut portion 460B of the groove 410B.

The goods 14 inside the interior 42 of the container 10 may bear against the inside facing face 170, exerting a force thereupon, and maintain the toe portion 450B inside the undercut portion 460B of the groove 410B. Engagement between the toe portion 450B and the undercut portion 460B prevents the panel 20B from pivoting inwardly toward the interior 42 of the container 10. If the predetermined amount of outwardly directed force or pressure applied to the inside facing face 170 of the panel 20B is removed or reduced below a predetermined threshold value, the toe portion 450B may disengage with the undercut portion 460B, allowing the relieved portion 4440B to be removed from the groove 410B, by an upwardly directed force, i.e., a force in a direction opposite the direction indicated by arrow "C". In this manner, the panels 20B may be disassembled from the base 30. The predetermined amount of outwardly directed force or pressure applied to the inside facing face 170 of the panel 20B by the goods 14 may be removed or reduced by moving all or a portion of the goods 14 contained in the container 10.

Referring to FIG. 15B, an alternate embodiment of the bottom portion 90 of the panels 20B of the second panel type is illustrated. In this embodiment, the bottom portion 90 of each of the panels 20B includes a relieved portion 92. The relieved portion 92 may be substantially similar to the relieved portion 220 in the first side portion 110. In particular embodiments, the relieved portion 92 extends along a larger portion of the inside facing face 170 and outside facing face 180 than the relieved portion 220 in the first side portion 110. The relieved portion 92 may be formed using any method suitable for forming the relieved portion 220 in the first side portion 110.

Each of the panels 20B is connected to the base 30 by an elongated anchor member 1430B coupled to a corresponding panel anchor strip 1406B disposed on the top surface 1400 of the bottom panel 1320. The anchor member 1430B includes a connector 1432B integrally formed with or coupled to an anchor portion 1434B. The relieved portion 92 is received inside a connector 1432B of an anchor member 1430B. The connector 1432B may be substantially identical to the connector 1432A of the anchor member 1430A and therefore will not be described in detail.

The anchor portion 1434B may be substantially identical to the relieved portion 440B (see FIG. 7) of the bottom portion 90 of the panels 20B. Consequently, the anchor member 1430B and panel 20B coupled thereto may be assembled with the base 30 in the same manner the relieved portion 440B of the bottom portion 90 of the panels 20B is assembled with the base 30. The anchor member 1430B and panel 20B coupled thereto may be subsequently disassembled from the base 30 in the same manner the relieved portion 440B of the bottom portion 90 of the panels 20B is disassembled from the base 30.

In the embodiment depicted in the figures, the connector 1432B is offset laterally from the anchor portion 1434B creating an overhanging portion 447B. The overhanging portion 447B may be adjacent to the outside facing face 180 of the panel 20B. An underside 449B of the overhanging portion 447B may bear against the top surface 1408B of the panel anchor strips 1406B when the anchor member 1430B is coupled thereto. Engagement between the underside 449B of the overhanging portion 447B and the top surface 1408B of the panel anchor strips 1406B help prevent the anchor portion 1434B from rotating inside the groove 410B and thereby disengaging the toe portion 450A from the undercut portion 460B and potentially disassembling the panel 20B from the base 30.

In particular embodiments, the first elongated member 150 and second elongated member 160 are fixedly installed on the panels 20A and 20B before the panels 20A and 20B are coupled to the base 30. In such embodiments, the panels 20A must be installed before the panels 20B. Otherwise, the first elongated member(s) 150 and/or second elongated member (s) 160 installed on the panels 20B will interfere with leaning the panels 20A inwardly during insertion into the grooves 410A. After a pair of panels 20A flanking a selected panel 20B are installed, the selected panel 20B may be installed therebetween by inserting the key portion 212 of the first elongated joining members 150 of the edge joining assemblies 140 adjacent to the first and second side portions 110 and 120 of the selected panel 20B into the keyway portion 242 of the second elongated joining members 160 of the edge joining assemblies 140 adjacent to the first and second side portions 110 and 120 of the selected panel 20B, and sliding the key portions 212 downwardly within the keyway portions 242 until the relieved portion 440B of the selected panel 20B is received inside the corresponding groove 410B. When the key portion 212 of the first elongated joining members 150 is received inside the keyway portion 242 of the second elongated joining member 160, the mating surface 218 may be slid longitudinally along the mating surface 252 to allow the key portion 212 to slide within the keyway portion 242.

Referring to FIG. 1A, in the embodiment depicted in the figures, the bottom end portion 154 of the first elongated joining members 150 is not received into the grooves 410A and 410B (see FIGS. 2A and 5). Similarly, the bottom end portion 164 of the second elongated joining members 160 is not received into the grooves 410A and 410B. A portion of the bottom end portion 154 of the first elongated joining members 150 and/or a portion of the bottom end portion 164 of the second elongated joining members 160 may rest upon the portion 414 (see FIG. 5) of the top surface 400 of the bottom panel 320 separating each of the grooves 410A from an adjacent groove 410B. Alternatively, a portion of the bottom end portion 154 of each of the first elongated joining members 150 may extend into the opening 456A (see FIG. 6A) of one of the grooves 410A and/or the opening 456B (see FIG. 7) of one of the grooves 410B. Likewise, a portion of the bottom end portion 154 of each of the second elongated joining members 160 may extend into the opening 456A of one of the grooves 410A and/or the opening 456B of one of the grooves 410B.

The container 10 may be disassembled by eliminating or reducing the outwardly directed force or pressure applied to the inside facing face 170 of the panel 20B below the predetermined threshold value and upwardly lifting the selected panel 20B thereby sliding the key portions 212 upwardly within the keyway portions 242 until the relieved portion 440B of the selected panel 20B is removed from the corresponding groove 410B and the key portions 212 of the edge joining assemblies 140 adjacent to the first and second side portions 110 and 120 of the selected panel 20B exit the keyway portions 242 of the edge joining assemblies 140 adjacent to the first and second side portions 110 and 120 of the selected panel 20B. Then, each of the panels 20A may be leaned inwardly and lifted out of their corresponding grooves 410A. In this manner, the container 10 is collapsed or disassembled without the use of hand tools.

While assembly and disassembly of the container 10 has been described with reference to the first elongated joining members 150 and the second elongated joining members 160, it is appreciated by those of ordinary skill in the art that the first elongated joining members 1150 is substantially similar to the first elongated joining member 150 and the second elongated joining member 1160 is substantially similar to the second elongated joining member 160, and embodiments of the container 10 incorporating the first and second elongated joining members 1150 and 1160 may be assembled and disassembled in a substantially similar manner. Similarly, the first elongated joining members 150' is substantially similar to the first elongated joining member 150 and the second elongated joining member 160' is substantially similar to the second elongated joining member 160, and embodiments of the container 10 incorporating the first and second elongated joining members 150' and 160' may be assembled and disassembled in a substantially similar manner.

Referring to FIGS. 1B, 2A, 2C-2D, and 8-9, optionally, the container 10 may include a lid 500. The lid 500 may be constructed using a composite material. In particular embodiments, the lid 500 is constructed using the same composite material used to construct the panels 20A or the panels 20B. However, as is apparent to those of ordinary skill, the lid 500 need not be constructed from the same materials used to construct either the panels 20A or the panels 20B. Further, the panels 20A need not be constructed from the same composite material used to construct the panels 20B.

Figure 8:
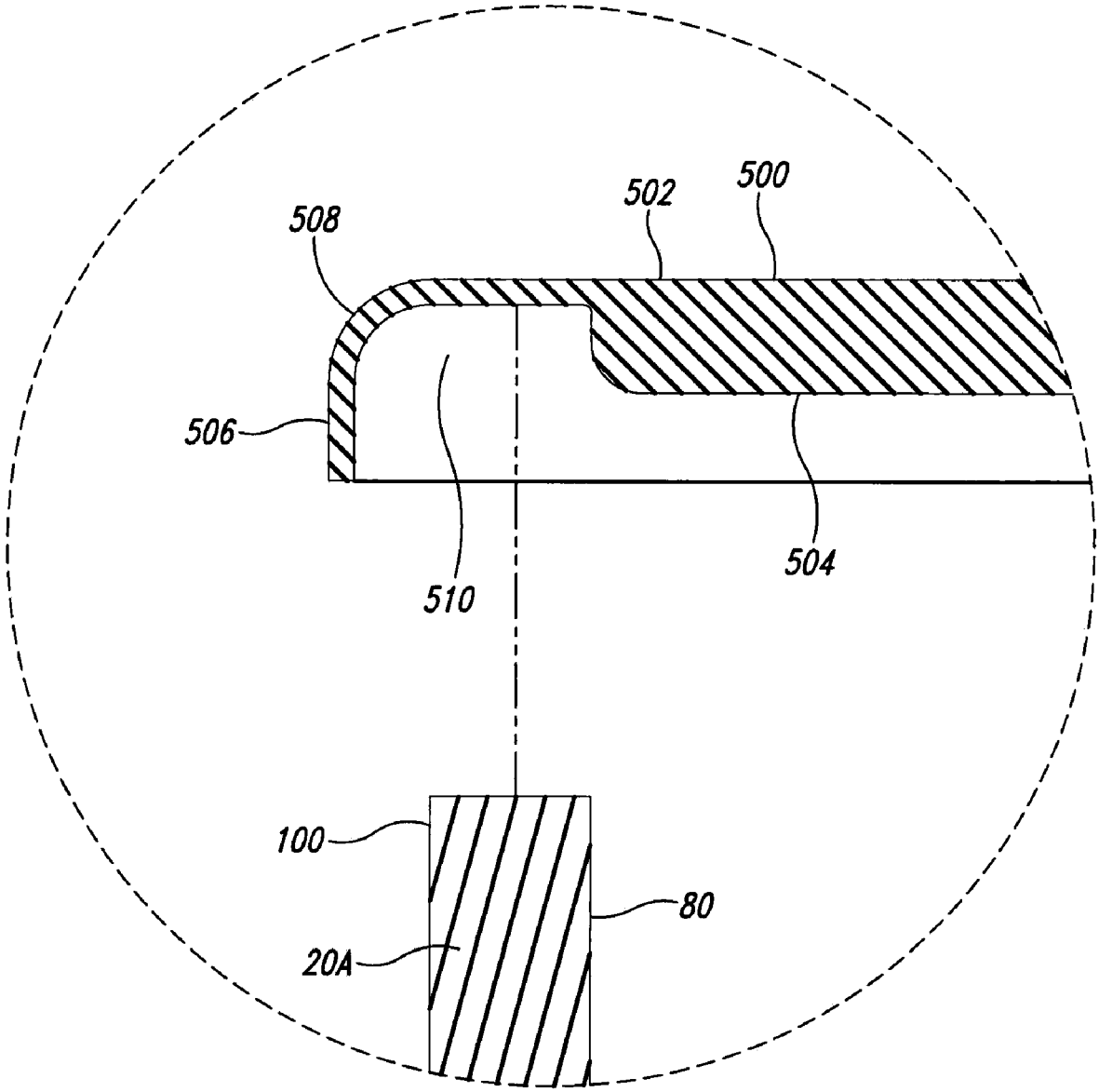
FIG. 8 is an enlarged fragmentary view of a portion of FIG. 2C depicting the top portion of the second side panel and a portion of the optional lid.

As may best be viewed in FIG. 8, the lid 500 may include an outside facing surface 502 opposing an inside facing surface 504. The lid 500 has a perimeter portion 506 with an arcuate flange or curved overhanging portion 508 and extends about the perimeter portion 506 of the lid 500. A groove or channel 510 is defined under the curved overhanging portion 508. The channel 510 is configured to receive the top portion 100 of each of the panels 20A and 20B of the container 10 with the overhanging portion 508 overhanging the top portion 100 of each of the panels 20A and 20B along a portion of the outside facing faces 180 of each of the panels 20A and 20B. The top end portion 152 of each of the first elongated joining members 150 and the top end portion 162 of each of the second elongated joining members 160 may also be received inside the channel 510. In the embodiment depicted in FIG. 1B, the curved overhanging portion 508 extends downwardly below the inside facing surface 504. Engagement between the top portion 100 of each of the panels 20A and 20B and the overhanging portion 508 prevents the lid 500 from slipping or sliding on or relative to the top portions 100 of the panels 20A and 20B.

Figure 10:
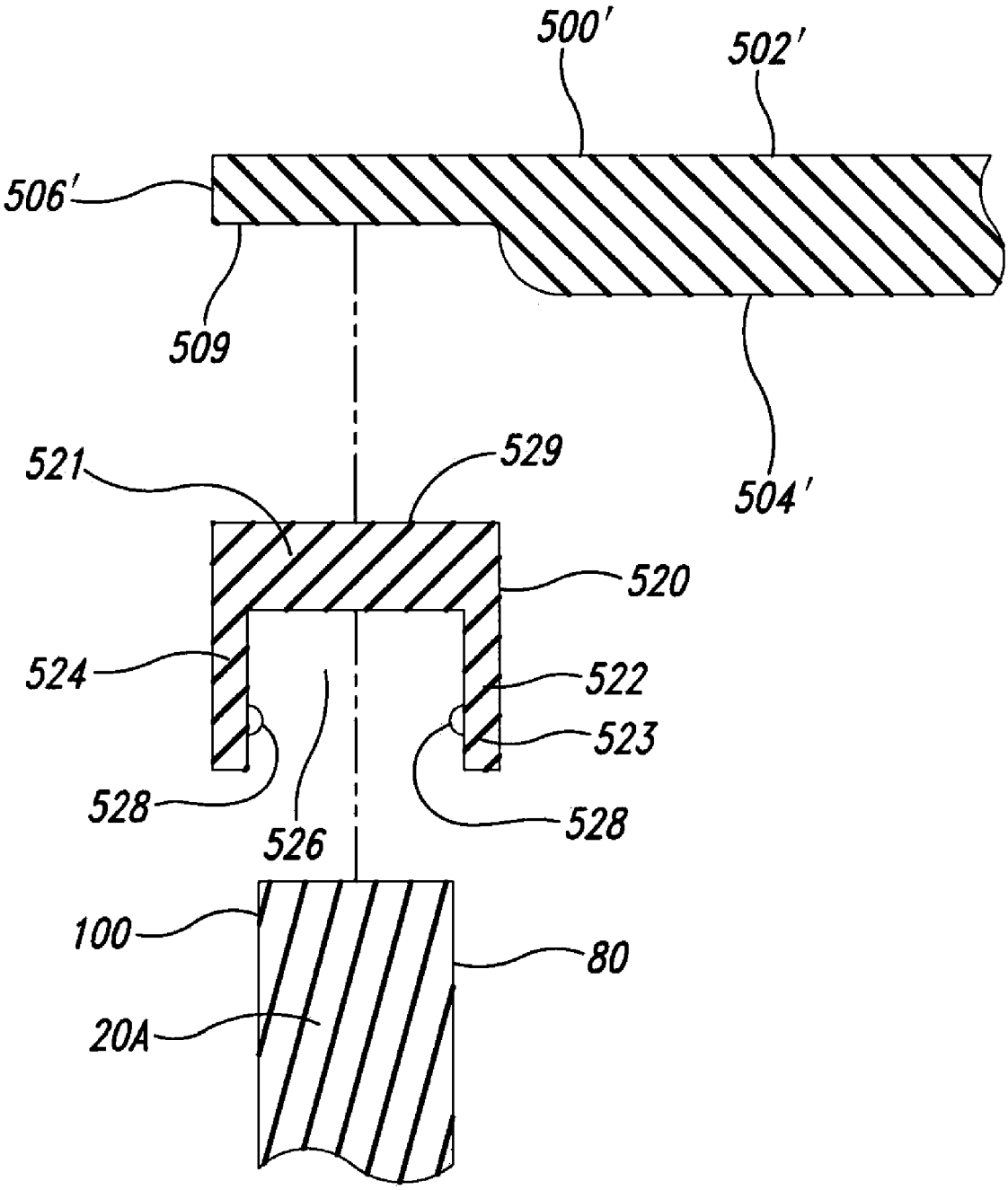
FIG. 10 is an enlarged fragmentary view of an alternate embodiment of the optional lid.

Referring to FIG. 10, an alternate embodiment of the lid 500' is provided. With respect to the lid 500', reference numerals identical to those used with reference to the lid 500 have been used to identify substantially identical components. Only the components of the lid 500' that differ substantially from the components of lid 500 will be described in detail.

The lid 500' may include an outside facing surface 502' opposing an inside facing surface 504'. The lid 500' has a perimeter portion 506' and a compressed or relieved portion 509 that extends about the perimeter portion 506' of the lid 500' and is formed in a portion of the inside facing surface 504'. The relieved portion 509 is sized to rest upon the top portion 100 of the panels 20A and 20B when assembled therewith. The relieved portion 509 may also be sized to rest upon the top end portion 152 of each of the first elongated joining members 150 and the top end portion 162 of each of the second elongated joining members 160. In various embodiments, an optional elongated top seal or cap 520 may be disposed along the top portion 100 of each of the panels 20A and 20B. In such embodiments, the relieved portion 509 is sized to rest upon an upper surface 529 of the cap 520.

Referring to FIG. 14B, the optional cap 520 may be disposed along the top portion 100 of each of the panels 20A and 20B. In the embodiment depicted in FIG. 14A, the top cap 520 extends between the edge joining assembly 140 coupled to the first side portion 110 of a selected panel and the edge joining assembly 140 coupled to the second side portion 120 of the same panel. The cap 520 may have a first end portion 522 configured to be received inside the portion 1243 of the interior 1204 of the connector 1200 of the first elongated joining member 1150 and a second end portion 526 configured to similarly mate with the connector 1226 of the second elongated joining member 1160. The first end portion 522 may include a tapered portion 540 defined between tapered walls 542 and 544. When the first end portion 522 is received inside the portion 1243 of the interior 1204, the tapered wall 542 is adjacent and sealed against the tapered sidewall 1241 of the connector 1200 and the tapered wall 544 is adjacent and sealed against the tapered sidewall 1245 of the connector 1200.

Figure 9:
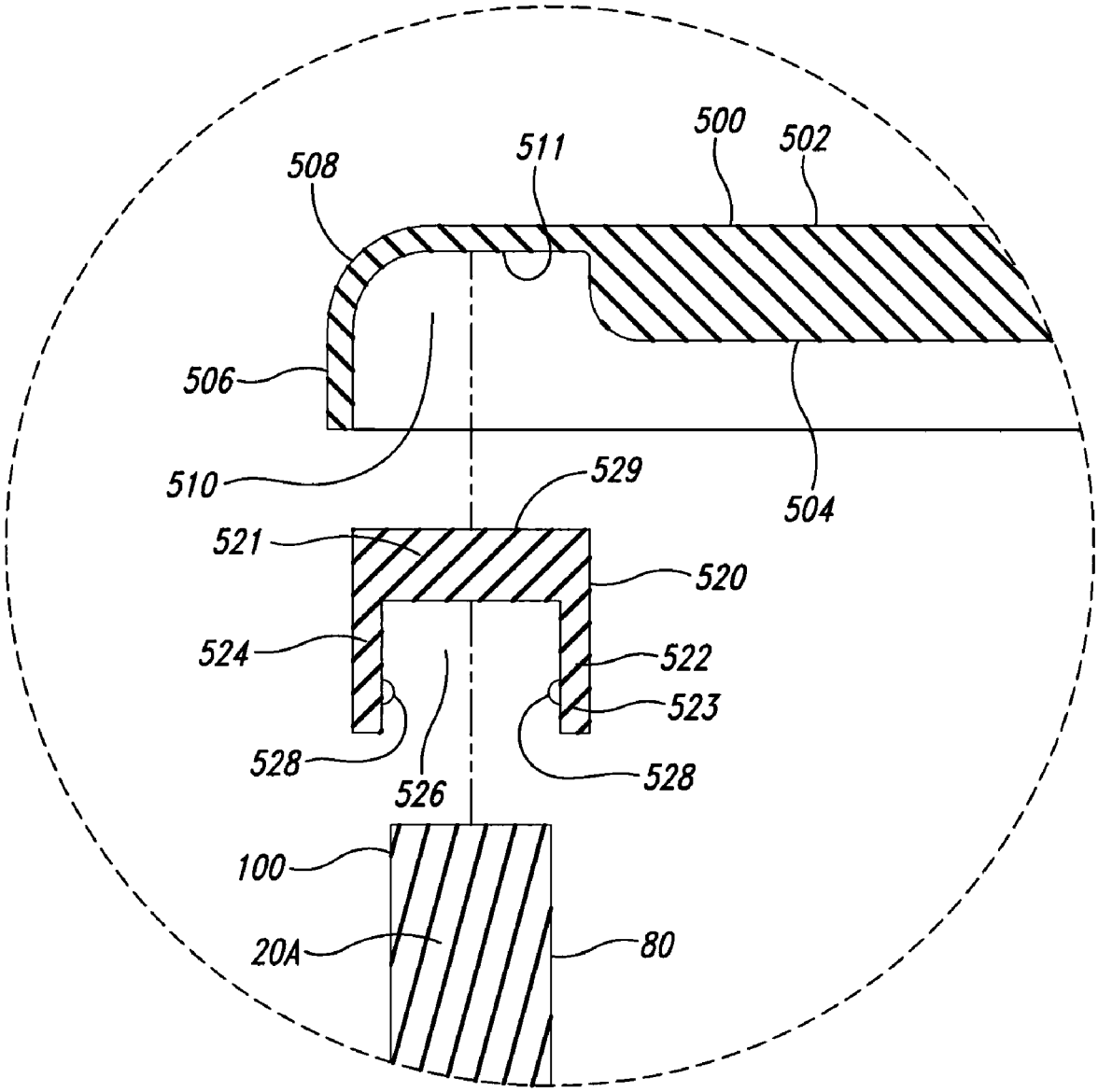
FIG. 9 is an enlarged fragmentary view of an embodiment of the container including a top cap disposed between the top portion of the second side panel and the optional lid.

Referring to FIGS. 9 and 10, the cap 520 may include a connector 522 substantially similar to the connector 200 of the first elongated joining member 150. The connector 522 may include a pair of longitudinally extending and spaced apart sidewalls 523 and 524 defining an open channel 526 therebetween. Each of the sidewalls 523 and 524 may include an inwardly projecting and longitudinally extending gripping projection 528. The gripping projection 528 of the sidewall 523 is juxtaposed with the gripping projection 528 of the sidewall 524. The gripping projection 528 of one of the sidewalls 523 and 524 bears against the inside facing face 170 of one of the panels 20A and 20B, and the gripping projection 528 of the other of the sidewalls 523 and 524 bears against the outside facing face 180 of the same panel. In this manner, the gripping projection 528 helps maintain the cap 520 on the top portion 100 of the panel 20A or 20B.

In various embodiments, the connector 522 is affixed to the top portion 100 of each of the panels 20A and 20B using any method suitable for affixing the connector 200 to the first side portion 110. The upper surface 529 of the cap 520 may be configured to mate with the inside surface 511 of the channel 510 formed in the lid 500. The cap 520 may be constructed using any method suitable for constructing the first elongated joining member 150.

Returning to FIG. 1B, the outside facing surface 502 of the lid 500 may include one or more recesses 580 formed along the perimeter portion 506. Each of the recesses 580 may have a strip of Velcro or a Velcro strap 590 affixed therein. In various embodiments, the Velcro strap 590 has a tethered end 592 affixed inside one of the recesses 580 and a free end 594 opposite the tethered end 592. A strip or a piece of Velcro 596 (see FIG. 2A) corresponding to each of the Velcro straps 590 is affixed to one of the panels 20A and 20B at a location reachable by the free end 594 of the Velcro strap 590. The lid 500 may be secured on the top portions 100 of the panels 20A and 20B by intermeshing the hooks (or loops) of the free end 594 of the Velcro strap 590 with the loops (or hooks) of the piece of Velcro 596 corresponding to the Velcro strap 590. The outside facing surface 502' of the lid 500' may also include one or more recesses formed along the perimeter portion 506' substantially similar to the recess(es) 580 of the lid 500 and configured for use with the Velcro strap 590.

As a non-limiting example, suitable Velcro for constructing the Velcro straps 590 and the pieces of Velcro 596 include P-87/P-81 hooks and Loop 9000, which may be purchased from 3M. The tethered end 592 of each the Velcro straps 590 may be affixed inside one of the recesses 580 by an acrylic pressure sensitive adhesive. Similarly, each of the pieces of Velcro 596 may be affixed to one of the panels 20A and 20B by an acrylic pressure sensitive adhesive.

Figure 11:
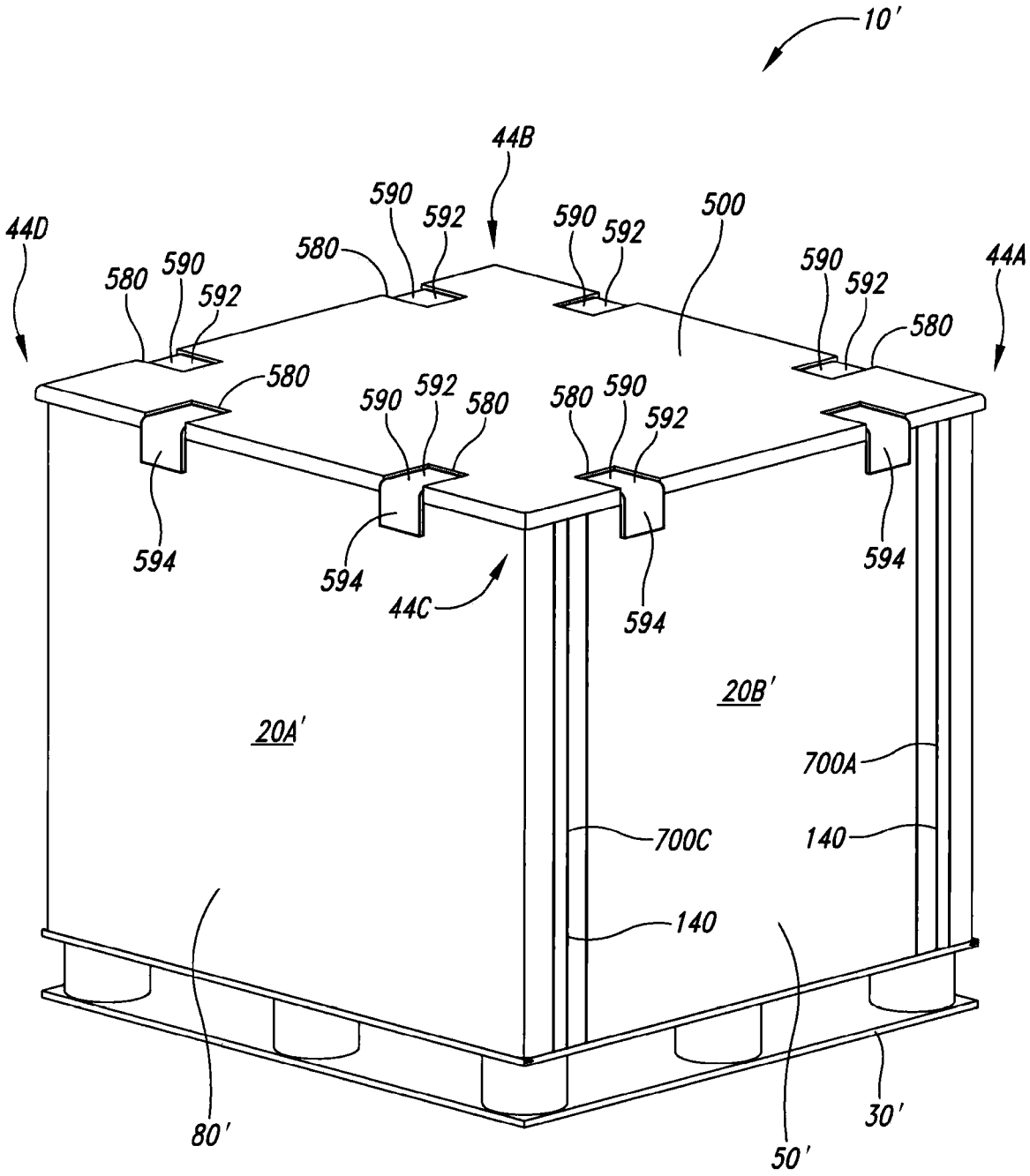
FIG. 11 is a perspective view of an alternate embodiment of the collapsible container, including the optional lid, constructed in accordance with the present invention.

An alternate embodiment of the container 10 will now be described. Referring now to FIG. 11, a container 10' is provided. With respect to the container 10', reference numerals identical to those used with reference to the container 10 have been used to identify substantially identical components. Only the components of the container 10' that differ substantially from the components of container 10 will be described in detail.

The container 10' differs from the container 10 with respect to the structure of the corners 44A, 44B, 44C, and 44D. Specifically, each of the corners 44A, 44B, 44C, and 44D is not formed by the edge joining assembly 140. Instead, each of the corners 44A, 44B, 44C, and 44D is formed by a bent portion 600, 610, 620, and 630, respectively, of the panels 20A'. Each of the bent portions 600, 610, 620, and 630 extends substantially vertically between the bottom portion 90 and the top portion 100 of one of the panels 20A'. The bent portions 600, 610, 620, and 630 may be formed in the panels 20A' using any method known in the art.

Figure 12A:
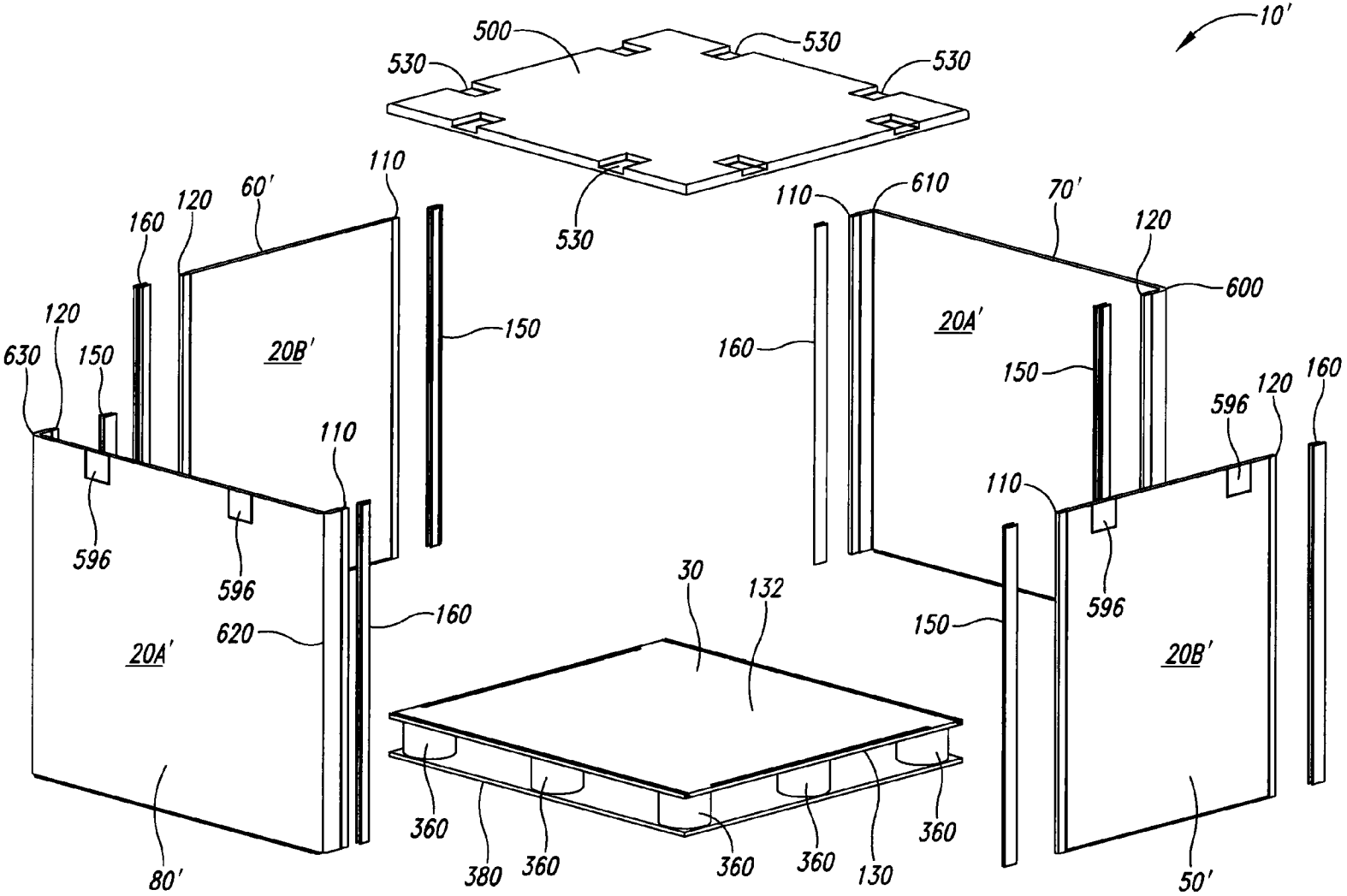
FIG. 12A is an exploded perspective view of the collapsible container of FIG. 11 including the optional lid. The Velcro straps used to secure the lid have been removed to provide a better view of aspects of the container.
Figure 12B:
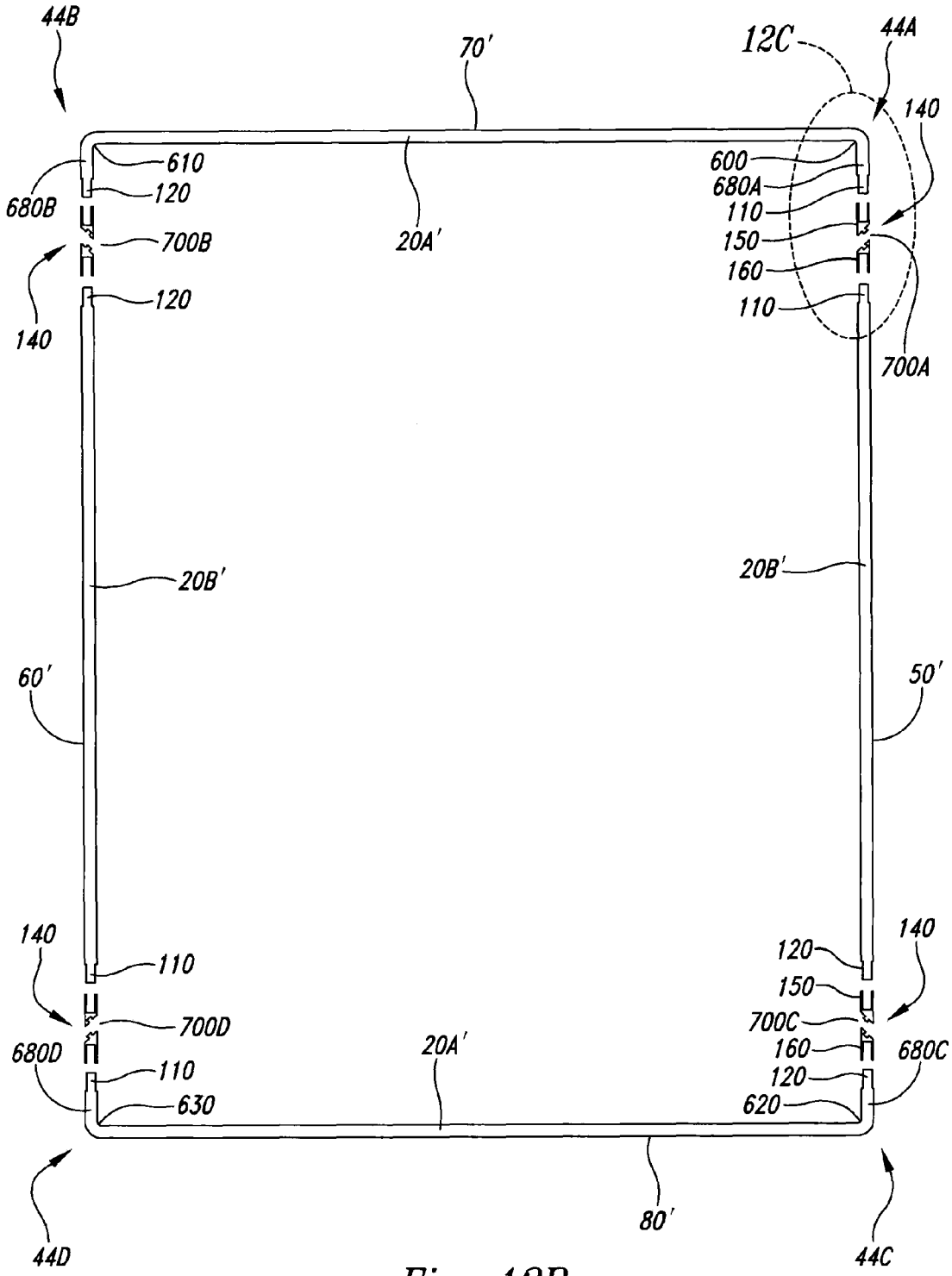
FIG. 12B is an exploded cross-sectional top view of the collapsible container of FIG. 11 taken through a plane substantially parallel to the bottom panel of the base of the container.
Figure 12C:
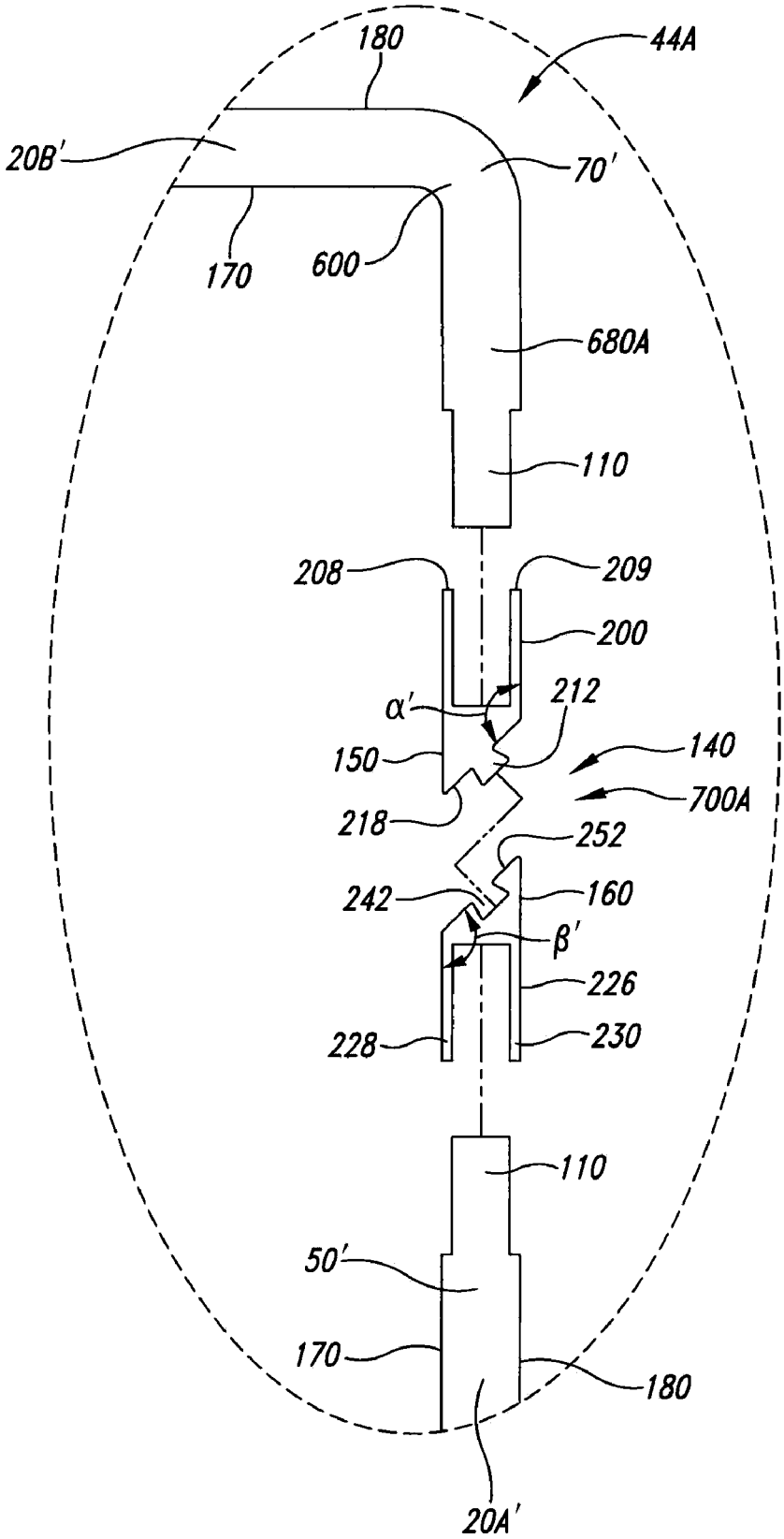
FIG. 12C is an enlarged fragmentary top view of a portion of FIG. 11 depicting one of the corners and the edge joining assemblies of the container.

With reference to FIGS. 12A-12C, the corner 44A may be formed by the bent portion 600 provided in the first side portion 110 of the first side panel 70'. The corner 44B may be formed by the bent portion 610 provided in the second side portion 120 of the first side panel 70'. The corner 44C may be formed by the bent portion 620 provided in the second side portion 120 of the second side panel 80'. The corner 44D may be formed by the bent portion 630 provided in the first side portion 110 of the second side panel 80'.

While in the embodiment depicted in the figures the bent portions 600, 610, 620, and 630 are provided in the panels 20A' of the first panel type, i.e., the first and second side panels 70' and 80', those of ordinary skill in the art appreciate that the bent portions 600, 610, 620, and 630 may be provided in the panels 20B' of the second panel type, i.e., the front and back panels 50' and 60', and such embodiments are within the scope of the present invention. Further, only the first side portion 110 of the panels 20A' and the second side portion 120 of the panels 20B' may include a bent portion. Alternatively, only the first side portion 110 of the panels 20B' and the second side portion 120 of the panels 20A' may include a bent portion.

Referring to FIG. 12B, the edge joining assemblies 140 are spaced from each of the corners 44A, 44B, 44C, and 44D along the perimeter portion 404' (see FIG. 13) of the bottom panel 400' of the base 30'. Turning to FIG. 12B-12C, each of the edge joining assemblies 140 includes the first elongated joining member 150 and the second elongated joining member 160. However, one of the first elongated joining member 150 and the second elongated joining member 160 is reversed or rotated 180° relative to the other.

In this embodiment, if the first elongated joining member 150 is rotated 180°, the angle "α'" is defined between the mating surface 218 and the outside sidewall 209 (which would have been the inside sidewall 208 had the first elongated joining member 150 not been rotated 180°), otherwise, the angle "α'" is defined between the mating surface 218 and the inside sidewall 208. If the second elongated joining member 150 is rotated 180°, the angle "β'" is defined between the mating surface 252 and the outside sidewall 230 (which would have been the inside sidewall 228 had the second elongated joining member 160 not been rotated 180°), otherwise, the angle "β'" is defined between the mating surface 252 and the inside sidewall 228. In other words, the sidewall used to define the angles "α'" and "β'" does not change with the orientation of the first elongated joining member 150 and the second elongated joining member 160, respectively.

In the embodiment depicted in the figures, the angles "α'" and "β'" total about 90°. In alternate embodiments, each of the angles "α'" and "β'" may be about 90°. Therefore, when the key portion 212 of the first elongated joining member 150 is inserted into the keyway portion 242 of the second elongated joining member 160, and the mating surface 218 is adjacent to and sealed with the mating surface 252, instead of constructing a corner, the edge joining assembly 140 constructs a linear section 700A, 700B, 700C, or 700D of container 10'.

In the embodiment depicted in FIG. 12B, the angles "α'" and "β'" may each be about 45°. The first elongated joining member 150 of the edge joining assembly 140 nearest the corner 44A is rotated 180°. The second elongated joining member 160 of the same edge joining assembly 140 is not rotated. When the key portion 212 of the first elongated joining member 150 is inserted into the keyway portion 242 of the second elongated joining member 160, the edge joining assembly 140 constructs the linear section 700A of the container 10'.

The first elongated joining member 150 of the edge joining assembly 140 nearest the corner 44B is not rotated and the second elongated joining member 160 of the same edge joining assembly 140 is rotated 180°. When the key portion 212 of the first elongated joining member 150 is inserted into the keyway portion 242 of the second elongated joining member 160, the edge joining assembly 140 constructs the linear section 700B of the container 10'.

The first elongated joining member 150 of the edge joining assembly 140 nearest the corner 44C is not rotated and the second elongated joining member 160 of the same edge joining assembly 140 is rotated 180°. When the key portion 212 of the first elongated joining member 150 is inserted into the keyway portion 242 of the second elongated joining member 160, the edge joining assembly 140 constructs the linear section 700C of the container 10'.

The first elongated joining member 150 of the edge joining assembly 140 nearest the corner 44D is rotated 180° and the second elongated joining member 160 of the same edge joining assembly 140 is not rotated. When the key portion 212 of the first elongated joining member 150 is inserted into the keyway portion 242 of the second elongated joining member 160, the edge joining assembly 140 constructs the linear section 700D of the container 10'.

While particular arrangements of the first elongated joining member 150 and second elongated joining member 160 used to construct the linear sections 700A, 700B, 700C, and 700D of container 10' have been described, those of ordinary skill in the art appreciate that alternate configurations of the first elongated joining member 150 and second elongated joining member 160 may be used to construct a linear section of the container 10' and such embodiments are within the scope of the present invention.

Figure 13:
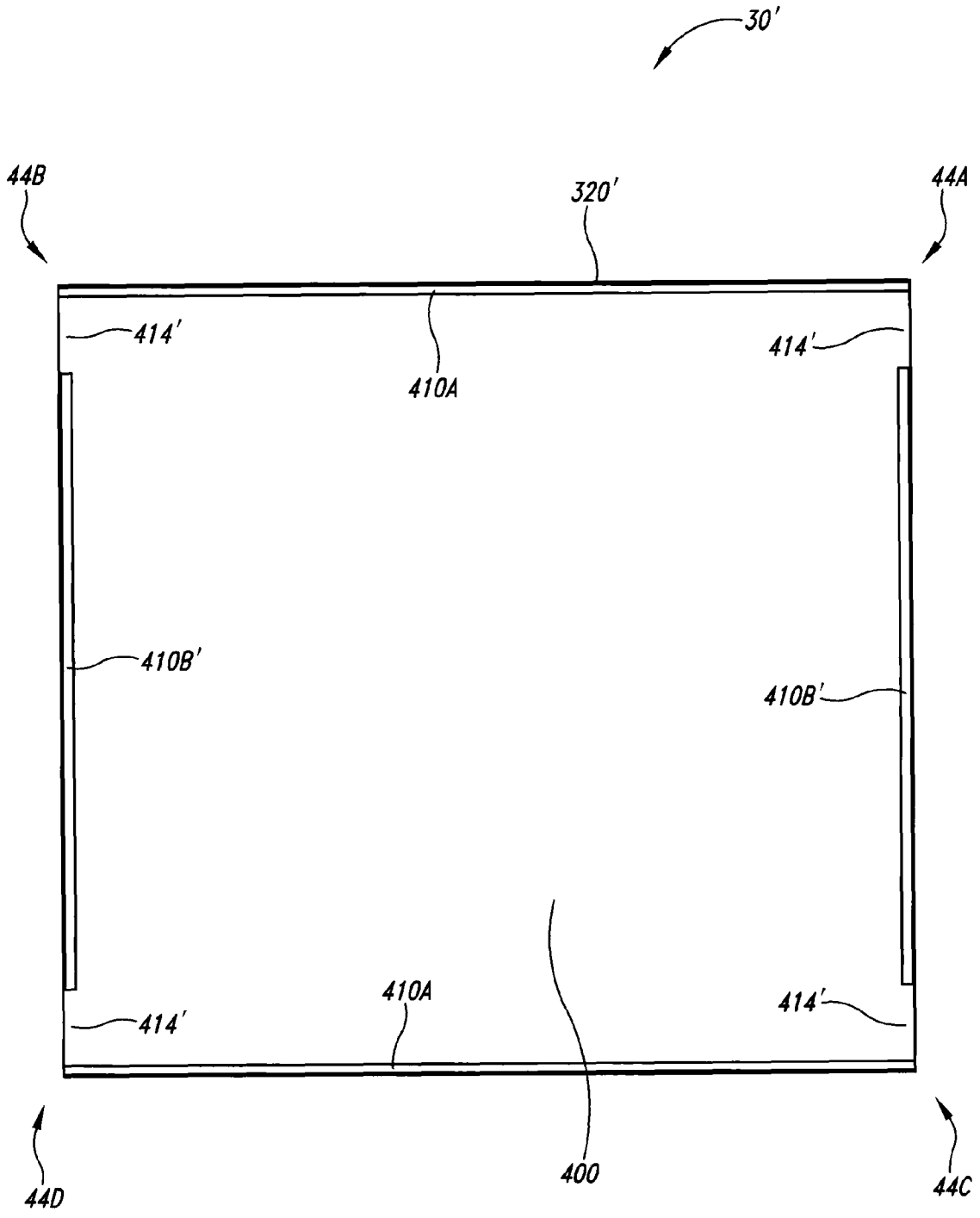
FIG. 13 is a top view of the bottom panel of the base of the container depicted in FIG. 11.

Referring to FIG. 13, a single groove 410A or 410B' is formed along each of the sides 403 of the perimeter portion 404' of the bottom panel 320' of the base 30'. Each of the grooves 410B' of the second groove type extends along only a portion of the side 403 in which the groove 410B' is formed. The grooves 410B' are longitudinally shorter than the grooves 410B of the embodiment depicted in FIG. 5. The portion 414' of the top surface 400 of the bottom panel 320' separates each groove 410A from the adjacent grooves 410B' flanking it. In the embodiment depicted in FIG. 13, the portion 414' of the top surface 400 is larger than the portion 414 of the top surface 400 of the embodiment depicted in FIG. 5.

A portion 680A of the first side panel 70A' located between the bent portion 600 and the first end portion 110 may be adjacent to and/or rest upon the portion 414' of the top surface 400 nearest the corner 44A. A portion 680B of the first side panel 70A' located between the bent portion 610 and the second end portion 120 may be adjacent to and/or rest upon the portion 414' of the top surface 400 nearest the corner 44B. A portion 680C of the second side panel 80A' located between the bent portion 620 and the second end portion 120 may be adjacent to and/or rest upon the portion 414' of the top surface 400 nearest the corner 44C. A portion 680D of the second side panel 80A' located between the bent portion 630 and the first end portion 110 may be adjacent to and/or rest upon the portion 414' of the top surface 400 nearest the corner 44D.

The container 10' may be assembled in the same manner the container 10 is assembled. The bottom portion 90 of the panels 20A' may be substantially identical to the bottom portion 90 of the panels 20A allowing the panels 20A' to be assembled with the base 30' in the same manner the panels 20A are assembled with the base 30. The bottom portion 90 of the panels 20B' may be substantially identical to the bottom portion 90 of the panels 20B. However, because the groove 410B' is longitudinally shorter than the groove 410B, the bottom portion 90 of the panels 20B' may be correspondingly shorter than the bottom portion 90 of the panel 20B. The panels 20B' may be assembled with the base 30' by inserting the bottom portion 90 into the groove 410B' in the same manner the panels 20B are assembled with the base 30. The container 10' may be disassembled in the same manner the container 10 is disassembled.

While the embodiment of the container 10' depicted in FIGS. 12A-12C and 13 includes the first elongated joining members 150 and second elongated joining members 160, as is apparent to those of ordinary skill in the art, the container 10' may alternatively include the first elongated joining members 150' (see FIGS. 4A-4B) and second elongated joining members 160' (see FIGS. 4A-4B). Optionally, the container 10' may include the lid 500.

Referring to FIGS. 17-23, another alternate embodiment of the collapsible container 10 will be described. For ease of illustration, like reference numerals have been used to identify like components of a collapsible container 1500 and other embodiments of the collapsible container 10. Only the most significant aspects of the container 1500 that differ from the other embodiments described above will be described in detail.

Figure 17:
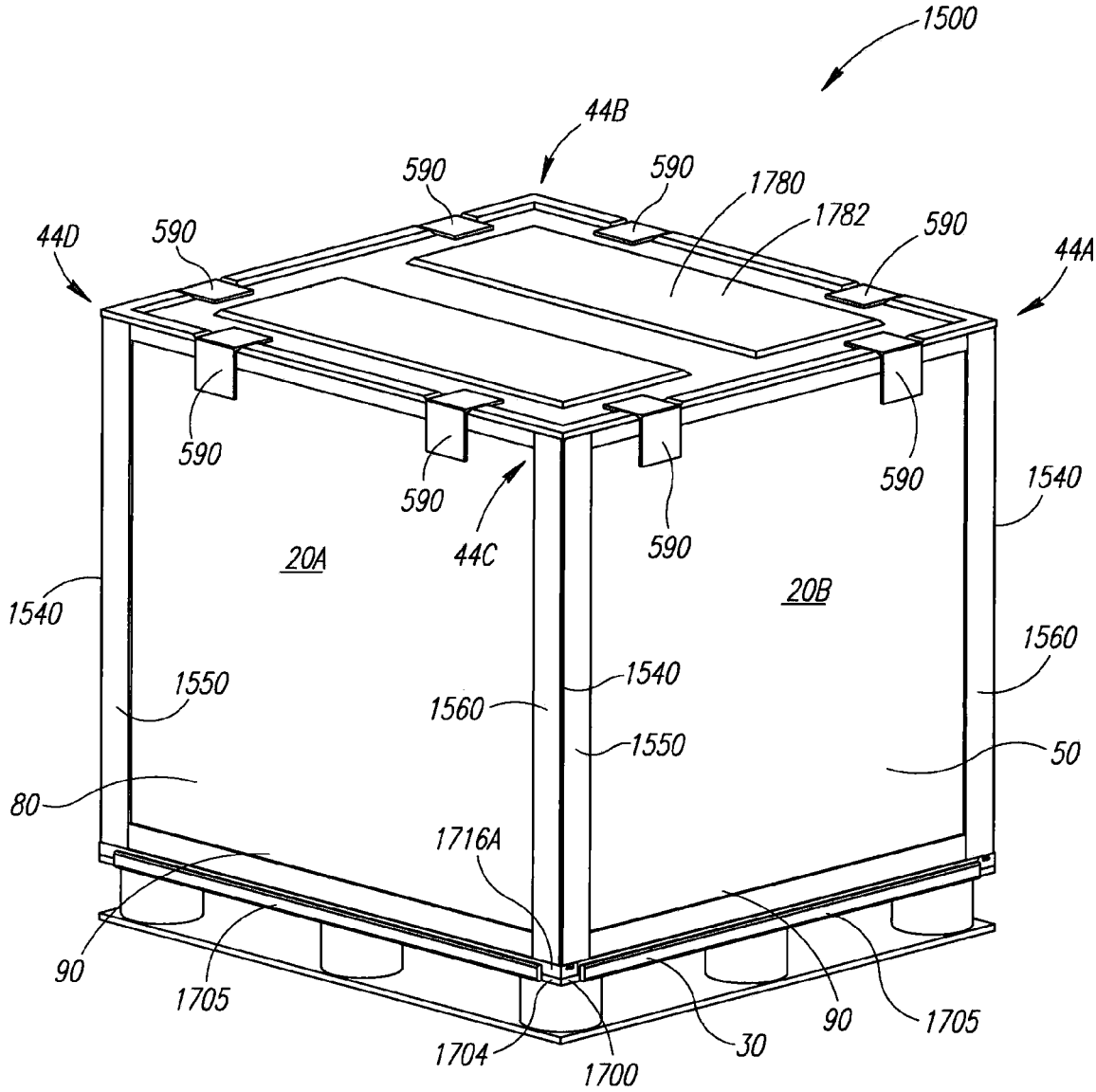
FIG. 17 is a perspective view of an alternate embodiment of a collapsible container including an optional lid and Velcro straps used to secure the lid.
Figure 18:
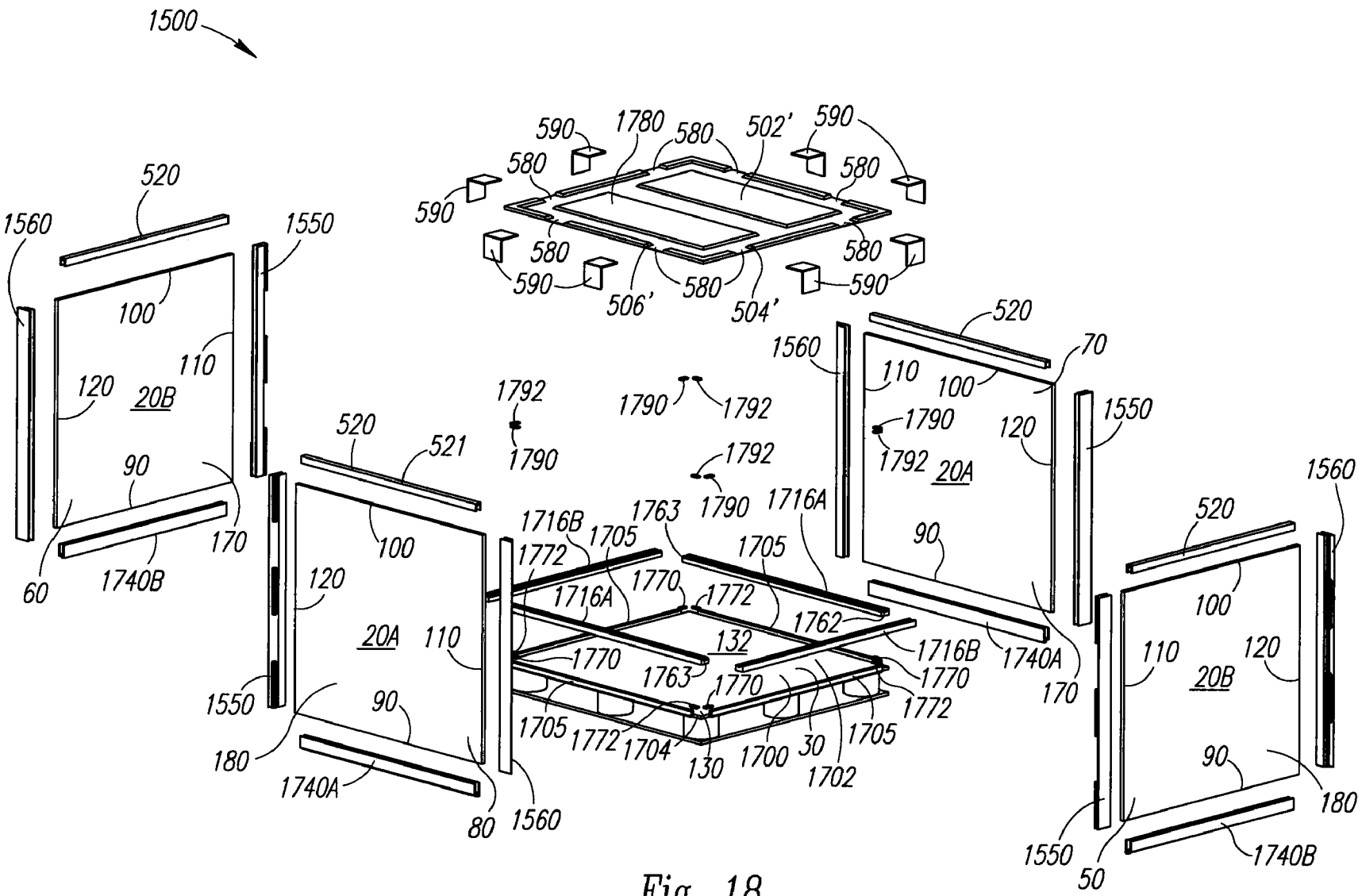
FIG. 18 is an exploded perspective view of the alternate embodiment of the collapsible container of FIG. 17.

Referring to FIGS. 17 and 18, like previously discussed embodiments, the collapsible container 1500 includes panels 20A and 20B coupled by their bottom portions 90 to the base 30. The bottom portion 90 of each of the uprighted panels 20 is arranged around the perimeter portion 130 of the base 30 in an alternating fashion with each of the panels 20A of the first panel type being flanked by a pair of panels 20B of the second panel type. The panels 20A of the first panel type include the first side panel 70 and the second side panel 80. The panels 20B of the second panel type include the front panel 50 and the back panel 60. In alternate embodiments, the first side and the second side panels 70 and 80 are of the second panel type and the front and the back panels 50 and 60 are of the first panel type. Because the container 1500 may be perceived in various orientations the terms "front," "back," "first side," and "second side" are used merely for illustrative purposes and do not limit the scope of the present invention.

Each of the panels 20A and 20B is coupled to the pair of panels flanking it by an edge joining assembly 1540. Each of the edge joining assemblies 1540 may be used to construct one of the corners 44A, 44B, 44C, and 44D of the container 1500. However, as was described above with reference to the container 10' of FIGS. 11-13, the corners 44A, 44B, 44C, and 44D may be formed in the panels 20A of the first panel type or the panels 20B of the second panel type separate from the edge joining assemblies 1540 and such embodiments of the container 1500 are within the scope of the present description.

Each edge joining assembly 1540 includes a first elongated joining member 1550 and a second elongated joining member 1560. The first elongated joining member 1550 longitudinally engages the second elongated joining member 1560 and locks therewith to prevent the lateral disengagement of the first elongated joining member 1550 from the second elongated joining member 1560. The first elongated joining member 1550 and the second elongated joining member 1560 are coupled to the panels 20A and 20B in any manner and in any arrangement discussed above as suitable for coupling the first elongated joining member 150 and the second elongated joining member 160 to the panels 20A and 20B to form one of the edge joining assemblies 140.

Figure 19A:
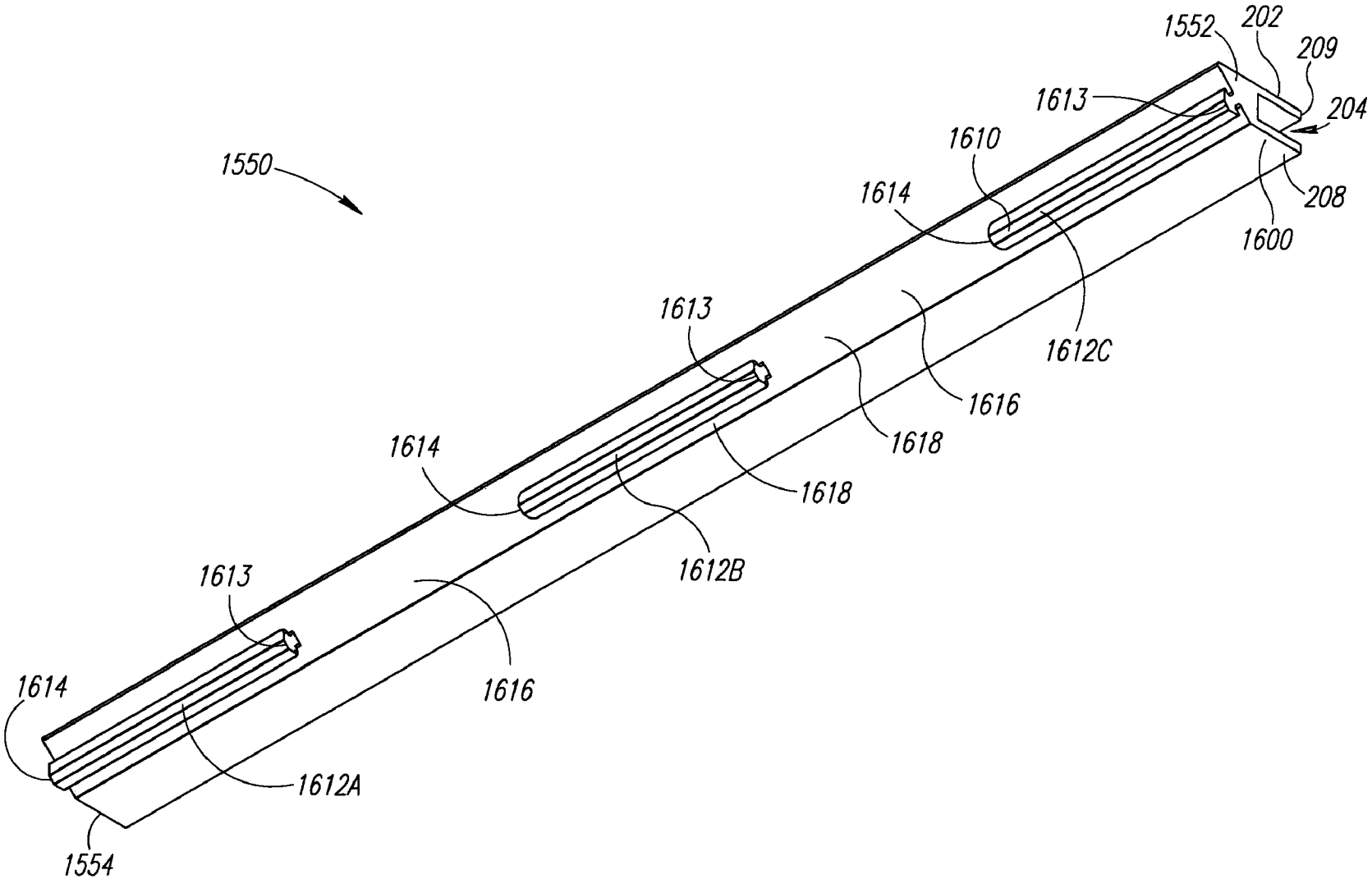
FIG. 19A is an enlarged perspective view of a first elongated edge joining member of an edge joining assembly of the container of FIG. 17.
Figure 19B:
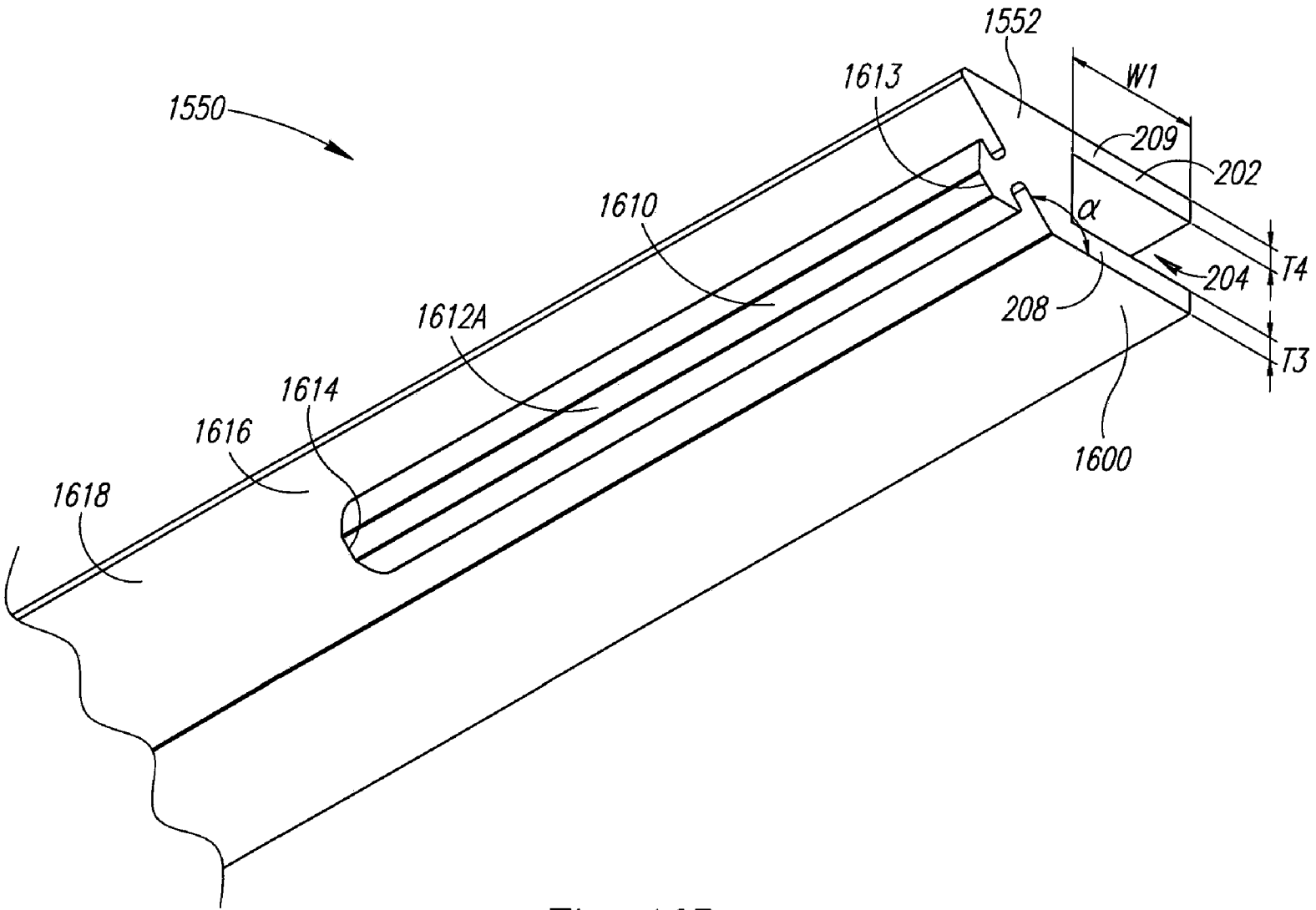
FIG. 19B is an enlarged fragmentary perspective view of the first elongated edge joining member of FIG. 19A.

Referring to FIGS. 19A and 19B, the structure of the first elongated joining member 1550 will now be described. The first elongated joining member 1550 has a top end portion 1552 opposing a bottom end portion 1554. The first elongated joining member 1550 includes a connector 1600 integrally formed with or coupled to a locking portion 1610. The connector 1600 is configured to be coupled to either the first side portion 110 or the second side portion 120 of one of the panels 20A and 20B. The connector 1600 may be substantially similar to the connector 200 of the first elongated joining member 150 (described above). For example, the connector 1600 may include the connector portion 202 having a generally U-shaped cross-sectional shape with the interior 204 sized and shaped to receive one of the first side portion 110 and the second side portion 120 of one of the panels 20A and 20B.

Referring to FIG. 19B, the interior 204 of the connector portion 202 may be defined between a longitudinally extending inside sidewall 208 and a substantially identical longitudinally extending spaced apart outside sidewall 209. The inside sidewall 208 and the outside sidewall 209 have a thickness "T3" and "T4," respectively. The thicknesses "T3" and "T4 may be about 0.1 inches to about 0.5 inches, and in the embodiment depicted are about 0.25 inches. As mentioned above, each of the sidewalls 208 and 209 has the width "W1," which may range from about 1 inch to about 2 inches. By way of a non-limiting example, the width "W1" is about 1.5 inches.

The connector 1600 may be coupled to either the first side portion 110 or the second side portion 120 of one of the panels 20A and 20B in any manner described as suitable for similarly coupling the connector 200 to either the first side portion 110 or the second side portion 120 of one of the panels 20A and 20B.

In the embodiment depicted in FIG. 18, the first side portion 110 and the second side portion 120 of one of the panels 20A and 20B do not include the relieved portions 220 and 224, respectively. However, as is apparent to those of ordinary skill in the art, embodiments in which at least one of the first side portion 110 and the second side portion 120 of one of the panels 20A and 20B include the relieved portions 220 and 224, respectively, are within the scope of the present description.

Returning to FIGS. 19A and 19B, the locking portion 1610 includes at least one outwardly projecting, longitudinally extending key portion 1612A. In the embodiment depicted in FIG. 19A, the locking portion 1610 includes three outwardly projecting, longitudinally extending and longitudinally aligned key portions 1612A, 1612B, and 1612C. The key portions 1612A, 1612B, and 1612C may be characterized as a single discontinuous or interrupted key portion or alternatively as separate individual key portions that cooperated together to form a single key portion. Each of the key portions 1612A, 1612B, and 1612C has a first end portion 1613 and a second end portion 1614 opposite the first end portion 1613. In the embodiment depicted, the locking portion 1610 includes an angled stop wall 1616 that is substantially similar to the angled stop wall 216 (see e.g., FIG. 3B) discussed above. In various embodiments, the key portions 1612A, 1612B, and 1612C project outwardly in a direction substantially orthogonal to the angled stop wall 1616. The stop wall 1616 includes a mating surface 1618.

While each of the key portions 1612A, 1612B, and 1612C depicted in the drawings is generally similar to the key portion 1212 (see FIG. 14B), which has a T-shaped or knob-shaped cross-sectional shape, those of ordinary skill in the art appreciate that alternate cross-sectional shapes, including a tapered cross-sectional shape that is narrower near the angled stop wall 1616 and widens the farther the key portions 1612A, 1612B, and 1612C project therefrom (see the key portion 212 depicted in FIG. 3B), are within the scope of the present invention.

Figure 20A:
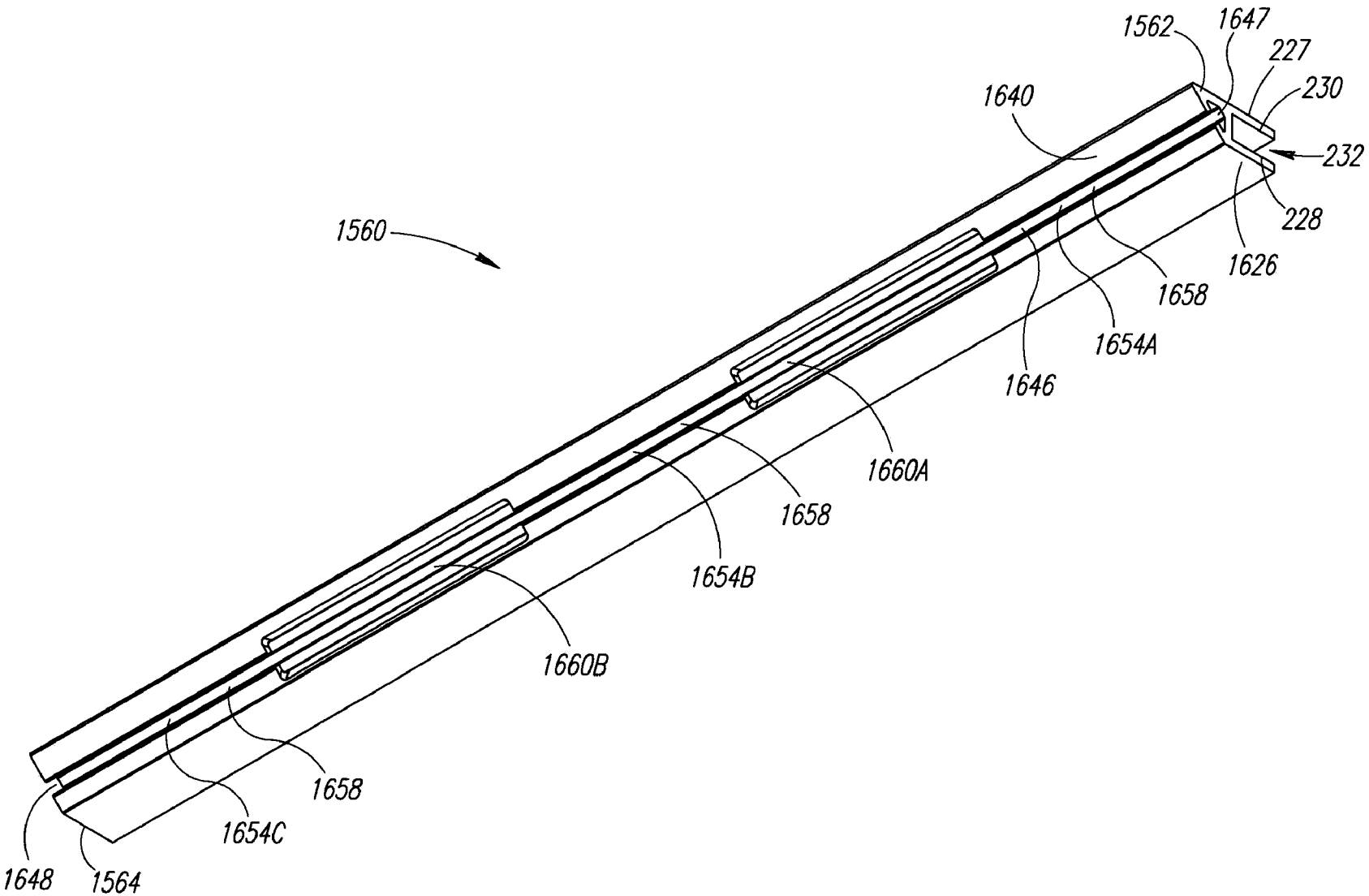
FIG. 20A is an enlarged perspective view of a second elongated edge joining member of the edge joining assembly of the container of FIG. 17.
Figure 20B:
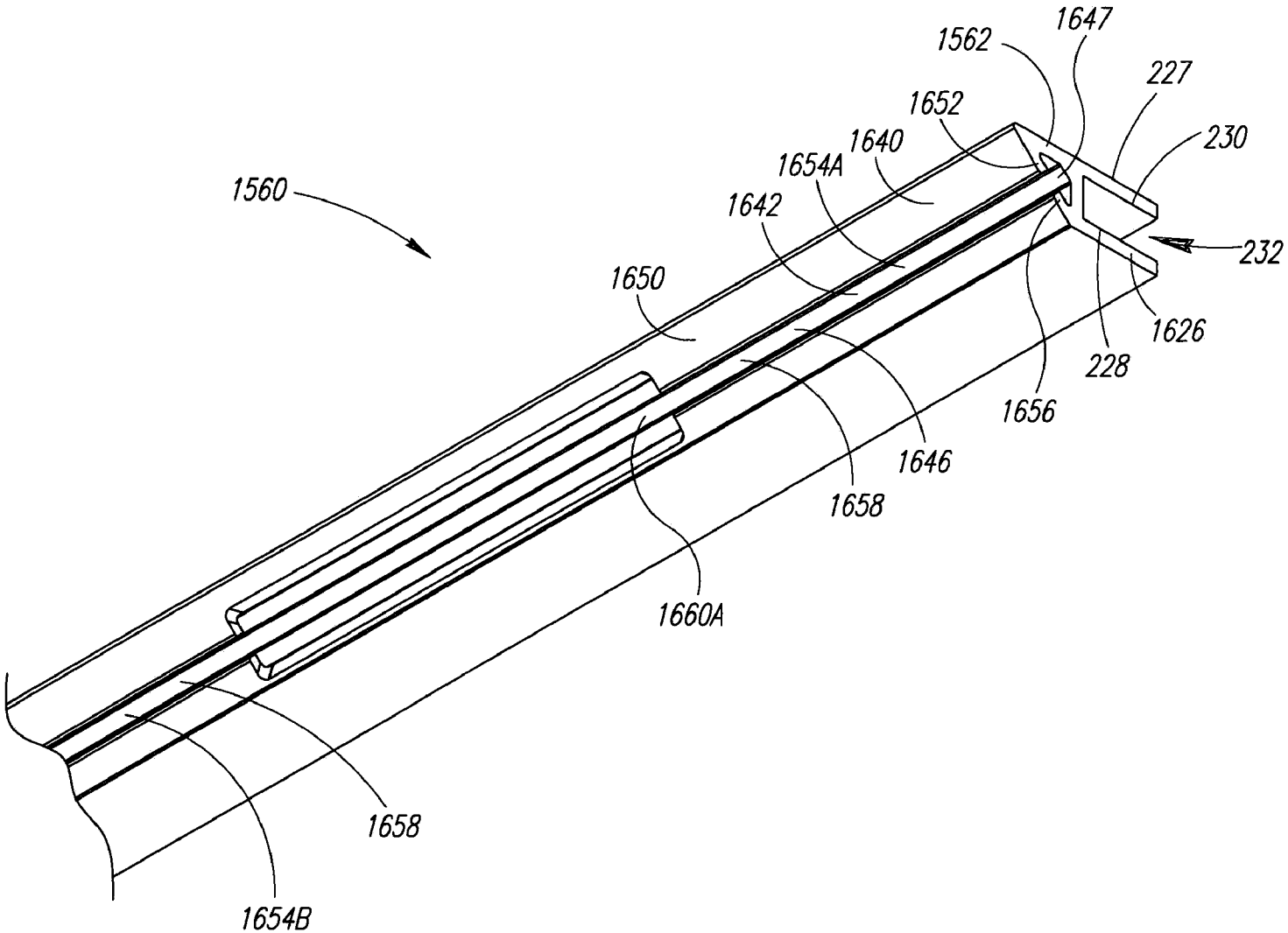
FIG. 20B is an enlarged fragmentary perspective view of the second elongated edge joining member of FIG. 20A.

Referring to FIGS. 20A and 20B, the second elongated joining member 1560 has a top end portion 1562 opposing a bottom end portion 1564. The second elongated joining member 1560 may include a connector 1626 integrally formed with or coupled to a locking portion 1640. The connector 1626 is configured to be coupled to either the first side portion 110 or the second side portion 120 of one of the panels 20A and 20B. The connector 1626 may be substantially identical to the connector 200 of the first elongated long member 150 (see FIG. 3B). The connector 1626 may include the connector portion 227, which is substantially similar to the connector portion 202. In particular embodiments, the connector 1626 may include the inside sidewall 228 spaced from the outside sidewall 230 and defining the interior 232 therebetween. The inside sidewall 228 may be substantially identical to the inside sidewall 208 of the connector portion 202 and the outside sidewall 230 may be substantially identical to the outside sidewall 209 of the connector portion 202.

The connector 1626 may be coupled to either the first side portion 110 or the second side portion 120 of one of the panels 20A and 20B in any manner described as suitable for similarly coupling the connector 200 to either the first side portion 110 or the second side portion 120 of one of the panels 20A and 20B.

Referring to FIG. 20B, the locking portion 1640 includes a longitudinally extending keyway portion 1642 having an angled stop wall 1650 and a longitudinally extended open-ended channel 1646 formed therein and configured to receive the key portions 1612A, 1612B, and 1612C of the first elongated joining member 1550. The channel 1646 extends from the angled stop wall 1650 into the locking portion 1640 of the second elongated joining member 1560 at an angle approximately orthogonal to the angled stop wall 1650. Referring to FIG. 20A, the open-ended channel 1646 has a top open end 1647 formed in the top end portion 1562 of the second elongated joining member 1560 and a bottom open end 1648 formed in the bottom end portion 1564 of the second elongated joining member 1560.

Referring to FIGS. 20A and 20B, the angled stop wall 1650 also includes a discontinuous first overhang portion 1652 that extends laterally over one or more partially enclosed portions 1654A, 1654B, and 1654C of the channel 1646 partially enclosing at least a portion thereof. The angled stop wall 1650 also includes a second discontinuous overhang portion 1656 that extends laterally over the one or more partially enclosed portions 1654A, 1654B, and 1654C of the channel 1646 toward the first overhang portion 1652 partially enclosing at least a portion of the partially enclosed portions 1654A, 1654B, and 1654C. A longitudinally extending opening 1658 is defined between the first overhang portion 1652 and the second overhang portion 1656 in the partially enclosed portions 1654A, 1654B, and 1654C of the channel 1646.

One or more unenclosed portions 1660A and 1660B of the channel 1646 are not partially enclosed by the first overhang portion 1652 and the second overhang portion 1656. The unenclosed portions 1660A and 1660B of the channel 1646 alternate with the partially enclosed portions 1654A, 1654B, and 1654C of the channel 1646. Each of the unenclosed portions 1660A and 1660B of the channel 1646 corresponds to one of the key portions 1612A, 1612B, and 1612C. In the embodiment depicted in the drawings, the second elongated joining member 1560 has one fewer unenclosed portions 1660A and 1660B of the channel 1646 than the first elongated joining member 1550 has key portions 1612A, 1612B, and 1612C. Further, each of the partially enclosed portions 1654A, 1654B, and 1654C corresponds to one of the key portions 1612A, 1612B, and 1612C. In the embodiment depicted in the drawings, the second elongated joining member 1560 has the same number of partially enclosed portions 1654A, 1654B, and 1654C as the first elongated joining member 1550 has key portions 1612A, 1612B, and 1612C.

As is apparent to those of ordinary skill in the art, each of the locking portion 1610 and the locking portion 1640 may be symmetric about their longitudinal midpoint. In this manner, the locking portion 1610 may engage the locking portion 1640 even if one or both of the first elongated joining member 1550 and the second elongated joining member 1560 is rotated 180 degrees about its longitudinal midpoint into an upside down orientation with the top end portion 1552 and/or the top end portion 1562 located adjacent to the base 30.

The unenclosed portions 1660A and 1660B of the channel 1646 each provide a through way for a selected one of the key portions 1612A, 1612B, and 1612C through which the selected key portion may enter and exit the channel 1646. In other words, each of the unenclosed portions 1660A and 1660B is configured to receive the selected key portion 1612A, 1612B, or 1612C and allow it pass therethrough thus providing an entryway into and an exit from the channel 1664. After the selected one of key portions 1612A, 1612B, and 1612C is received inside each of the unenclosed portions 1660A and 1660B, the key portions are slid longitudinally in a first direction into an adjacent one of the partially enclosed portions 1654A, 1654B, and 1654C where the key portions 1612A, 1612B, and 1612C are trapped inside the channel 1646 by the first overhang portion 1652 and the second overhang portion 1656.

The angled stop wall 1616 of the locking portion 1610 of the first elongated joining member 1550 bears against the angled stop wall 1650 of the locking portion 1640 of the second elongated joining member 1560 when the key portions 1612A, 1612B, and 1612C of the first elongated joining member 1550 are received inside the enclosed portions 1654A, 1654B, and 1654C of the channel 1646 of the keyway portion 1642 of the second elongated joining member 1560.

To disengage the selected one of key portions 1612A, 1612B, and 1612C from the adjacent one of the partially enclosed portions 1654A, 1654B, and 1654C, the key portions may slid in a second direction, opposite the first direction, and positioned inside one of the unenclosed portions 1660A and 1660B. Once inside one of the unenclosed portions 1660A and 1660B, the selected key portion 1612A, 1612B, or 1612C may be removed laterally from the channel 1646.

A method of assembling the edge joining assembly 1540 will now be described. As is apparent to those of ordinary skill, before the first elongated joining member 1550 and the second elongated joining member 1560 are coupled to the panels 20A and 20B, the first elongated joining member 1550 and the second elongated joining member 1560 may be configured to be assembled in several configurations. For example, both the first elongated joining member 1550 and the second elongated joining member 1560 may be arranged in an upright orientation before they are assembled. Alternatively, one of the first elongated joining member 1550 and the second elongated joining member 1560 may be arranged in an upright orientation and the other of the first elongated joining member 1550 and the second elongated joining member 1560 arranged in an upside down orientation before they are assembled. Alternatively, both the first elongated joining member 1550 and the second elongated joining member 1560 may be arranged in an upside down orientation before they are assembled. Therefore, the assignment of top and bottom ends to the first elongated joining member 1550 and the second elongated joining member 1560 does not limit the manner in which these components may be assembled into the edge joining assemblies 1540. After a configuration is selected, the first elongated joining member 1550 and the second elongated joining member 1560 may each be coupled to one of the panels 20A and 20B. After the first elongated joining member 1550 and the second elongated joining member 1560 have each been coupled to one of the panels 20A and 20B, the number of configurations in which the first elongated joining member 1550 and the second elongated joining member 1560 may be assembled may be limited.

For ease of illustration, the assembly of the first elongated joining member 1550 and the second elongated joining member 1560 will be described with respect to only one of the several possible orientations of the first elongated joining member 1550 and the second elongated joining member 1560. Specifically, the orientations of the first elongated joining member 1550 and the second elongated joining member 1560 used to construct the edge joining assembly 1540 forming the corner 44C (see FIGS. 17 and 18) will be described. In the edge joining assembly 1540 forming the corner 44C, the first elongated joining member 1550 is in an upside down orientation (i.e., the top end portion 1552 is adjacent the base 30) and the second elongated joining member 1560 is in an upright orientation (i.e., the bottom end portion 1564 is adjacent the base 30). However, those of ordinary skill in the art appreciate that the assembly of the other possible orientations of the first elongated joining member 1550 and the second elongated joining member 1560 is substantially similar and within the scope of the present description.

To assemble the edge joining assembly 1540 forming the corner 44C, the key portions 1612B and 1612C, are inserted laterally into the unenclosed portions 1660A and 1660B, respectively, of the channel 1646. The second end portion 1613 of the key portion 1612A is aligned with the top open end 1647 of the channel 1646. Then, the first elongated joining member 1550 is slid longitudinally toward the bottom end portion 1564 of the second elongated joining member 1560 until the key portion 1612C is received inside the enclosed portion 1654C, the key portion 1612B is received inside the enclosed portion 1654B, and key portion 1612A is received inside the enclosed portion 1654A. When the first elongated joining member 1550 is slid longitudinally in this manner, the second end portion 1613 of the key portion 1612A is slidably received into the top open end 1647 of the channel 1646 and then slides along the channel 1646.

To disassemble the edge joining assembly 1540 forming the corner 44C, the first elongated joining member 1550 is slid longitudinally away from the enclosed portion 1654C until the key portion 1612C is received inside the unenclosed portion 1660B, the key portion 1612B is received inside the unenclosed portion 1660A, and key portion 1612A exits the enclosed portion 1654A through the top open end 1647 of the channel 1646. The first elongated joining member 1550 is then disengaged from the second elongated joining member 1560 by laterally removing the key portions 1612B and 1612C from the unenclosed portions 1660A and 1660B, respectively, of the channel 1646.

While the first overhang portion 1652 and the second overhang portion 1656 have been described as being discontinuous, those of ordinary skill in the art appreciate that the first overhang portion 1652 and/or the second overhang portion 1656 may instead be continuation and each of the unenclosed portions 1660A and 1660B of the channel 1646 formed therein by removing only a sufficient portion of the first overhang portion 1652 and/or the second overhang portion 1656 to permit the entry and withdrawal of one of the key portions 1612A, 1612B, and 1612C therethrough.

The first elongated joining member 1550 and the second elongated joining member 1560 of the edge joining assembly 1540 may be constructed using any method suitable for constructing the first elongated joining member 150 and the second elongated joining member 160, respectively, of the edge joining assembly 140. Each of the key portions 1612A, 1612B, and 1612C may be formed by removing two adequately spaced apart portions of a continuous key portion using any method known in the art. Similarly, each of the unenclosed portions 1660A and 1660B of the channel 1646 may be formed by removing two adequately spaced apart portions of the first overhang portion 1652 and/or the second overhang portion 1656 using any method suitable for removing two adequately spaced apart portions of the continuous key portion.

As mentioned above, the container 1500 includes the base 30. The base 30 includes an alternate embodiment of the bottom panel 320. Referring to FIGS. 17 and 18, the base 30 includes a bottom panel 1700 having a top surface 1702 and a perimeter portion 1704. A discontinuous outer rail 1705 is affixed to selected locations of the perimeter portion 1704.

A panel anchor strip 1716A or 1716B is affixed to the top surface 1702 of the bottom panel 1700 along each of the four sides of the perimeter portion 1704. As mentioned above, the panels 20A are of the first panel type and the panels 20B are of the second panel type. Similarly, the panel anchor strips 1716A are of a first anchor strip type and the panel anchor strips 1716B are of a second anchor strip type. Each of the panel anchor strips 1716A of the first anchor strip type corresponds to a single panel 20A of the first panel type and each of the panel anchor strips 1716B of the second anchor strip type corresponds to a single panel 20B of the second panel type. Each of the panel anchor strips 1716B may be flanked by a pair of panel anchor strips 1716A and extend therebetween. As is apparent to those of ordinary skill, in other embodiments, the structure described below with respect to the anchor strips 1716A and the anchor strips 1716B may be may be formed in the top surface 1702 of the bottom panel 1700 instead of being included in the anchor strips 1716A and the anchor strips 1716B and such embodiments are within the scope of the present description.

Figure 21A:
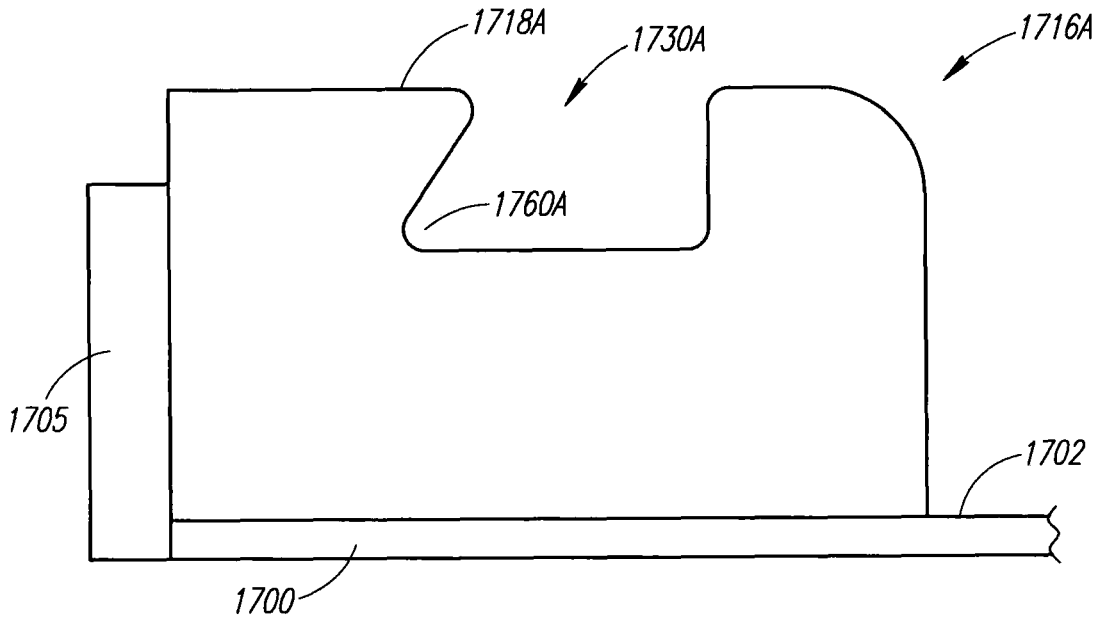
FIG. 21A is an enlarged cross-sectional view of a panel anchor strip for anchoring panels of a first panel type to a base of the container of FIG. 17.
Figure 21B:
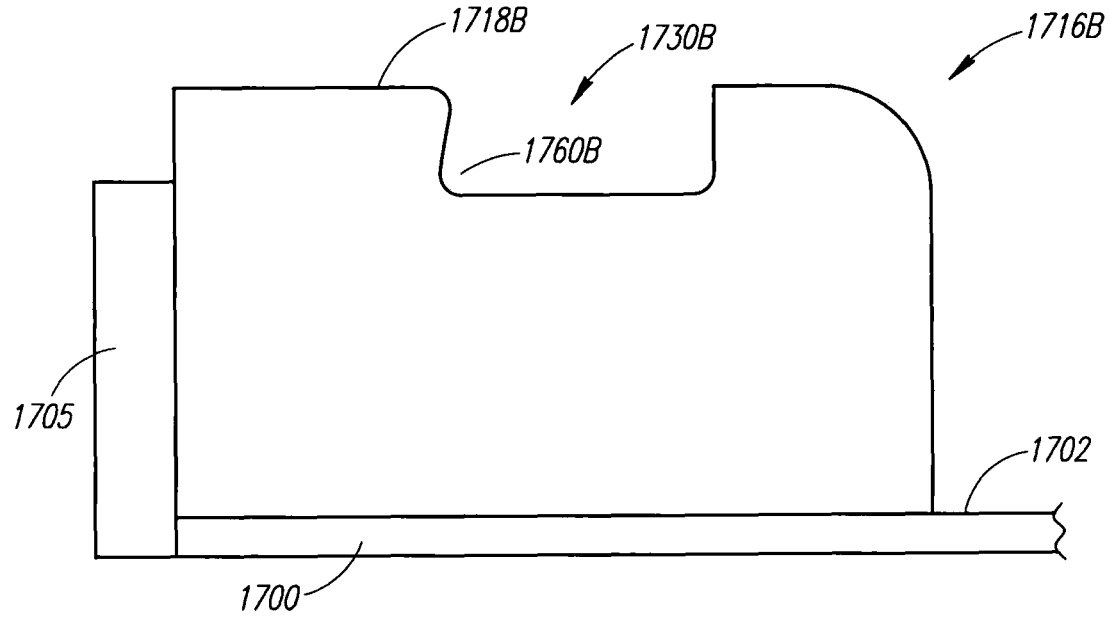
FIG. 21B is an enlarged cross-sectional view of a panel anchor strip for anchoring panels of a second panel type to the base of the container of FIG. 17.

Referring to FIGS. 21A and 21B, each of the panel anchor strips 1716A has a top surface 1718A and each of the panel anchor strips 1716B has a top surface 1718B. The grooves 410A or 410A' (see FIGS. 6A and 6C, respectively), or in the alternative, the groove shape shown as grooves 410A" (see FIG. 15A), may be formed in the top surface 1718A of the panel anchor strips 1716A. The grooves 410B (see FIG. 7), or in the alternative, the groove shape shown as grooves 410B' (see FIG. 15B), may be formed in the top surface 1718B of the panel anchor strips 1716B. Alternatively, as shown in FIGS. 21A and 21B, groove 1730A having the cross-sectional shape depicted in FIG. 21A may be formed in the top surface 1718A of the panel anchor strips 1716A and a groove 1730B having the cross-sectional shape depicted in FIG. 21B may be formed in the top surface 1718B of the panel anchor strips 1716B.

Returning to FIGS. 17 and 18, each of the panels 20A is connected to the base 30 by an elongated anchor member 1740A coupled to a corresponding panel anchor strip 1716A disposed on the top surface 1702 of the bottom panel 1700. As may best be viewed in FIG. 22A, the anchor member 1740A includes a connector 1742A integrally formed with or coupled to an anchor portion 1744A. The bottom portion 90 of each of the panels 20A is received inside the connector 1742A of the anchor member 1740A. The connector 1742A may be substantially identical to the connector 200 of the first elongated joining member 150. In the embodiment depicted in FIG. 22A, the connector 1742A includes a longitudinally extending sleeve or connector portion 1743A having an interior 1745 defined between a pair of sidewalls 1747 and 1749. The interior 1745 may be sized and shaped to receive the bottom portion 90 of one of the panels 20A therein. Each of the sidewalls 1747 and 1749 may extend laterally and upwardly along the bottom portion 90. The connector 1742A may be affixed to the bottom portion 90 in any manner suitable for affixing the connector 200 of the first elongated joining member 150 to the first or second side portions 110 and 120 of one of the panels 20A and 20B.

Optionally, the bottom portion 90 of each of the panels 20A may include the relieved portion 92 (see FIGS. 15A and 15B) that is received inside the connector 1742A of the anchor member 1740A. In such an embodiment, the interior 1745 may be sized and shaped to receive the relieved portion 92 therein. Each of the sidewalls 1747 and 1749 may extend laterally and upwardly along the relieved portion 92. The connector 1742A may be affixed to the relieved portion 92 in any manner suitable for affixing the connector 200 of the first elongated joining member 150 to the first or second side portions 110 and 120 of one of the panels 20A and 20B.

Figure 22B:
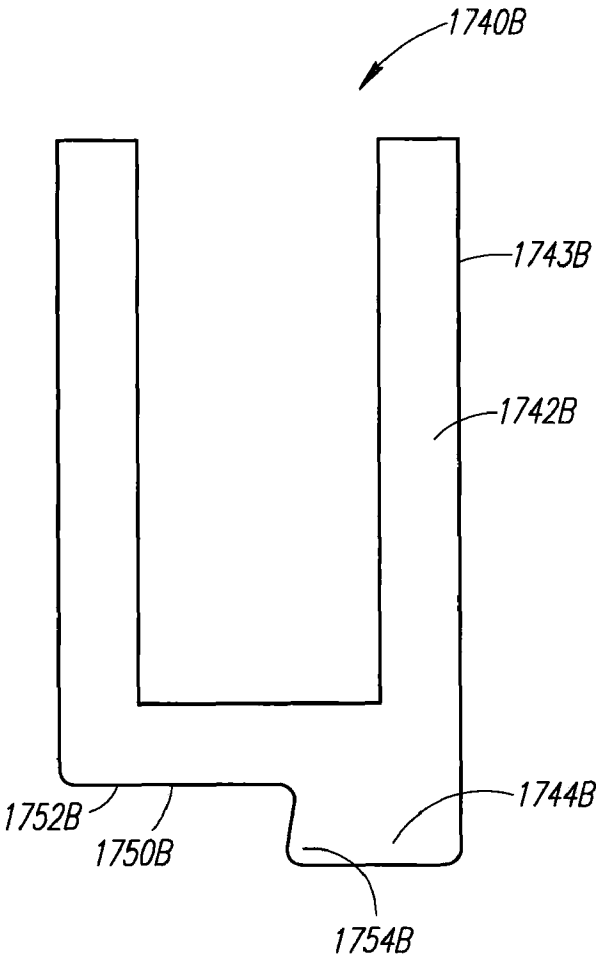
FIG. 22B is an enlarged cross-sectional view of an elongated anchor member configured to anchor a panel of the second panel type to the panel anchor strip of FIG. 21B.
Figure 22A:
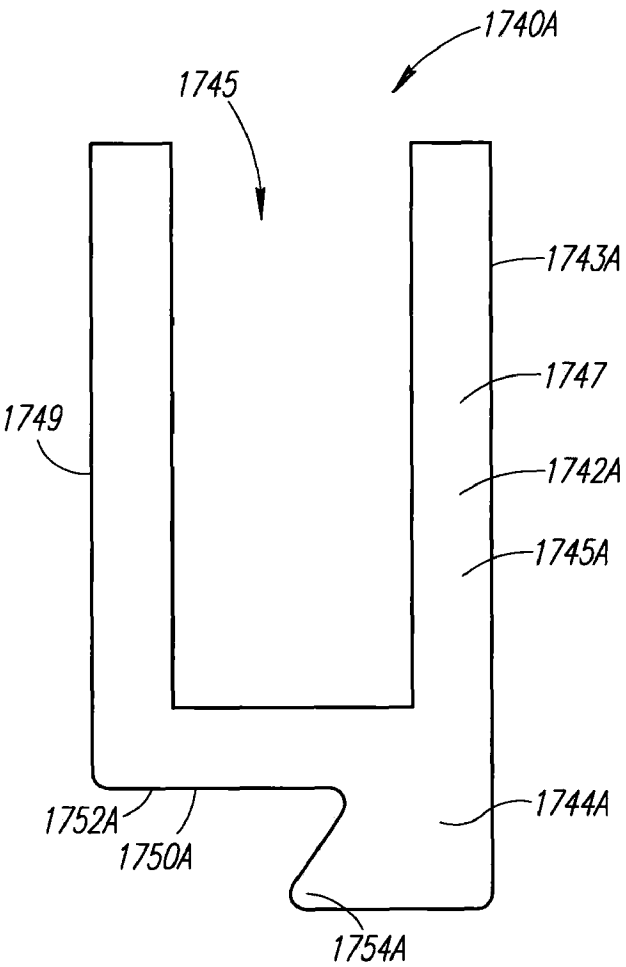
FIG. 22A is an enlarged cross-sectional view of an elongated anchor member configured to anchor a panel of the first panel type to the panel anchor strip of FIG. 21A.

In the embodiment depicted in FIG. 22A, the connector 1742A is offset laterally from the anchor portion 1744A creating an overhanging portion 1750A. The overhanging portion 1750A may be adjacent to the outside facing face 180 of the panel 20A. An underside 1752A of the overhanging portion 1750A may bear against the top surface 1718A of the panel anchor strips 1716A (see FIG. 21A) when the anchor member 1740A is coupled thereto.

The anchor portion 1744A may be substantially identical to the relieved portion 440A' (see FIG. 6C) described above. Alternatively, the anchor portion 1744A may include a laterally extending toe portion 1754A. As is apparent to those of ordinary skill in the art, while the cross-sectional shape of the toe portion 1754A differs from the cross-sectional shape of toe portion 450A' depicted in the figures, the toe portion 1754A is functionally equivalent to the toe portion 450A' functioning in a substantially identical manner thereto. Further, those of ordinary skill will readily recognize alternate cross-sectional shapes suitable for use with the toe portion 1754A, such as square, rectangular, oval, trapezoidal, arbitrary, and the like, and such embodiments are within the scope of the present invention.

Returning to FIG. 21A, the groove 1730A formed in the panel anchor strip 1716A may include an undercut portion 1760A configured to receive the toe portion 1754A in substantially the same manner the undercut portion 460A' (see FIG. 6C) receives the toe portion 450A'. Returning to FIG. 18, the grooves 1730A may be open ended, having a first open end 1762, and a second open end 1763 opposite the first open end 1762. The panel 20A may be installed in the groove 1730A by placing the panel 20A in an upright orientation and sliding the anchor portion 1744A into one of the open ends 1762 or 1763 of the groove 1730A in a manner similar to that depicted in FIG. 16.

Returning to FIGS. 21B and 22B, each of the panels 20B is connected to the base 30 by an elongated anchor member 1740B coupled to a corresponding panel anchor strip 1716B disposed on the top surface 1702 of the bottom panel 1700. As may best be viewed in FIG. 22B, the anchor member 1740B includes a connector 1742B integrally formed with or coupled to an anchor portion 1744B. The connector 1742B may be substantially identical to the connector 1742A of the anchor member 1740A and therefore will not be described in detail. Optionally, the bottom portion 90 of each of the panels 20A includes the relieved portion 92 that is received inside a connector 1742B of an anchor member 1740B.

The anchor portion 1744B may be substantially identical to the relieved portion 440B (see FIG. 7) of the bottom portion 90 of the panels 20B. Alternatively, the anchor portion 1744B includes a laterally extending toe portion 1754B. As is apparent to those of ordinary skill in the art, while the cross-sectional shape of the toe portion 1754B differs from the cross-sectional shape of toe portion 450B depicted in the figures, the toe portion 1754B is functionally equivalent to the toe portion 450B functioning in a substantially identical manner thereto. Further, those of ordinary skill will readily recognize alternate cross-sectional shapes suitable for use with the toe portion 1754B, such as square, rectangular, oval, trapezoidal, arbitrary, and the like, and such embodiments are within the scope of the present invention.

Returning to FIG. 21B, the groove 1730B formed in the panel anchor strip 1716B may include an undercut portion 1760B configured to receive the toe portion 1754B in substantially the same manner the undercut portion 460B (see FIG. 7) configured receives the toe portion 450B. Like the undercut portion 460B, the undercut portion 1760B extends outwardly away from the center portion 132 of the base 30.

The anchor member 1740B and panel 20B coupled thereto may be assembled with the base 30 in the same manner the relieved portion 440B of the bottom portion 90 of the panels 20B is assembled with the base 30. The anchor member 1740B and panel 20B coupled thereto may be subsequently disassembled from the base 30 in the same manner the relieved portion 440B of the bottom portion 90 of the panels 20B is disassembled from the base 30.

In the embodiment depicted in the figures, the connector 1742B is offset laterally from the anchor portion 1744B creating an overhanging portion 1750B. The overhanging portion 1750B may be adjacent to the outside facing face 180 of the panel 20B. An underside 1752B of the overhanging portion 1750B may bear against the top surface 1718B of the panel anchor strips 1716B (see FIG. 21B) when the anchor member 1740B is coupled thereto. Engagement between the underside 1752B of the overhanging portion 1750B and the top surface 1718B of the panel anchor strips 1716B help prevent the anchor portion 1744B from rotating inside the groove 1730B and thereby disengaging the toe portion 1754B from the undercut portion 1760B and potentially disassembling the panel 20B from the base 30.

In the embodiment depicted in FIG. 18, a second elongated joining member 1560 is attached to each of the first side portion 110 and the second side portion 120 of the panels 20A. Further, an anchor member 1740A is affixed to the bottom portion 90 of each of the panels 20A. A first elongated joining member 1550 is attached to each of the first side portion 110 and the second side portion 120 of the panels 20B. An anchor member 1740B is affixed to the bottom portion 90 of each of the panels 20B. To assemble the container 1500, each of the panels 20A are installed in the groove 1730A of one of the panel anchor strips 1716A by sliding the anchor portion 1744A of the anchor member 1740A affixed to the panel 20A into one of the open ends 1762 or 1763 of the groove 1730A of the anchor strip 1716A in a manner similar to that depicted in FIG. 16.

Then, a selected two of the key portions 1612A, 1612B, and 1612C of the first elongated joining members 1550 attached to the first side portion 110 and the second side portion 120 of the panels 20B are inserted laterally into the unenclosed portions 1660A and 1660B, of the second elongated joining members 1560 attached to each of the first side portion 110 and the second side portion 120, respectively, of the panels 20A. The two key portions are selected based on the orientation, upright or upside-down of the first elongated joining member 1550 and the second elongated joining member 1560. Next, pressure is applied to the top portion 100 of each of the panels 20B causing them to slide toward the base 30 and forcing each of the key portions 1612A, 1612B, and 1612C of each of the first elongated joining members 1550 into a respective one of the enclosed portions 1654A, 1654B, and 1654C of the second elongated joining members 1560 affixed to the panels 20A. When each of the panels 20B is slid in this manner, the anchor portion 1744B of the anchor member 1740B affixed to the panel 20B is received into the groove 1730B of the anchor strip 1716B.

Unlike in previously discussed embodiments of the container, assembly of the container 1500 does not require the lifting of the panels 20B to the top portion 100 of the flanking panels 20A. Instead, the panels 20B need only be lifted high enough to insert the selected two of the key portions 1612A, 1612B, and 1612C of the first elongated joining members 1550 laterally into the unenclosed portions 1660A and 1660B, of the second elongated joining members 1560 attached to the panels 20A.

To disassemble the container 1500, each of the panels 20B is pulled away from the base 30 until the selected two of the key portions 1612A, 1612B, and 1612C of the first elongated joining members 1550 attached to the first side portion 110 and the second side portion 120 of the panels 20B are positioned inside the unenclosed portions 1660A and 1660B, of the second elongated joining members 1560 attached to each of the first side portion 110 and the second side portion 120, respectively, of the panels 20A. When the panels 20B are so moved the anchor portion 1744B of the anchor member 1740B affixed to the panel 20B exits the groove 1730B of the anchor strip 1716B. Then, the panels 20B are laterally disengaged from the panels 20A. Finally, each of the panels 20A may be removed from the groove 1730A of one of the panel anchor strips 1716A by sliding the anchor portion 1744A of the anchor member 1740A affixed to the panel 20A out one of the open ends 1762 or 1763 of the groove 1730A of the anchor strip 1716A.

Unlike in previously discussed embodiments of the container, the disassembly of the container 1500 does not require the lifting of the panels 20B to the top portion 100 of the flanking panels 20A. Instead, the panels 20B need only be lifted high enough to position the selected two of the key portions 1612A, 1612B, and 1612C of the first elongated joining members 1550 in the unenclosed portions 1660A and 1660B of the second elongated joining members 1560 attached to the panels 20A. Then, the panels 20B may be laterally disengaged from the panels 20A.

Returning to FIG. 18, a gap (not shown) may be disposed between the first elongated joining member 1550 and the second elongated joining member 1560 of each of the edge joining assemblies 1540 and the adjacent panel anchor strips 1716A and 1716B. The interior 12 of the container may be sealed by placing one or more seals, plugs, and the like in the gap. In the embodiment of the container 1500 depicted, a pair of plugs 1770 and 1772 are disposed one each inside a gap (not shown) defined between each of the first elongated joining member 1550 and the second elongated joining member 1560 whichever of the panel anchor strips 1716A and 1716B is adjacent thereto.

The container 1500 may include a lid 1780 constructed in general accordance with the lid 500' depicted in FIG. 10. With respect to the lid 1780, like reference numerals have been used to identify like components of the lid 500'. Only the components of the lid 1780 that differ substantially from the components of lid 500' will be described in detail.

The optional cap 520 may be disposed along the top portion 100 of each of the panels 20A and 20B. The top cap 520 extends between the edge joining assembly 1540 coupled to the first side portion 110 of a selected panel and the edge joining assembly 1540 coupled to the second side portion 120 of the same panel. Referring to FIGS. 9 and 10, the cap 520 may include a connector 522 substantially similar to the connector 200 of the first elongated joining member 150. The connector 522 may include a pair of longitudinally extending and spaced apart sidewalls 523 and 524 that flank a top portion 521 and define an open channel 526 therebetween. However, the caps 520 of the container 1500 omit the gripping projections 528 depicted in FIGS. 9 and 10. When the connector 522 is coupled to the top portion 100 of each of the panels 20A and 20B, the top portion 521 is disposed on top of the top portion 100. When the lid 1780 is affixed to the panels 20A and 20B, the top portion 521 is disposed between the top portion 100 and the lid 1780.

In various embodiments, the connector 522 is affixed to the top portion 100 of each of the panels 20A and 20B using any method suitable for affixing the connector 200 to the first side portion 110. The upper surface 529 of the cap 520 may be configured to mate with the relieved portion 509 formed in the perimeter portion 506' of the inside facing surface 504' of the lid 1780.

Because the top portion 521 of each of the caps 520 is disposed between the top portion 100 of one of the panels 20A and 20B and the lid 1780, in the embodiment depicted in FIG. 18, a gap (not shown) exists between the edge joining assemblies 1540 and the relieved portion 509 formed in the perimeter portion 506' of the inside facing surface 504' of the lid 1780. The interior 12 of the container 1500 may be sealed by placing a seal, a plug, and the like inside the gap to form a seal between the edge joining assemblies 1540 and the perimeter portion 506' of the inside facing surface 504' of the lid 1780. In the embodiment depicted, a first plug 1790 and a second plug 1792 are disposed between the perimeter portion 506' of the inside facing surface 504' of the lid 1780 and the first elongated joining member 1550 and the second elongated joining member 1560, respectively, forming each of the edge joining assemblies 1540.

Figure 23:
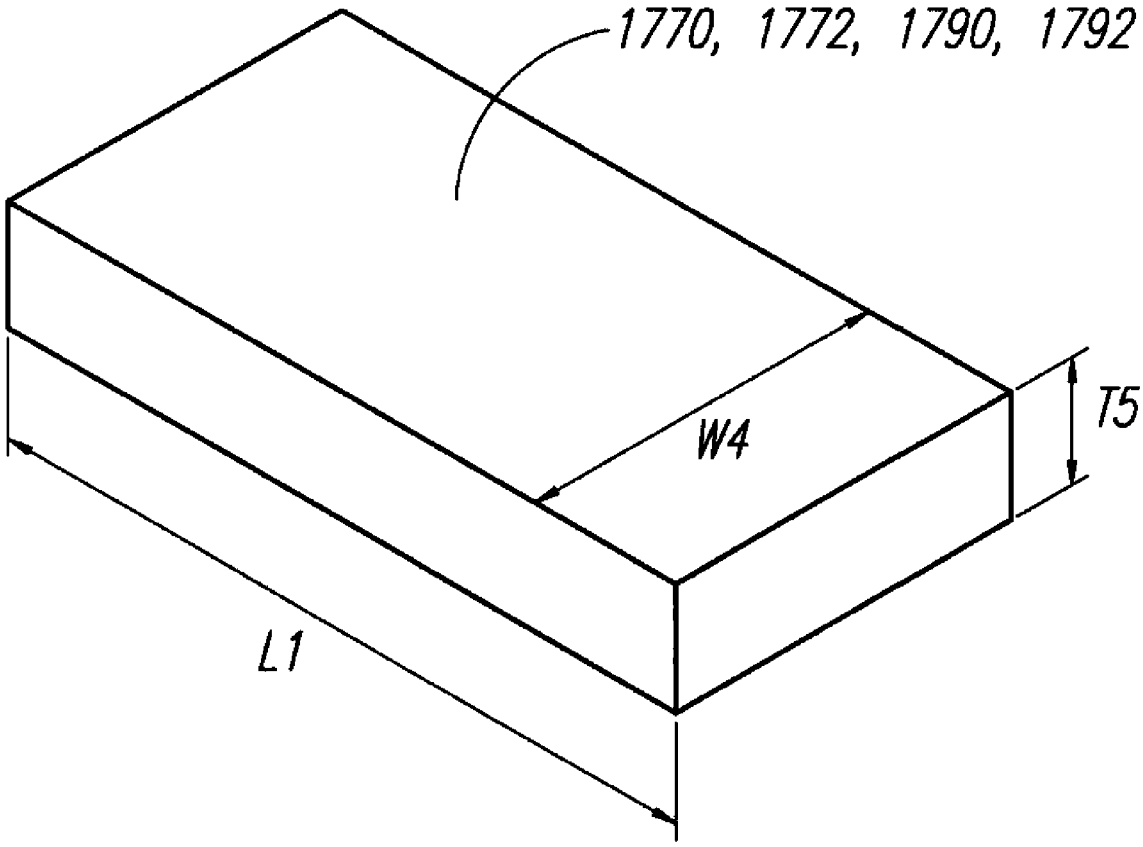
FIG. 23 is an enlarged perspective view of a plug of the container of FIG. 17.

Referring to FIG. 23, the plug 1770 is depicted. For illustrative purposes, only the plug 1770 will be described. However, each of the plugs 1772, 1790, and 1792 is substantially similar to the plug 1770. The plug 1770 is rectangular in shape having a length "L1" of about 1.0 inches to about 2.0 inches, a width "W4" of about 0.25 inches to about 1.25 inches, and a thickness "T3" of about 0.1 inches to about 0.5 inches. In particular embodiments, the length "L1" is about 1.5 inches, the width "W4" is about 0.75 inches, and thickness "T3" is about 0.25 inches. As is apparent to those of ordinary skill in the art, the size and shape of the plugs 1770, 1772, 1790 and 1792 may be determined at least in part by the size and shape of the first elongated joining member 1550 and the second elongated joining member 1560.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A container defining an interior for containing goods, the container comprising:

a first plurality of panels comprising a bottom portion having an anchor member, each of the first plurality of panels being flanked by a first elongated edge joining member having a channel with alternating partially enclosed portions and substantially unenclosed portions;

a second plurality of panels comprising a bottom portion having an anchor member, each of the second plurality of panels being flanked by a second elongated edge joining member having a plurality of spaced apart longitudinally aligned locking portions, the unenclosed portions of each of the first elongated edge joining members being configured to laterally receive at least one of the locking portions of one of the second elongated edge joining members, the partially enclosed portions of each of the first elongated edge joining members being configured to longitudinally slidably receive at least one of the locking portions of one of the second elongated edge joining members and retain at least one of the locking portions therein against lateral removal; and a base having a perimeter portion comprising:

a first groove for each of the first plurality of panels, the first groove having a first open end, the first groove being configured to slidably receive the anchor member into the first open end and retain the anchor member therein against upward removal, and a second groove for each of the second plurality of panels, the second groove being configured to receive and retain the anchor member therein.

2. The container of claim 1, the container further comprising:

for each of the first plurality of panels, a plug disposed between each of the first elongated edge joining members flanking the panel and the base.

3. The container of claim 1, the container further comprising:

for each of the second plurality of panels, a plug disposed between each of the second elongated edge joining members flanking the panel and the base.

4. The container of claim 3, wherein each of the first plurality of panels comprises a top portion opposite the bottom portion, each of the second plurality of panels comprises a top portion opposite the bottom portion, and the container further comprises:

a lid having an inside face facing the interior of the container, the inside face of the lid having a groove formed therein and configured to receive therein the top portions of each one of the first plurality of panels and the second plurality of panels.

5. The container of claim 4, wherein the top portion of each of the first and second pluralities of panels comprises a top cap, and the groove formed in the inside face of the lid is configured to receive therein the top caps of each one of the first plurality of panels and the second plurality of panels.

6. The container of claim 5, the container further comprises:

for each of the first plurality of panels a plug disposed between each of the first elongated edge joining members flanking the panel and the groove formed in the inside face of the lid.

7. The container of claim 6, the container further comprises:

for each of the second plurality of panels a plug disposed between each of the second elongated edge joining members flanking the panel and the groove formed in the inside face of the lid.

8. The container of claim 1, further comprising:

a lid having an inside surface facing the interior of the container and an outside surface opposite the inside surface, the outside surface having at least one recess;

a first strip of Velcro disposed inside the recess of the outside surface of the lid and attached to the lid; and a second strip of Velcro configured to mate and couple with the first strip of Velcro, the second strip being attached to one of the first plurality of panels or one of the second plurality of panels.

9. The container of claim 1, wherein the first plurality of panels and the second plurality of panels are constructed from a composite material comprising a fiber material and a polymer.

10. The container of claim 1, wherein the first plurality of panels and the second plurality of panels are constructed from a composite material comprising glass fibers and one of polypropylene, polyethylene terephthalate, and polyvinyl chloride.

11. The container of claim 1, wherein the base comprises a top surface, and for each of the first plurality of panels, the perimeter portion of the base comprises a first panel anchor strip coupled to the top surface of the base, for each of the first plurality of panels, the first groove of the perimeter portion of the base is formed in the first panel anchor strip, for each of the second plurality of panels, the perimeter portion of the base comprises a second panel anchor strip coupled to the top surface of the base, and for each of the second plurality of panels, the second groove of the perimeter portion of the base is formed in the second panel anchor strip.

12. The container of claim 1, wherein each of the partially enclosed portions comprises a pair of confronting overhang portions that extend from opposite sides of the channel toward one another defining a longitudinally extending opening therebetween and each of the locking portions comprises a proximal narrow portion and a distal wide portion wider than the proximal narrow portion, the proximal narrow portion being configured to slide within the longitudinally extending opening and the distal wide portion being configured to maintain the locking portion within the partially enclosed portion when the locking portion is received therein.

13. A container having an interior for containing goods, the container comprising:

a plurality of panels, each panel having a bottom portion and a pair of opposing side edge portions;

a base comprising a perimeter portion having a groove corresponding to each of the panels of the plurality of panels, the bottom portion of each of the panels being releasably received inside the groove of the perimeter portion of the base corresponding to the panel, a portion of the interior of the container being defined between the plurality the panels; and a plurality of edge joining assemblies, each of the edge joining assemblies being flanked by a first panel of the plurality of panels and second panel of the plurality of panels, each of the edge joining assemblies joins one of the side edge portions of the first panel to one of the side edge portions of the second panel, each of the plurality of edge joining assemblies comprising:

a first upright elongated joining member, and a second upright elongated joining member, each of the first and second upright elongated joining members comprising a connector coupled to one of the side edge portions of the pair of opposing side edge portions of one of the first and second panels, each of the first and second upright elongated joining members further comprising a locking portion, the locking portion of the second upright elongated joining member being configured to be slid longitudinally into the locking portion of the first upright elongated joining member and when therein laterally lock the first and second upright elongated joining members together to prevent lateral disengagement of the first upright elongated joining member from the second upright elongated joining member, the locking portion of the second upright elongated joining member comprising a plurality of spaced apart longitudinally extending and laterally outward projecting locking members, the locking portion of the first upright elongated joining member comprising a channel having alternating partially enclosed portions and substantially unenclosed portions, each of the substantially unenclosed portions being configured to receive one of the locking members of the second upright elongated joining member and permit the locking member to be slid laterally into an adjacent partially enclosed portion, each of the partially enclosed portions being configured to trap one of the locking members therein and prevents its lateral disengagement from the partially enclosed portion.

14. The container of claim 13, wherein the bottom portion of the first panel has a toe portion, the toe portion extending away from the bottom portion, the corresponding groove into which the bottom portion of the first panel is received has a first undercut portion into which the toe portion of the first panel is received, engagement between the toe portion of the first panel and the first undercut portion of the corresponding groove preventing a vertical disengagement of the first panel from the corresponding groove.

15. The container of claim 14, wherein the toe portion of the first panel extends away the interior of the container, and the toe portion of the first panel and the first undercut portion of the corresponding groove being configured to prevent the first panel from rotating within the corresponding groove toward from the interior of the container.

16. The container of claim 14, wherein the toe portion of the first panel extends toward the interior of the container, and the toe portion of the first panel and the first undercut portion of the corresponding groove being configured to prevent the first panel from rotating within the corresponding groove away from the interior of the container.

17. The container of claim 13, wherein the bottom portion of the second panel has a toe portion, the toe portion extends away from the bottom portion and away from the interior of the container, the corresponding groove into which the bottom portion of the second panel is received has a second undercut portion arranged such that the goods contained in the interior of the container bias the toe portion of the second panel into the second undercut portion of the corresponding groove, and engagement between the toe portion of the second panel and the second undercut portion of the corresponding groove preventing a vertical disengagement of the second panel from the corresponding groove and a rotation of the second panel within the corresponding groove toward the interior of the container.

18. The container of claim 13, wherein the perimeter portion of the base comprises a panel anchor strip corresponding to each of the panels of the plurality of panels and each of the grooves corresponding to each of the panels of the plurality of panels is formed in one of the panel anchor strips.

19. The container of claim 13, wherein a corner of the container is formed by the edge joining assemblies between the first and second panels.

20. The container of claim 13, wherein the first panel includes a bent portion positioned intermediate the pair of opposing side edge portions thereof.

21. The container of claim 13, wherein the panels of the plurality of panels are constructed from a composite material comprising a fiber material and a polymer.

22. The container of claim 13, wherein the panels of the plurality of panels are constructed from a composite material comprising glass fibers and one of polypropylene, polyethylene terephthalate, and polyvinyl chloride.

23. A container containing a good, the container comprising:

a plurality of elongated key members, each elongated key member having a plurality of spaced apart longitudinally extending key portions that projects laterally therefrom, the key portion having an end portion;

a plurality of elongated keyway members, each elongated keyway member having a longitudinally extending channel having alternating partially enclosed portions and substantially unenclosed portions, the unenclosed portions being configured to receive a portion of the key portions of a selected elongated key member of the plurality of elongated key members and allow the portion of the key portions to be slid longitudinally into adjacent partially enclosed portions, the partially enclosed portions being configured to laterally lock the portion of the key portions of the selected elongated key member inside the keyway portion, while allowing the keyway portion and key portion to slide longitudinally relative to one another;

a plurality of first panels, each first panel having a first side portion coupled to an elongated keyway member of the plurality of elongated keyway members, a second side portion coupled to an elongated keyway member of the plurality of elongated keyway members, and a bottom portion having a toe portion projecting therefrom;

a plurality of second panels, each of the second panels being flanked by a first flanking one of the first panels and a second flanking one of the first panels, each second panel having a first side portion coupled to an elongated key member of the plurality of elongated key members, a second side portion coupled to an elongated key member of the plurality of elongated key members, and a bottom portion having a toe portion projecting therefrom; and a base portion having a first groove corresponding to each of the first panels of the plurality of first panels, each of the first grooves having an interior, and open end, and an undercut portion extending laterally away from the interior of the first groove, the open end of each of the first grooves being configured to slidably receive the bottom portion of a selected first panel of the plurality of first panels into the interior of the first groove, the base portion further comprising a second groove corresponding to each of the second panels of the plurality of second panels, each of the second grooves having an interior and an undercut portion extending laterally away from the interior of the second groove, the interior of each of the second grooves being configured to receive the bottom portion of a selected second panel of the plurality of second panels when the selected second panel is in an upright position, wherein each of the second panels of the plurality of second panels is configured to receive an outwardly directed biasing force exerted by the good when the good is contained in the container that forces the toe portion of the bottom portion of the second panel into the undercut portion of the second groove, the first side portion of each of the second panels is laterally locked to the first side portion of a first flanking first panel by the slidable receipt of the portion of the key portions of the elongated key member of the first side portion of the second panel inside the partially enclosed portions of the keyway portion of the elongated keyway member of the first side portion of the first flanking first panel, and the second side portion of each of the second panels is laterally locked to the second side portion of a second flanking first panel by the slidable receipt of the of the portion of the key portions of the elongated key member of the second side portion of the second panel inside the partially enclosed portions of the keyway portion of the elongated keyway member of the second side portion of the second flanking first panel.

24. The container of claim 23, wherein each of the first panels of the plurality of first panels includes a first bent portion spaced from the first side portion and a second bent portion spaced from the second side portion.

25. The container of claim 23, wherein each of the first panels of the plurality of first panels includes a top portion opposite the bottom portion and each of the second panels of the plurality of second panels includes a top portion opposite the bottom portion, the container further comprising a lid having an inside surface facing the base portion, the inside surface of the lid having a groove formed therein, the top portion of each of the first panels and the top portion of each of the second panels being received inside the groove of the lid.

26. The container of claim 23, wherein the plurality of first panels and the plurality of second panels are constructed from a composite material comprising glass fibers and one of polypropylene, polyethylene terephthalate, and polyvinyl chloride.

27. The container of claim 26, wherein the plurality of first panels and the plurality of second panels are constructed from a composite material comprising a fiber material and a polymer.

* * * * *